US012594449B2

(12) United States Patent
Cohen et al.

(10) Patent No.: US 12,594,449 B2
(45) Date of Patent: Apr. 7, 2026

(54) EXERCISE EQUIPMENT

(71) Applicant: AMP FIT ISRAEL LTD, Tel Aviv (IL)

(72) Inventors: Shahar Cohen, Ramat Hasharon (IL); Guy Shneorson, Ra'anana (IL); Doron Doctoras, Ra'anana (IL); Zohar Goldenstein, Nes-Ziona (IL); Oren Erez, Tel-Aviv (IL)

(73) Assignee: AMP FIT ISRAEL LTD, Tel Aviv (IL)

( * ) Notice: Subject to any disclaimer, the term of this patent is extended or adjusted under 35 U.S.C. 154(b) by 0 days.

(21) Appl. No.: 19/239,684

(22) Filed: Jun. 16, 2025

(65) Prior Publication Data

US 2025/0303215 A1 Oct. 2, 2025

Related U.S. Application Data

(63) Continuation of application No. 19/051,942, filed on Feb. 12, 2025, which is a continuation of application
(Continued)

(51) Int. Cl.
*A63B 21/00* (2006.01)

(52) U.S. Cl.
CPC ..... *A63B 21/00047* (2013.01)

(58) Field of Classification Search
CPC ..... A63B 24/0087; A63B 21/0058; A63B 21/151; A63B 21/4035; A63B 21/4045;
(Continued)

(56) References Cited

U.S. PATENT DOCUMENTS 3,622,116 A 11/1971 Fellows
3,881,677 A 5/1975 Ihlenfeld
(Continued)

FOREIGN PATENT DOCUMENTS

CA 2466435 A1 5/2003
CN 106232187 A 12/2016
(Continued)

OTHER PUBLICATIONS

Melsteel, "T-Bar Sections: The Ultimate Choice for Structural Applications", Nov. 19, 2021, 5 pages.

*Primary Examiner* — Andrew M Kobylarz
(74) *Attorney, Agent, or Firm* — Workman Nydegger

(57) ABSTRACT

An exercise equipment comprising: a longitudinal beam having a beam longitudinal axis; an arm rotatably coupled, at least indirectly, to the longitudinal beam, the arm comprising a rotatable element being selectively rotatable about an arm rotation axis extending along a first direction transverse to the beam longitudinal axis; a locking mechanism connected, at least indirectly, to the longitudinal beam, the locking mechanism comprising: a locking base fixedly connected, at least indirectly, to the longitudinal beam; and a locking element at least indirectly pivotably coupled to the locking base, the locking element being pivotable between a locking position and an unlocking position about a pivot axis; and a lock controller operatively associated with the locking mechanism and operable for pivoting the locking element at least from the locking position to the unlocking position.

20 Claims, 47 Drawing Sheets

Related U.S. Application Data

No. PCT/IL2024/051186, filed on Dec. 15, 2024, which is a continuation of application No. PCT/IB2024/053763, filed on Apr. 17, 2024.

(60) Provisional application No. 63/611,051, filed on Dec. 15, 2023.

(58) Field of Classification Search
CPC ..... A63B 21/4034; A63B 2024/0093; A63B 2208/0242; A63B 2220/805; A63B 2220/833
See application file for complete search history.

(56) References Cited

U.S. PATENT DOCUMENTS 4,132,380 A 1/1979 Pastore
4,624,457 A 11/1986 Silberman et al.
4,640,019 A 2/1987 Paley
4,930,742 A 6/1990 Schofield et al.
4,953,852 A 9/1990 Donohue
4,968,028 A 11/1990 Wehrell
5,107,601 A 4/1992 Semchuck
5,385,525 A 1/1995 Davis
5,588,938 A 12/1996 Schneider et al.
5,605,313 A 2/1997 Erickson et al.
5,626,546 A 5/1997 Little
5,692,357 A 12/1997 Mccain
5,820,529 A 10/1998 Weintraub
5,820,629 A 10/1998 Cox
6,123,649 A 9/2000 Lee et al.
6,173,931 B1 1/2001 Johnson, Jr. et al.
6,877,641 B2 4/2005 Howland
7,090,085 B1 8/2006 Vicendese et al.
7,225,958 B2 6/2007 Hansen
7,527,600 B2 5/2009 Farmer
7,575,538 B1 8/2009 Clark
7,686,746 B2 3/2010 Koyama
8,020,821 B2 9/2011 Chen et al.
8,485,950 B2 7/2013 Adams
8,667,701 B1 3/2014 Geesaman
9,132,330 B2 9/2015 Brendle
9,656,116 B2 5/2017 Giannelli et al.
9,708,164 B2 7/2017 Jakob et al.
9,782,625 B1 10/2017 Blum et al.
9,968,819 B2 5/2018 Hockridge
10,022,590 B2 7/2018 Foley et al.
10,052,026 B1 8/2018 Tran
10,143,880 B1 * 12/2018 Boatwright ..... A63B 21/078
10,161,488 B1 12/2018 Meyer
10,179,265 B2 1/2019 Carr
10,322,315 B2 6/2019 Foley et al.
10,486,026 B2 11/2019 Foley et al.
10,500,442 B2 12/2019 Hong et al.
D873,935 S 1/2020 Van Den Berg
10,617,903 B2 4/2020 Orady et al.
10,639,521 B2 5/2020 Foley et al.
10,724,678 B1 7/2020 Elliott
10,737,134 B2 8/2020 Anderson et al.
10,743,685 B2 8/2020 Will et al.
10,758,780 B2 9/2020 Putnam
10,772,786 B2 9/2020 Suzuki et al.
10,799,025 B2 10/2020 Malott et al.
10,814,172 B1 10/2020 Ilfrey et al.
10,828,551 B2 11/2020 Putnam
10,864,406 B2 12/2020 Foley et al.
10,905,916 B1 2/2021 Malik
10,946,238 B1 3/2021 Ragus
10,974,094 B2 4/2021 Consiglio et al.
10,981,047 B2 4/2021 Putnam
10,987,565 B2 4/2021 Orady et al.
D921,132 S 6/2021 Orady et al.
11,045,709 B2 6/2021 Putnam
11,065,527 B2 7/2021 Putnam
11,090,547 B2 8/2021 Putnam
11,097,148 B2 8/2021 Kennington
11,110,336 B2 9/2021 Putnam
11,117,038 B2 9/2021 Putnam
11,117,039 B2 9/2021 Putnam
11,123,626 B1 9/2021 Putnam
11,135,503 B2 10/2021 Putnam
11,135,504 B1 10/2021 Putnam
11,135,505 B2 10/2021 Putnam
11,139,061 B2 10/2021 Foley et al.
11,145,398 B2 10/2021 Foley et al.
11,145,399 B2 10/2021 Foley et al.
11,167,172 B1 11/2021 Putnam et al.
11,170,886 B2 11/2021 Foley et al.
11,173,377 B1 11/2021 Putnam
11,173,378 B2 11/2021 Putnam
11,179,620 B2 11/2021 Putnam
11,183,288 B2 11/2021 Foley et al.
11,202,951 B1 12/2021 Augustin et al.
11,207,564 B2 12/2021 Ward et al.
11,219,799 B2 1/2022 Poure et al.
11,219,816 B2 1/2022 Putnam
11,220,412 B2 1/2022 Peuker et al.
11,253,770 B2 2/2022 Putnam
11,273,343 B2 3/2022 Augustin et al.
11,285,355 B1 3/2022 Nicholson et al.
11,289,185 B2 3/2022 Foley et al.
11,295,849 B2 4/2022 Foley et al.
11,295,850 B2 4/2022 Foley et al.
11,298,591 B2 4/2022 Evancha et al.
11,298,606 B2 4/2022 Putnam
11,311,778 B2 4/2022 Ward et al.
11,311,791 B2 4/2022 Dion et al.
11,324,983 B2 5/2022 Orady et al.
11,324,984 B2 5/2022 Kashkash et al.
11,331,538 B2 5/2022 Ward et al.
11,389,687 B2 7/2022 Orady et al.
11,432,412 B2 8/2022 Martin et al.
11,517,785 B1 12/2022 Nolan
11,547,223 B1 1/2023 Hassett et al.
11,623,126 B1 4/2023 Lagree et al.
11,642,560 B1 5/2023 Hewlett
11,642,569 B2 * 5/2023 Zhang ..... A63B 24/0087 482/9
11,686,138 B2 6/2023 Vilhelmsen
11,779,793 B2 10/2023 Peal et al.
11,794,057 B2 10/2023 Thach et al.
11,806,580 B1 11/2023 Nolan
11,931,616 B2 3/2024 Orady et al.
12,303,731 B1 * 5/2025 Yu ..... A63B 21/156
2002/0039954 A1 4/2002 Simonson
2002/0091043 A1 7/2002 Rexach
2003/0015414 A1 1/2003 Kajiura et al.
2003/0060345 A1 * 3/2003 Piane, Jr. ..... A63B 21/154 482/100
2004/0229730 A1 11/2004 Ainsworth et al.
2005/0115091 A1 6/2005 Harris
2009/0139127 A1 6/2009 Southard
2009/0170675 A1 7/2009 Giannelli et al.
2010/0125026 A1 5/2010 Zavadsky et al.
2011/0082010 A1 4/2011 Dyer et al.
2011/0105278 A1 5/2011 Fabbri et al.
2011/0319230 A1 12/2011 Brendle
2012/0237911 A1 9/2012 Watterson
2013/0035220 A1 2/2013 Adams
2013/0123071 A1 5/2013 Rhea
2013/0345883 A1 12/2013 Sloo et al.
2014/0038777 A1 2/2014 Bird
2014/0038781 A1 2/2014 Foley et al.
2014/0121072 A1 5/2014 Ercanbrack
2014/0135181 A1 5/2014 Smith
2014/0274600 A1 9/2014 Dalebout et al.
2015/0044648 A1 2/2015 White et al.
2015/0087486 A1 3/2015 Franks
2015/0182773 A1 7/2015 Olson et al.
2015/0182780 A1 7/2015 Olson
2015/0290488 A1 10/2015 Hopperstad et al.
2016/0325132 A1 * 11/2016 Nelson ..... A63B 23/03541
2017/0007886 A1 1/2017 Alessandri
2017/0112282 A1 4/2017 Will et al.

(56) References Cited

U.S. PATENT DOCUMENTS

| | | | |
|---|---|---|---|
| 2017/0177295 | A1 | 6/2017 | Bowen |
| 2017/0312564 | A1 | 11/2017 | Perez Gomez |
| 2017/0319941 | A1 | 11/2017 | Smith et al. |
| 2017/0333755 | A1 | 11/2017 | Rider |
| 2018/0005615 | A1 | 1/2018 | Macpherson |
| 2018/0036573 | A1 | 2/2018 | Lennox et al. |
| 2018/0048196 | A1 | 2/2018 | Kuo et al. |
| 2018/0159618 | A1 | 6/2018 | Winata |
| 2018/0174347 | A1 | 6/2018 | Chaney |
| 2018/0253840 | A1 | 9/2018 | Tran |
| 2019/0005373 | A1 | 1/2019 | Nims et al. |
| 2019/0099632 | A1 | 4/2019 | Orady et al. |
| 2019/0099633 | A1 | 4/2019 | Orady et al. |
| 2019/0143194 | A1 | 5/2019 | Evancha et al. |
| 2019/0184234 | A1 | 6/2019 | Packles et al. |
| 2019/0290964 | A1 | 9/2019 | Oren |
| 2019/0299043 | A1 | 10/2019 | Gisin et al. |
| 2019/0336827 | A1 | 11/2019 | Intonato et al. |
| 2019/0371114 | A1 | 12/2019 | Diefenbach et al. |
| 2020/0009444 | A1 | 1/2020 | Putnam |
| 2020/0014967 | A1 | 1/2020 | Putnam |
| 2020/0047027 | A1 | 2/2020 | Ward et al. |
| 2020/0047030 | A1 | 2/2020 | Ward et al. |
| 2020/0047031 | A1 | 2/2020 | Orady et al. |
| 2020/0047053 | A1 | 2/2020 | Ward et al. |
| 2020/0047055 | A1 | 2/2020 | Ward et al. |
| 2020/0054922 | A1 | 2/2020 | Azaria et al. |
| 2020/0070032 | A1 | 3/2020 | Orady et al. |
| 2020/0114194 | A1 | 4/2020 | McGhee |
| 2020/0139187 | A1 | 5/2020 | Kennington |
| 2020/0139194 | A1 | 5/2020 | Min et al. |
| 2020/0147445 | A1 | 5/2020 | Anderson et al. |
| 2020/0254311 | A1 | 8/2020 | Watterson et al. |
| 2020/0272311 | A1 | 8/2020 | Rotta |
| 2020/0276465 | A1 | 9/2020 | Orady et al. |
| 2021/0004981 | A1 | 1/2021 | Song et al. |
| 2021/0062966 | A1 | 3/2021 | Woolman et al. |
| 2021/0093921 | A1 | 4/2021 | Foley et al. |
| 2021/0128978 | A1 | 5/2021 | Gilstrom et al. |
| 2021/0169417 | A1 | 6/2021 | Burton |
| 2021/0170222 | A1 | 6/2021 | Consiglio et al. |
| 2021/0170224 | A1 | 6/2021 | Ragus |
| 2021/0205688 | A1 | 7/2021 | Liao et al. |
| 2021/0236874 | A1 | 8/2021 | Ward et al. |
| 2021/0291015 | A1 | 9/2021 | Consiglio et al. |
| 2021/0299520 | A1 | 9/2021 | Evancha et al. |
| 2021/0308528 | A1 | 10/2021 | Soifer |
| 2021/0339110 | A1 | 11/2021 | Putnam et al. |
| 2021/0342952 | A1 | 11/2021 | Putnam et al. |
| 2021/0362030 | A1 | 11/2021 | Putnam |
| 2021/0362031 | A1 | 11/2021 | Putnam |
| 2021/0370154 | A1 | 12/2021 | Putnam |
| 2021/0379447 | A1 | 12/2021 | Lee |
| 2021/0379471 | A1 | 12/2021 | Putnam |
| 2021/0379472 | A1 | 12/2021 | Putnam |
| 2021/0379473 | A1 | 12/2021 | Putnam |
| 2021/0387038 | A1 | 12/2021 | Premachandra et al. |
| 2022/0023738 | A1 | 1/2022 | Putnam |
| 2022/0032115 | A1 | 2/2022 | Mallard et al. |
| 2022/0032162 | A1 | 2/2022 | Putnam |
| 2022/0032163 | A1 | 2/2022 | Putnam |
| 2022/0040535 | A1 | 2/2022 | Warren |
| 2022/0047921 | A1 | 2/2022 | Bissonnette et al. |
| 2022/0050655 | A1 | 2/2022 | Chiang et al. |
| 2022/0054891 | A1 | 2/2022 | Owusu |
| 2022/0054925 | A1 | 2/2022 | Chiang et al. |
| 2022/0062680 | A1 | 3/2022 | Orady et al. |
| 2022/0071415 | A1 | 3/2022 | Putnam et al. |
| 2022/0072375 | A1 | 3/2022 | Putnam et al. |
| 2022/0072376 | A1 | 3/2022 | Putnam et al. |
| 2022/0072379 | A1 | 3/2022 | Putnam et al. |
| 2022/0072380 | A1 | 3/2022 | Trehan |
| 2022/0078503 | A1 | 3/2022 | Putnam et al. |
| 2022/0105417 | A1 | 4/2022 | Putnam |
| 2022/0118301 | A1 | 4/2022 | Valente et al. |
| 2022/0118304 | A1 | 4/2022 | Mcnally et al. |
| 2022/0118338 | A1 | 4/2022 | Putnam |
| 2022/0118339 | A1 | 4/2022 | Putnam |
| 2022/0118340 | A1 | 4/2022 | Putnam |
| 2022/0212055 | A1 | 7/2022 | Valente et al. |
| 2022/0225769 | A1 | 7/2022 | Brown et al. |
| 2022/0266084 | A1 | 8/2022 | Hoover |
| 2022/0368260 | A1 | 11/2022 | Chen |
| 2022/0370854 | A1* | 11/2022 | Zhang ..... A63B 21/169 |
| 2022/0386260 | A1 | 12/2022 | Lee et al. |
| 2023/0067732 | A1 | 3/2023 | Neuhaus |
| 2023/0089962 | A1 | 3/2023 | Shavit |
| 2023/0103725 | A1 | 4/2023 | Neuhaus |
| 2023/0123415 | A1 | 4/2023 | White et al. |
| 2023/0128721 | A1 | 4/2023 | Plummer |
| 2023/0226413 | A1 | 7/2023 | Neuhaus |
| 2023/0264062 | A1 | 8/2023 | Parker et al. |
| 2023/0276945 | A1 | 9/2023 | Mueller et al. |
| 2023/0277890 | A1 | 9/2023 | Peal et al. |
| 2023/0285806 | A1 | 9/2023 | Webster et al. |
| 2023/0338770 | A1 | 10/2023 | Chen |
| 2024/0033571 | A1 | 2/2024 | James et al. |
| 2024/0042266 | A1 | 2/2024 | Chevalier |
| 2024/0226661 | A1 | 7/2024 | Schloss et al. |
| 2024/0252875 | A1* | 8/2024 | Cohen ..... A63B 21/4035 |
| 2024/0342544 | A1* | 10/2024 | Cohen ..... A63B 21/156 |

FOREIGN PATENT DOCUMENTS

| | | | | |
|---|---|---|---|---|
| CN | 113616976 | A | 11/2021 | |
| CN | 115397523 | A * | 11/2022 | ..... A63B 21/00069 |
| CN | 217724440 | U | 11/2022 | |
| CN | 116139456 | A | 5/2023 | |
| EP | 655264 | A1 | 5/1995 | |
| GB | 2414078 | A | 11/2005 | |
| GB | 2531038 | A | 4/2016 | |
| GB | 2612311 | A * | 5/2023 | ..... A63B 21/4049 |
| KR | 101425769 | B1 | 8/2014 | |
| WO | 2018044721 | A1 | 3/2018 | |
| WO | 2019063960 | A1 | 4/2019 | |
| WO | 2019143488 | A1 | 7/2019 | |
| WO | 2019231982 | A1 | 12/2019 | |
| WO | 2020033508 | A1 | 2/2020 | |
| WO | 2020033530 | A1 | 2/2020 | |
| WO | 2020033544 | A1 | 2/2020 | |
| WO | 2020033548 | A2 | 2/2020 | |
| WO | 2020123756 | A1 | 6/2020 | |
| WO | 2021021447 | A1 | 2/2021 | |
| WO | 2021081094 | A1 | 4/2021 | |
| WO | 2021118859 | A1 | 6/2021 | |
| WO | 2021154298 | A1 | 8/2021 | |
| WO | 2021222497 | A1 | 11/2021 | |
| WO | 2022011448 | A1 | 1/2022 | |
| WO | 2022026486 | A1 | 2/2022 | |
| WO | 2022051474 | A2 | 3/2022 | |
| WO | 2022132814 | A1 | 6/2022 | |
| WO | 2024175972 | A1 | 8/2024 | |

* cited by examiner

EXERCISE EQUIPMENT

This application is a continuation of U.S. patent application Ser. No. 19/051,942 filed on Feb. 12, 2025, and entitled "EXERCISE EQUIPMENT," which is a continuation of PCT/IL2024/051186, filed Dec. 15, 2024, which is a continuation of PCT/IB2024/053763, filed Apr. 17, 2024, which claims benefit of and priority to U.S. Provisional Patent Application Ser. No. 63/611,051, filed Dec. 15, 2023, which applications are expressly incorporated herein by reference in their entirety.

TECHNOLOGICAL FIELD

This invention generally relates to exercise equipment, add-on accessories for use with the exercise equipment, such as an add-on platform, and methods for using the exercise equipment with or without an add-on accessory.

BACKGROUND

US20220212055A1 to VALENTE et al. discloses "An exercise machine is disclosed. A vertically oriented console unit comprises: a first cable; a screen; and a motor providing a controllable tension force on the first cable. An auxiliary pulley that is remote from the console unit is disclosed, wherein the first cable is routable over the auxiliary pulley that is remote from the console unit.

An exercise machine is disclosed. A resistance unit comprises: a first cable; and a motor providing a controllable tension force on a first cable. An adjustable screen unit is disclosed, wherein the adjustable screen unit is at least one of tiltable, rotatable, and translatable."

GENERAL DESCRIPTION

The presently disclosed subject matter relates to an exercise equipment and accessories usable therewith for performance of exercise routines. The exercise equipment of the kinds described herein below generally include an equipment cable (interchangeably referred to herein as cable), having a first end generally anchored within a frame (e.g. a beam) of the exercise equipment and a second end which extends via an arm of the exercise equipment and then externally to the exercise equipment. A resistance force is applied to the first end (or segment) of the cable by a resistance source, for example, a motorized resistance source, while the second end is manipulated at least indirectly by a user for performance of one or more exercise routines, in which the user works against the resistance applied by the resistance source. In some embodiments, the second end is associated (e.g. connected to) an add-on accessory, for example as described herein.

In some embodiments, the exercise equipment is usable with a user interface installed on a personal device, such as a cellular phone application. The cellular phone application can be suitable for selection of different types of exercises, personal adaptations to the user, presenting of instructions and guidance to the user, and other uses. The cellular phone application and the exercise equipment may actively communicate with each other.

According to a first aspect of the presently disclosed subject matter, provided herein is an exercise equipment, and methods for use thereof, allowing easy insertion, installation, removal and/or replacement of the equipment cable. Cable insertion pathways, guiding elements and anchoring solutions are described.

According to a second aspect of the presently disclosed subject matter, provided herein is an exercise equipment, and methods for use thereof, allowing adjustment of an orientation of the arm of the exercise equipment and/or a position of the arm along the frame or the beam. Arm orientation setting and locking mechanisms are described.

According to a third aspect of the presently disclosed subject matter, provided herein are add-on accessories, for example add-on platforms and/or spool assemblies, to be connected to and used with an exercise equipment for potentially enhancing the usability of the exercise equipment, for example, increasing the number of exercise routines performable with the exercise equipment, modifying the resistance applied by a resistance source of the exercise equipment, or others described herein further below in detail.

Embodiments 1 to 70 listed below relate at least to the first aspect of the presently disclosed subject matter.

1. An exercise equipment comprising:
a frame having a frame internal volume, said frame comprising a cable anchor;
an arm having an arm internal volume, said arm comprising a shoulder portion at least indirectly coupled to the frame and a wrist portion opposite the shoulder portion, the wrist portion operable to at least indirectly connect thereto an exercise interface;
a cable path extending between the wrist portion and the cable anchor at least partially through the frame internal volume and the arm internal volume, said cable path comprising a frame cable path portion extending within the frame internal volume, said frame preventing access to at least a part of the frame cable path portion by a user;
at least one cable receiving opening in communication with at least one of the frame internal volume and the arm internal volume, said opening being accessible by a user for pushing therethrough an end of a cable into said at least one of the frame internal volume and the arm internal volume; and
a cable guiding arrangement at least partially located within the frame internal volume and operable for guiding the end of the cable through the frame internal volume on the frame cable path portion to the cable anchor while the cable is being pushed through the cable receiving opening.

2. The exercise equipment according to Embodiment 1, further comprising one or more sheaves located within at least one of the frame internal volume and arm internal volume, said one or more sheaves at least partially defining the cable path.
3. The exercise equipment according to Embodiment 2, wherein housings of the frame and the arm are constructed to prevent manual access to the one or more sheaves.
4. The exercise equipment according to Embodiment 2 or 3, wherein the cable guiding arrangement comprises one or more guiding elements positioned within said at least one of the frame internal volume and the arm internal volume, said one or more guiding elements being operatively associated with the one or more sheaves and being operable to guide the end of the cable onto the one or more sheaves while the cable is being pushed through the at least one cable receiving opening.
5. The exercise equipment according to Embodiment 4, wherein the one or more guiding elements at least partially cover the one or more sheaves.
6. The exercise equipment according to Embodiment 4 or 5, wherein at least one of the one or more guiding elements has a corresponding entry opening through which the end of the cable enters the at least one guiding element, and a corresponding exit opening through which the end of the cable exits the at least one guiding element.

7. The exercise equipment according to Embodiment 6, wherein the entry opening is larger than the exit opening.

8. The exercise equipment according to any one of Embodiments 4 to 7, wherein the one or more sheaves comprise a first sheave and a second sheave.

9. The exercise equipment according to Embodiment 8, wherein the one or more guiding elements comprise a single guiding element operatively associated with the first and second sheaves and being operable to guide the end of the cable onto the first and second sheaves while the cable is being pushed through the at least one cable receiving opening.

10. The exercise equipment according to Embodiment 8, wherein the one or more guiding elements comprise a first guiding element operatively associated with the first sheave and being operable to guide the end of the cable onto the first sheave, and a second guiding element operatively associated with the second sheave and being operable to guide the end of the cable onto the second sheave.

11. The exercise equipment according to Embodiment 10, wherein the first guiding element has a corresponding first element entry opening through which the end of the cable enters the first guiding element, and a corresponding first element exit opening through which the end of the cable exits the first guiding element, and the second guiding element has a corresponding second element entry opening through which the end of the cable enters the second guiding element, and a corresponding second element exit opening through which the end of the cable exits the second guiding element.

12. The exercise equipment according to Embodiment 11, wherein the second element entry opening is aligned with the first element exit opening for receiving the end of the cable within the second guiding element when the end of the cable exits the first guiding element, while the cable is being pushed through the at least one cable receiving opening.

13. The exercise equipment according to any one of Embodiments 4 to 12, wherein at least one of the one or more sheaves comprise a circumferential channel defining at least partially the cable path, and a corresponding one of the one or more guiding elements at least partially covers the circumferential channel.

14. The exercise equipment according to Embodiment 13, wherein the corresponding one of the one or more guiding elements guides the end of the cable into the circumferential channel.

15. The exercise equipment according to any one of Embodiments 4 to 14, wherein the one or more guiding elements at least partially cover each of the one or more sheaves circumferentially.

16. The exercise equipment according to any one of Embodiments 4 to 15, wherein the one or more guiding elements form at least partially closed channels together with the one or more sheaves.

17. The exercise equipment according to Embodiment 16, wherein the at least partially closed channels define at least partially the cable path.

18. The exercise equipment according to any one of Embodiments 4 to 17, wherein the one or more sheaves comprise one or more frame sheaves located within the frame internal volume, said one or more frame sheaves at least partially defining the frame cable path portion.

19. The exercise equipment according to Embodiment 18, wherein the one or more guiding elements comprises one or more frame guiding elements positioned within the frame internal volume and operatively associated with the one or more frame sheaves, said one or more frame guiding elements being operable to guide the end of the cable onto the one or more frame sheaves while the cable is being pushed through the at least one cable receiving opening.

20. The exercise equipment according to Embodiment 19, wherein the one or more frame sheaves comprise a first frame sheave and a second frame sheave.

21. The exercise equipment according to Embodiment 20, wherein the one or more frame guiding elements comprise a single frame guiding element operatively associated with the first and second frame sheaves and being operable to guide the end of the cable onto the first and second frame sheaves while the cable is being pushed through the at least one cable receiving opening.

22. The exercise equipment according to Embodiment 21, wherein the frame guiding elements has a corresponding frame guiding element entry opening through which the end of the cable enters the frame guiding element, and a corresponding frame guiding element exit opening through which the end of the cable exits the frame guiding element.

23. The exercise equipment according to any one of Embodiments 1 to 22, said cable path comprising an arm cable path portion extending within the arm internal volume, wherein a housing of said arm prevents user access to at least a part of the arm cable path portion.

24. The exercise equipment according to Embodiment 23, when at least indirectly dependent on any one of Embodiments 4 to 22, wherein the one or more sheaves comprise one or more arm sheaves located at least partially within the arm internal volume, said one or more arm sheaves at least partially defining the arm cable path portion.

25. The exercise equipment according to Embodiment 24, wherein the one or more guiding elements comprises one or more arm guiding elements positioned within the arm internal volume and operatively associated with the one or more arm sheaves, said one or more arm guiding elements being operable to guide the end of the cable onto the one or more arm sheaves while the cable is being pushed through the at least one cable receiving opening.

26. The exercise equipment according to Embodiment 25, wherein the one or more arm sheaves comprise a first arm sheave and a second arm sheave.

27. The exercise equipment according to Embodiment 26, wherein the one or more arm guiding elements comprise a first arm guiding element operatively associated with the first arm sheave and being operable to guide the end of the cable onto the first arm sheave, and a second arm guiding element operatively associated with the second arm sheave and being operable to guide the end of the cable onto the second arm sheave.

28. The exercise equipment according to Embodiment 27, wherein the first arm guiding element has a corresponding first arm guiding element entry opening through which the end of the cable enters the first arm guiding element, and a corresponding first arm guiding element exit opening through which the end of the cable exits the first arm guiding element, and the second arm guiding element has a corresponding second arm guiding element entry opening through which the end of the cable enters the second arm guiding element, and a corresponding second arm guiding element exit opening through which the end of the cable exits the second arm guiding element.

29. The exercise equipment according to Embodiment 28, wherein the second arm guiding element entry opening is aligned with the first arm guiding element exit opening for receiving the end of the cable within the second arm guiding element when the end of the cable exits the first arm guiding element, while the cable is being pushed through the at least one cable receiving opening.

30. The exercise equipment according to Embodiment 28 or 29, when at least indirectly dependent on Embodiment 22, wherein the frame guiding element entry opening is at least selectively aligned with the second arm guiding element exit opening for receiving the end of the cable within the frame guiding element when the end of the cable exits the second arm guiding element, while the cable is being pushed through the at least one cable receiving opening.

31. The exercise equipment according to Embodiment 28 or 29, when at least indirectly dependent on Embodiment 22, wherein the first arm guiding element entry opening is at least selectively aligned with the frame guiding element exit opening for receiving the end of the cable within the first arm guiding element when the end of the cable exits the frame guiding element, while the cable is being pushed through the at least one cable receiving opening.

32. The exercise equipment according to any one of Embodiments 1 to 31, said arm comprising an elongated arm member and a shoulder at least indirectly coupling the elongated arm member to the frame, said shoulder having a shoulder internal volume constituting a part of the arm internal volume and said elongated arm member having an arm member internal volume constituting a part of the arm internal volume.

33. The exercise equipment according to Embodiment 32, when dependent at least indirectly on Embodiment 25, wherein the one or more arm sheaves and the one or more arm guiding elements are located at least partially within the shoulder internal volume.

34. The exercise equipment according to Embodiment 33, wherein the elongated arm member is a hollow tube defining the arm member internal volume.

35. The exercise equipment according to Embodiment 34, said elongated arm member comprising a shoulder connection end having a shoulder connection opening establishing communication between the arm member internal volume and the shoulder internal volume.

36. The exercise equipment according to Embodiment 35, when dependent at least indirectly on Embodiment 28, wherein the first arm guiding element entry opening is aligned with the shoulder connection opening for receiving the end of the cable within the first arm guiding element when the end of the cable exits the elongated arm member via the shoulder connection opening, while the cable is being pushed through the at least one cable receiving opening.

37. The exercise equipment according to Embodiment 35 or 36, said elongated arm member comprising a wrist connection end opposite the shoulder connection end, said wrist connection end having a wrist connection opening and being operable for connecting a wrist member thereto.

38. The exercise equipment according to any one of Embodiments 33 to 37, wherein the hollow tube is free of obstructions, allowing the end of the cable to pass therethrough.

39. The exercise equipment according to any one of Embodiments 1 to 38, wherein the frame is an elongated frame extending along a frame longitudinal axis thereof.

40. The exercise equipment according to Embodiment 39, wherein the frame comprises an elongated frame channel extending along the frame longitudinal axis, the frame channel defining at least partially the frame cable path portion, said frame channel being at least partially closed from sides and comprising a frame channel top opening and a frame channel bottom opening allowing the cable to be conveyed through the frame channel.

41. The exercise equipment according to Embodiment 40, wherein the frame channel is free of obstructions, allowing the end of the cable to pass therethrough.

42. The exercise equipment according to any one of Embodiments 1 to 41, wherein the at least one cable receiving opening is formed in at least one of the frame and the arm.

43. The exercise equipment according to any one of Embodiments 1 to 42, when dependent at least indirectly on Embodiment 37 or 38, wherein the wrist connection opening constitutes the at least one cable receiving opening.

44. The exercise equipment according to any one of Embodiments 1 to 43, wherein the at least one cable receiving opening comprises a first cable receiving opening and a second cable receiving opening.

45. The exercise equipment according to Embodiment 44, wherein the first cable receiving opening is formed in the frame and is in communication with the frame internal volume, said first cable receiving opening being accessible by a user for pushing therethrough the end of the cable into the frame internal volume.

46. The exercise equipment according to Embodiment 45, when dependent at least indirectly on Embodiment 22, wherein the frame guiding element entry opening is aligned with the first cable receiving opening for receiving the end of the cable within the frame guiding element when the end of the cable is inserted through the first cable receiving opening.

47. The exercise equipment according to any one of Embodiments 44 to 46, wherein the second cable receiving opening is formed in the arm and is in communication with the arm internal volume, said second cable receiving opening being accessible by a user for pushing therethrough the end of the cable into the arm internal volume.

48. The exercise equipment according to Embodiment 47, when dependent at least indirectly on Embodiment 28, wherein the first arm guiding element entry opening is aligned with the second cable receiving opening for receiving the end of the cable within the first arm guiding element when the end of the cable is inserted through the second cable receiving opening.

49. The exercise equipment according to Embodiment 47 or 48, when dependent at least indirectly on Embodiment 32, wherein the second cable receiving opening is formed in the shoulder.

50. The exercise equipment according to any one of Embodiments 44 to 49, wherein the first and second cable receiving openings are aligned with each other, one of the first and second cable receiving openings receiving therethrough the end of the cable when the end of the cable exits from the other one of the first and second cable receiving openings, while the cable is being pushed.

51. The exercise equipment according to any one of Embodiments 43 to 50, wherein the first cable opening is accessible by a user for pushing therethrough a first end of the cable into the frame internal volume, and the second cable opening is accessible by a user for pushing therethrough a second end of the cable opposite the first end into the arm internal volume.

52. The exercise equipment according to any one of Embodiments 1 to 51, wherein the frame comprises:

a removable faceplate connected to a frame chassis via a quick-connection arrangement; and an anchor access opening operable, upon removal of the faceplate, to allow manual access to the cable anchor from outside the frame for anchoring the end of the cable to the cable anchor.

53. The exercise equipment according to any one of Embodiments 1 to 52, further comprising a spool constituting the cable anchor.

54. The exercise equipment according to Embodiment 53, the spool having a spool internal volume defined at least partially by a spool wall operable for winding at least a segment of the cable thereon.

55. The exercise equipment according to Embodiment 54, wherein the spool wall comprises a spool wall hole extending from an exterior side of the spool to the spool internal volume.

56. The exercise equipment according to Embodiment 55, when dependent at least indirectly on Embodiment 52, wherein the anchor access opening is aligned with the exterior side of the spool, allowing a user to access the end of the cable on the exterior side of the spool and to insert the end of the cable into the spool internal volume via the spool wall hole.

57. The exercise equipment according to Embodiment 56, wherein the frame comprises a spool internal volume access opening operable, upon removal of the faceplate, to allow a user to access the spool internal volume from outside the frame at least for anchoring the end of the cable within the spool internal volume.

58. The exercise equipment according to any one of Embodiments 53-57, wherein the spool is at least indirectly coupled to a resistance source that is operable to apply resistance onto the cable, once the cable is anchored to the spool.

59. The exercise equipment according to Embodiment 58, wherein the resistance source is operable to rotate the spool in a winding direction thereby causing the cable to wind onto the spool once the cable is anchored to the spool.

60. The exercise equipment according to Embodiment 59, wherein the cable when pulled by a user against the resistance applied onto the cable by the resistance source, causes the spool to rotate in an unwinding direction, opposite the winding direction, and is unwound from the spool.

61. The exercise equipment according to any one of Embodiments 58 to 60, further comprising the resistance source.

62. The exercise equipment according to any one of Embodiments 58 to 61, wherein the resistance source includes an electronically adjustable weight resistance motor.

63. A method for inserting and installing a cable into the exercise equipment according to any one of Embodiments 1 to 62, the method comprising:

inserting an end of the cable through the at least one cable receiving opening;

pushing the cable through the at least one cable receiving opening for advancing the cable through the cable path while being guided by the cable guiding arrangement until the end of the cable reaches the cable anchor;

accessing the end of the cable through an anchor access opening of the frame; and anchoring the end of the cable to the cable anchor.

64. A method for inserting and installing a cable into the exercise equipment according to Embodiment 57, the method comprising:

inserting an end of the cable through the at least one cable receiving opening;

pushing the cable through the at least one cable receiving opening for advancing the cable through the cable path while being guided by the cable guiding arrangement until the end of the cable reaches the exterior side of the spool;

accessing the end of the cable through the anchor access opening of the frame;

inserting the end of the cable into the spool internal volume via the spool wall hole;

accessing the end of the cable through the spool internal volume access opening of the frame; and anchoring the end of the cable within the spool internal volume.

65. The method according to Embodiment 64, further comprising:

releasing the end of the cable from within the spool internal volume by accessing via the spool internal volume access opening of the frame; and pulling the cable out of the exercise equipment via the at least one cable receiving opening.

66. A method for inserting and installing a cable into the exercise equipment according to Embodiment 44, wherein the first cable receiving opening is formed in the frame and is in communication with the frame internal volume and the second cable receiving opening is formed in the arm and is in communication with the arm internal volume, the method comprising:

inserting a first end of the cable through the first cable receiving opening;

pushing a first part of the cable through the first cable receiving opening for advancing the first part of the cable through the frame while being guided by the cable guiding arrangement until the first end of the cable reaches the cable anchor;

inserting a second end, opposite the first end, of the cable through the second cable receiving opening; and pushing a second part of the cable through the second cable receiving opening for advancing the second part of the cable through the arm while being guided by the cable guiding arrangement.

67. The method according to Embodiment 66, wherein the second cable receiving opening is formed in the shoulder portion, and said pushing the second part of the cable through the second cable receiving opening includes pushing the second part of the cable through the second cable receiving opening at least until the second end of the cable reaches the wrist portion.

68. The method according to Embodiment 67, further comprising attaching at least indirectly the second end of the cable to an exercise interface.

69. The method according to any one of Embodiments 66 to 68, further comprising: accessing the first end of the cable through an anchor access opening of the frame; and anchoring the end of the cable to the cable anchor.

70. The method according to Embodiment 69, further comprising:

releasing the first end of the cable from the cable anchor; and pulling the cable out of the exercise equipment via the first and second cable receiving openings through the wrist portion of the arm.

Embodiments 1 to 51 listed below relate at least to the second aspect of the presently disclosed subject matter.

1. An exercise equipment comprising:

a longitudinal beam having a beam longitudinal axis;

an arm rotatably coupled, at least indirectly, to the longitudinal beam, said arm comprising a rotatable element being selectively rotatable about an arm rotation axis extending along a first direction transverse to the beam longitudinal axis;

a locking mechanism connected, at least indirectly, to the longitudinal beam, said locking mechanism comprising:

a locking base fixedly connected, at least indirectly, to the longitudinal beam; and a locking element at least indirectly pivotably coupled to the locking base, said locking element being pivotable between a locking position and an unlocking position about a pivot axis, wherein said locking element, in the locking position, engages the rotatable element and prevents the rotation thereof about the arm rotation axis, and in the unlocking position, is distant from the rotatable element and allows the rotation thereof about the arm rotation axis; and a lock controller operatively associated with the locking mechanism and operable for pivoting the locking element at least from the locking position to the unlocking position.

2. The exercise equipment according to Embodiment 1, wherein the pivot axis extends along a second direction transverse to the first direction.

3. The exercise equipment according to Embodiment 2, wherein the second direction is perpendicular to the first direction.

4. The exercise equipment according to any one of Embodiments 1 to 3, wherein the pivot axis is at least partially located at the locking base.

5. The exercise equipment according to any one of Embodiments 1 to 4, wherein the pivot axis is spaced apart from the arm rotation axis.

6. The exercise equipment according to any one of Embodiments 1 to 5, wherein the locking element at least partially extends from the locking base in a direction transverse the pivot axis.

7. The exercise equipment according to any one of Embodiments 1 to 6, wherein the locking element extends at least partially along the pivot axis.

8. The exercise equipment according to any one of Embodiments 1 to 7, wherein the rotatable element comprises one or more lockable elements, wherein said locking element in the locking position lockingly engages at least one of the one or more lockable elements.

9. The exercise equipment according to Embodiment 8, wherein the one or more lockable elements are formed as recesses defined on the rotatable element, and the locking element in the locking position is positioned at least partially in at least one of the recesses thereby restricting movement of the rotatable element.

10. The exercise equipment according to Embodiment 8 or 9, wherein the one or more lockable elements comprise multiple lockable elements, wherein said locking element in the locking position lockingly engages at least two of the multiple lockable elements.

11. The exercise equipment according to Embodiment 10, wherein the multiple lockable elements are formed as recesses, and the locking element in the locking position is seated at least partially in at least two of the recesses thereby restricting movement of the rotatable element.

12. The exercise equipment according to Embodiment 10 or 11, wherein the at least two lockable elements are formed on the rotatable element and are located diametrically opposite to each other with respect to the arm rotation axis.

13. The exercise equipment according to Embodiment 9 or 11, or Embodiment 10 or 12 when at least indirectly dependent on Embodiment 9 or 11, wherein each of the recesses has an open end facing the first direction, said open end allowing the locking element to at least partially enter into and exit from the corresponding recess.

14. The exercise equipment according to any of Embodiments 8 to 13, wherein the one or more lockable elements comprise multiple lockable elements, each lockable element corresponding to a respective orientation of the rotatable element about the arm rotation axis.

15. The exercise equipment according to Embodiment 14, wherein the locking element, when engaged with a lockable element of the one or more lockable elements, locks the rotatable element in a corresponding position about the arm rotation axis.

16. The exercise equipment according to Embodiment 14 or 15, wherein the orientation of the rotatable element about the arm rotation axis sets an orientation of the arm with respect to the longitudinal beam.

17. The exercise equipment according to any one of Embodiments 1 to 16, wherein the locking element comprises an elongate element extending along the pivot axis.

18. The exercise equipment according to Embodiment 17, wherein the elongate element engages the rotatable element in the locking position of the locking element.

19. The exercise equipment according to Embodiment 17 or 18, wherein the elongate element is in the form of a rod or a pin.

20. The exercise equipment according to any one of Embodiments 1 to 19, wherein the locking mechanism comprises a locking element biasing arrangement operable to bias the locking element towards one of the locking positions and the unlocking position.

21. The exercise equipment according to Embodiment 20, wherein the locking element biasing arrangement is operable to bias the locking element towards the locking position.

22. The exercise equipment according to Embodiment 20 or 21, wherein the locking element biasing arrangement comprises a spring.

23. The exercise equipment according to any one of Embodiments 1 to 22, wherein the arm comprises a shoulder and an elongate arm member, said arm being at least indirectly coupled to the longitudinal beam via the shoulder.

24. The exercise equipment according to Embodiment 23, wherein the shoulder is integrally formed with the elongate arm member.
25. The exercise equipment according to Embodiment 24, wherein the shoulder is unitarily formed with the elongate arm member.
26. The exercise equipment according to any one of Embodiments 22 to 25, wherein the shoulder comprises an at least partially hollow shoulder housing.
27. The exercise equipment according to Embodiment 26, wherein the rotatable element is at least partially positioned within the shoulder housing.
28. The exercise equipment according to Embodiment 26 or 27, wherein the lock controller is at least partially positioned within the shoulder housing and extends at least partially along the arm rotation axis.
29. The exercise equipment according to any one of Embodiments 1 to 28, wherein the lock controller is at least selectively engageable with the locking element for pivoting the locking element at least from the locking position to the unlocking position.
30. The exercise equipment according to Embodiment 29, wherein the lock controller is at least selectively engageable with the locking element at a location spaced apart from the pivot axis.
31. The exercise equipment according to Embodiment 29 or 30, wherein the lock controller is displaceable between an arm orienting position associated with the unlocking position of the locking element and a neutral position associated with the locking position of the locking element.
32. The exercise equipment according to Embodiment 31, wherein the lock controller while being displaced from the neutral position to the arm orienting position engages the locking element and displaces the locking element towards the unlocking position.
33. The exercise equipment according to Embodiment 31 or 32, wherein the lock controller comprises an actuator operable to be actuated by a user to displace the lock controller at least from the neutral position to the arm orienting position.
34. The exercise equipment according to Embodiment 33, wherein the lock controller comprises a controlling element operable to pivot the locking element at least from the locking position to the unlocking position.
35. The exercise equipment according to any one of Embodiments 31 to 34, further comprising a lock controller biasing arrangement operable to bias the lock controller towards the neutral position.
36. The exercise equipment according to Embodiment 35, wherein the lock controller biasing arrangement comprises a spring.
37. The exercise equipment according to any one of Embodiments 29 to 36, wherein the lock controller comprises a locking element engaging member operable for at least selectively engaging the locking element.
38. The exercise equipment according to Embodiment 17 or any one of Embodiments 18-37, when dependent at least indirectly on Embodiment 17, wherein the locking element comprises at least one extension member extending from the locking base, transverse to the pivot axis, and the elongate element extends from the at least one extension member in a direction parallel to the pivot axis.
39. The exercise equipment according to any one of Embodiments 1 to 38, further comprising a trolley moveably coupled to the longitudinal beam and operable to move along the beam longitudinal axis.
40. The exercise equipment according to Embodiment 38 or Embodiment 39, wherein the arm is coupled to the longitudinal beam at least via the trolley.
41. The exercise equipment according to Embodiment 40, when at least indirectly dependent on Embodiment 23, said shoulder being at least indirectly coupled to the longitudinal beam via the trolley.
42. The exercise equipment according to any one of Embodiments 38 to 41, further comprising a trolley locking arrangement operable to lock the trolley at different trolley locking positions along the longitudinal beam, said trolley locking arrangement comprising:

a plurality of trolley locking first elements associated with the longitudinal beam and positioned along the beam longitudinal axis, each of the trolley locking first elements corresponding to a respective trolley locking position of the different trolley locking positions; and a trolley locking second element displaceable between a trolley locking state and a trolley unlocking state, wherein at the trolley locking state, the trolley locking second element engages one of the trolley locking first elements thereby locking the trolley at a corresponding trolley locking position, and at the trolley unlocking state, the trolley locking second element is free of engagement with the trolley locking first elements thereby allowing the trolley to be moved along the longitudinal axis.

43. The exercise equipment according to Embodiment 42, wherein the lock controller is operatively associated with the trolley locking arrangement and operable for displacing the trolley locking second element at least from the trolley locking state to the trolley unlocking state.
44. The exercise equipment according to Embodiment 43, wherein the lock controller is at least selectively engageable at least indirectly with the trolley locking second element for displacing the trolley locking second element at least from the trolley locking state to the trolley unlocking state.
45. The exercise equipment according to Embodiment 42, 43, or 44, when at least indirectly dependent on Embodiment 31, wherein the lock controller is displaceable between a trolley releasing position associated with the trolley unlocking state of the trolley locking second element and the neutral position associated with the trolley locking state of the trolley locking second element.
46. The exercise equipment according to Embodiment 45, wherein the lock controller while being displaced from the neutral position to the trolley releasing position at least indirectly engages the trolley locking second element and displaces the trolley locking second element towards the trolley unlocking state.
47. The exercise equipment according to Embodiment 44, 45, or 46, when at least indirectly dependent on Embodiment 33, wherein the actuator is operable to be actuated by a user to displace the lock controller at least from the neutral position to the trolley releasing position.
48. The exercise equipment according to any one of Embodiments 45 to 47, when at least indirectly dependent on Embodiment 34, wherein the lock controller biasing arrangement is operable to bias the lock controller towards one of the neutral positions and the trolley releasing position.

49. The exercise equipment according to any one of Embodiments 43 to 48, wherein the lock controller comprises a trolley locking second element engaging member operable for at least selectively engaging the trolley locking second element at least indirectly.

50. The exercise equipment according to any one of Embodiments 45 to 49, wherein the arm orienting position and the trolley releasing position are located at opposite sides of the neutral position, wherein the lock operator is operable to be displaced from the neutral position to the arm orienting position by one of a pushing and pulling action on the lock operator, and to be displaced from the neutral position to the trolley releasing position by other one of a pushing and pulling action on the lock operator.

51. A method for operating an exercise equipment according to any one of Embodiments 1 to 50, said method comprising:

pivoting, via the lock controller, the locking element from the locking position to the unlocking position;

rotating the arm about the arm rotation axis for setting an orientation of the arm with respect to the longitudinal beam; and pivoting the locking element into the locking position for locking the arm in the set orientation.

Embodiments 1 to 56 listed below relate at least to the third aspect of the presently disclosed subject matter.

1. A platform for use with an exercise equipment comprising an equipment cable and a resistance source for applying resistance to the equipment cable, the platform comprising:

a platform base;

at least one quick-release interface at least indirectly connected to the platform base and configured for operable connection of the equipment cable thereto;

at least one platform cable operatively associated with the at least one quick-release interface, wherein the at least one quick-release interface is operable to transfer the resistance applied to the equipment cable by the resistance source to the platform cable when the equipment cable is attached to the at least one quick-release interface; and at least one user interface position configured as part of the base and operable for providing to a user access to at least indirectly engage and manipulate the at least one platform cable.

2. The platform according to Embodiment 1, wherein the platform base comprises a housing defining an inner volume.

3. The platform according to Embodiment 1 or 2, wherein the platform base comprises a top surface for supporting a weight of a user thereupon.

4. The platform according to any one of Embodiments 1 to 3, wherein the platform base comprises a flat bottom surface for placing the platform on a flat surface.

5. The platform according to any one of Embodiments 1 to 4, wherein the at least one platform cable passes through the at least one user interface position.

6. The platform according to Embodiment 5, further comprising at least one user interface element positioned at the at least one user interface position, said at least one user interface element being operatively associated with the at least one platform cable and being at least indirectly engageable by a user.

7. The platform according to Embodiment 6, wherein the at least one user interface element comprises at least one of the following elements, each of which is at least indirectly engageable by a user: a handle, a rope, a loop, a hook, a hook pulley, and an eye pulley, a bar, a ring, a carabiner, a grip, a strap, a D-ring, a resistance band, a foot strap, a padded handle, a swivel connector, a sliding attachment, a magnetic coupler.

8. The platform according to Embodiment 6 or 7, wherein the at least one user interface element comprises at least one sheave, said at least one platform cable being conveyed via the at least one sheave.

9. The platform according to Embodiment 8, wherein the at least one user interface element comprises three sheaves including two end sheaves and a central sheave positioned between the two end sheaves, said at least one platform cable being conveyed via each one of the three sheaves.

10. The platform according to Embodiment 9, wherein the at least one platform cable passes under the two end sheaves and over the central sheave.

11. The platform according to any one of Embodiments 6 to 10, wherein at least a part of the at least one user interface element is a moveable part being moveable with respect to the platform base.

12. The platform according to Embodiment 11, said moveable part of the at least one user interface element being at least indirectly engageable by a user, wherein said moveable part is moveable with respect to the platform base upon application of a force thereupon by the user.

13. The platform according to Embodiment 11 or 12, when dependent at least indirectly on Embodiment 9, wherein said moveable part of the at least one user interface element includes the central sheave.

14. The platform according to any one of Embodiments 11 to 13, wherein said moveable part of the at least one user interface element is moveable in a direction extending along a horizontal plane.

15. The platform according to any one of Embodiments 11 to 14, wherein said moveable part of the at least one user interface element is moveable in a direction extending along a plane transverse a horizontal plane.

16. The platform according to any one of Embodiments 11 to 15, when dependent at least indirectly on Embodiment 2, wherein said moveable part of the at least one user interface element at least selectively extends outside the housing.

17. The platform according to any one of Embodiments 11 to 15, when dependent at least indirectly on Embodiment 2, wherein said moveable part of the at least one user interface element remains within the housing.

18. The platform according to any one of Embodiments 11 to 17, wherein the platform base comprises at least one track, said moveable part of the at least one user interface element is slidable along at least a segment of said at least one track.

19. The platform according to any one of Embodiments 11 to 18, wherein at least another part of the at least one user interface element is a fixed part being fixed with respect to the platform base.

20. The platform according to any one of Embodiments 1 to 19, wherein the at least one user interface position allows a user to apply on the at least one platform cable a force which counteracts the resistance transferred onto the at least one platform cable via the at least one quick-release interface.

21. The platform according to any one of Embodiments 1 to 20, further comprising a cable transfer mechanism allowing transfer and movement of the platform cable at least partially along the platform.

22. The platform according to Embodiment 21, wherein the cable transfer mechanism comprises one or more sheaves, said at least one platform cable being conveyed via at least one of the one or more sheaves.
23. The platform according to any one of Embodiments 1 to 22, wherein the at least one user interface position comprises a first user interface position and a second user interface position, each of the first and second user interface positions being operable for providing to a user access to at least indirectly engage and manipulate the at least one platform cable.
24. The platform according to Embodiment 23, wherein the at least one platform cable passes at least partially through each of the first and second user interface positions.
25. The platform according to Embodiment 24, wherein the at least one user interface element comprises a first user interface element positioned at the first user interface position and a second user interface element positioned at the second user interface position, each of the first and second user interface elements being operatively associated with the at least one platform cable and being at least indirectly engageable by a user.
26. The platform according to any one of Embodiments 1 to 22, wherein the at least one platform cable comprises a first platform cable and a second platform cable different from the first platform cable, each of the first and second platform cables being operatively associated with the at least one quick-release interface.
27. The platform according to any one of Embodiments 1 to 22, wherein the at least one quick-release interface comprises a first quick-release interface and a second quick-release interface different from the first quick-release interface; and the at least one platform cable comprises a first platform cable operatively associated with the first quick-release interface and a second platform cable different from the first platform cable operatively associated with the second quick-release interface.
28. The platform according to Embodiment 26 or 27, wherein the at least one user interface position comprises a first user interface position operable for providing to a user access to at least indirectly engage the first platform cable, and a second user interface position operable for providing to a user access to at least indirectly engage the second platform cable.
29. The platform according to Embodiment 28, wherein the first platform cable passes at least partially through the first user interface position, and the second platform cable passes at least partially through the second user interface position.
30. The platform according to Embodiment 29, wherein the at least one user interface element comprises a first user interface element positioned at the first user interface position and operatively associated with the first platform cable and being at least indirectly engageable by a user, and a second user interface element positioned at the second user interface position and operatively associated with the second platform cable and being at least indirectly engageable by a user.
31. The platform according to Embodiment 21 or any one of Embodiments 22 to 28, when dependent at least indirectly on Embodiment 21, wherein one or more of the at least one quick release interface and the cable transfer mechanism are arranged to modify the resistance applied to the equipment cable by the resistance source, when the equipment cable is attached to the at least one quick-release interface.
32. The platform according to Embodiment 31, wherein the modification includes multiplication by a factor greater than one.
33. The platform according to any one of Embodiments 1 to 32, wherein the at least one quick-release interface comprises:

a first rotatable element comprising: a quick-release connection member operable for at least indirectly connecting to the equipment cable; and a first element surface for winding of the equipment cable thereon; and a second rotatable element operatively connected to the first rotatable element for rotating together therewith, said second rotatable element comprising a second element surface for winding thereon an add-on cable different from the equipment cable.

34. The platform according to Embodiment 33, wherein the quick-release connection member is operable for removably attaching thereto a connector associated with the equipment cable.
35. The platform according to Embodiment 34, wherein the quick-release connection member constitutes a part of a snap fit connection arrangement allowing removably attaching thereto a connector associated with the equipment cable, said connector constituting another part of the snap fit connection arrangement.
36. The platform according to Embodiment 34 or 35, wherein the quick-release connection member comprises a recess for removably receiving therein at least partially the connector associated with the equipment cable.
37. The platform according to any one of Embodiments 1 to 36, wherein the first element surface comprises a channel for at least partially receiving therein the equipment cable when the equipment cable is wound on the first element surface.
38. The platform according to Embodiment 37, wherein the channel is a spiral channel.
39. The platform according to any one of Embodiments 33 to 38, wherein the platform cable constitutes the add-on cable and has a first add-on cable end attached at least indirectly to the second rotatable element, and a free second add-on cable end.
40. The platform according to any one of Embodiments 33 to 39, wherein the first rotatable element is rotatable about a first element rotation axis, and the second rotatable element is rotatable about a second element rotation axis.
41. The platform according to Embodiment 40, wherein the first and second element rotation axis coincide.
42. The platform according to Embodiment 33, wherein each of the first and second rotatable elements constitutes a spool.
43. The platform according to any one of Embodiments 1 to 42, wherein the resistance source is an electronically adjustable motorized resistance source.
44. The platform according to any one of Embodiments 1 to 43, wherein the resistance source is configured for applying continuous resistance onto the equipment cable to thereby maintain the platform cable continuously tensioned, when the equipment cable is attached to the at least one quick-release interface.
45. The platform according to any one of Embodiments 1 to 44, wherein the platform base comprises one or more connectors for removably connecting the platform to the exercise equipment at least when the platform is stored.

46. An exercise system comprising:

an exercise equipment comprising:

an equipment cable engageable by a user for performing one or more exercise routines; and an electronically adjustable motorized resistance source for applying resistance to the equipment cable; and the platform according to any one of Embodiments 1 to 45.

47. A method of operating an exercise system according to Embodiment 46, the method comprising:

selectively connecting a connector of the equipment cable to the quick-release interface of the platform, thereby at least indirectly connecting the equipment cable to the platform cable; and at the at least one user interface position, engaging the platform cable at least indirectly and manipulating the platform cable against the resistance applied by the resistance source.

48. A spool assembly for use as an add-on with an exercise equipment comprising an equipment cable and a resistance source for applying resistance to the equipment cable, said spool assembly comprising:

a first rotatable element comprising: a quick-release connection member operable for at least indirectly connecting to the equipment cable; and a first element surface for winding of the equipment cable thereon; and a second rotatable element operatively connected to the first rotatable element for rotating together therewith, said second rotatable element comprising a second element surface for winding thereon an add-on cable different from the equipment cable.

49. The spool assembly according to Embodiment 48, wherein the quick-release connection member is operable for removably attaching thereto a connector associated with the equipment cable.

50. The spool assembly according to Embodiment 49, wherein the quick-release connection member constitutes a part of a snap fit connection arrangement allowing removably attaching thereto a connector associated with the equipment cable, said connector constituting another part of the snap fit connection arrangement.

51. The spool assembly according to Embodiment 49 or 50, wherein the quick-release connection member comprises a recess for removably receiving therein at least partially the connector associated with the equipment cable.

52. The spool assembly according to any one of Embodiments 48 to 51, wherein the first element surface comprises a channel for at least partially receiving therein the equipment cable when the equipment cable is wound on the first element surface.

53. The spool assembly according to Embodiment 52, wherein the channel is a spiral channel.

54. The spool assembly according to any one of Embodiments 48 to 53, further comprising said add-on cable having a first add-on cable end attached at least indirectly to the second rotatable element, and a free second add-on cable end.

55. The spool assembly according to any one of Embodiments 48 to 54, wherein the first rotatable element is rotatable about a first element rotation axis, and the second rotatable element is rotatable about a second element rotation axis.

56. The spool assembly according to Embodiment 55, wherein the first and second element rotation axis coincide.

BRIEF DESCRIPTION OF THE DRAWINGS

In order to better understand the subject matter that is disclosed herein and to exemplify how it may be carried out in practice, embodiments will now be described, by way of non-limiting examples only, with reference to the accompanying drawings, in which.

DETAILED DESCRIPTION OF EMBODIMENTS

Figure 1A:
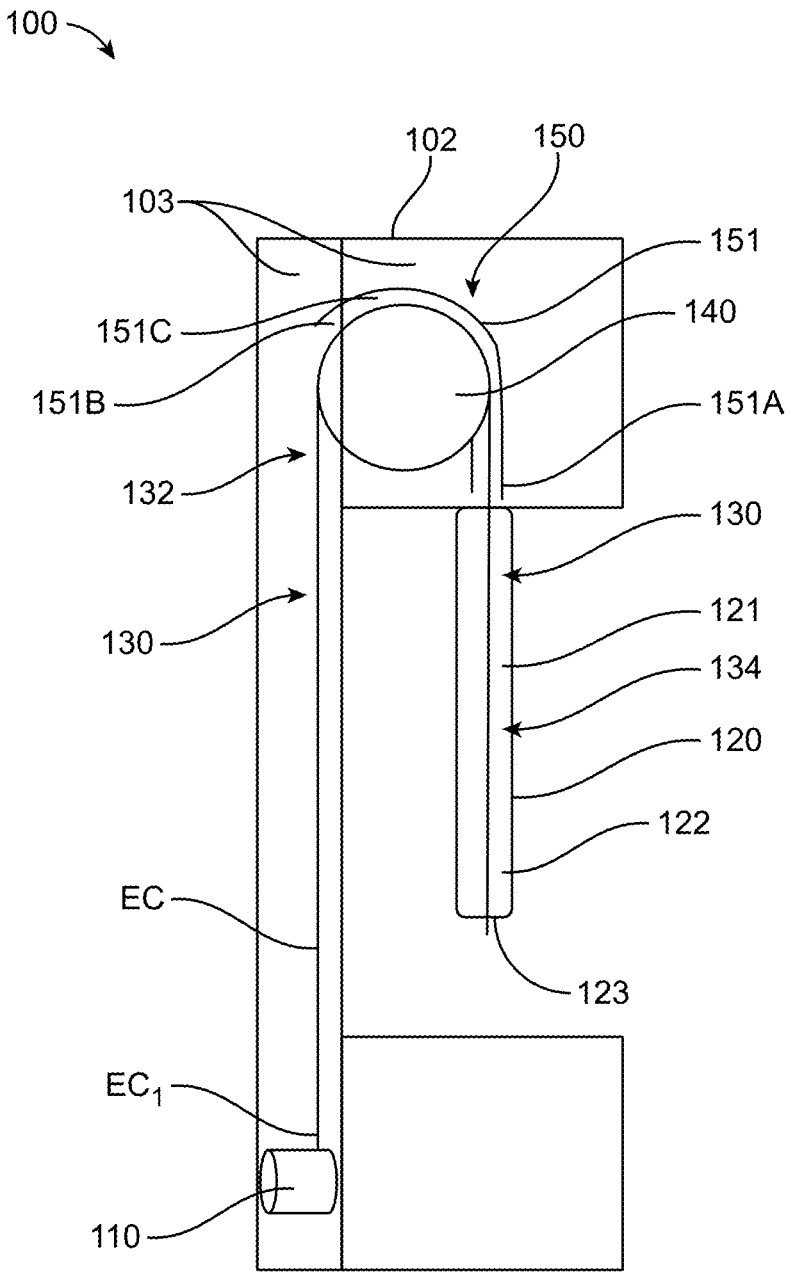
FIG. 1A illustrates a schematic side view of an exercise equipment according to an example of the presently disclosed subject matter.

This application claims priority from U.S. provisional patent Ser. No. 63/611,051 filing date Dec. 15, 2023, which is incorporated herein in its entirety.

The following detailed description provides details of various examples of exercise equipment and accessories usable therewith for performance of exercise routines. According to some examples, one or more of the exercise equipment described herein below can be wall mountable exercise equipment. According to some examples, the exercise equipment described herein below can include a cable that a user can engage and apply force to, for performing one or more exercise routines. The exercise equipment can apply a resistance to the cable, which can be adjusted, for example, according to the requirement of the user, according to predefined settings (e.g. of an exercise program), according to a specific machine setup (e.g. use of a platform for example as described below).

According to some examples, the resistance can be applied by a resistance source. According to some examples, the resistance source can include a motor, for example, an electronically adjustable weight resistance motor. According to some examples, one or more parts of the exercise equipment can be adjusted with respect to the other parts, for example, according to the requirements of the user and/or according to the exercise routine to be performed. Accordingly, the exercise equipment can include one more features of the exercise machines described in U.S. provisional patent Ser. No. 63/611,051 filing date Dec. 15, 2023, which is incorporated herein in its entirety.

Some examples of the presently disclosed matter relate to installation or maintenance of an exercise equipment, for example, including insertion and installation of the cable within the exercise equipment and/or removal or replacement of the cable of the exercise equipment. Some examples of the presently disclosed matter relate to operation of an exercise equipment, for example, including adjusting an orientation of an arm of the exercise equipment. Some examples of the presently disclosed matter relate to add-on accessories to be connected to and used with an exercise equipment, for example, add-on platforms and/or spool assemblies enhancing the usability of the exercise equipment, increasing the number of exercise routines performable with the exercise equipment, modifying the resistance applied by a resistance source of the exercise equipment, etc.

It is to be understood herein that for the purposes of the present description the term “at least indirectly” when used with respect to connection, coupling, or mounting between two elements, is intended to mean that the two elements can be connected, coupled, or mounted to each other either directly or via one or more intermediate elements.

First, some examples of exercise equipment allowing easy insertion, installation, removal, and/or replacement of a cable (interchangeably referred to herein as equipment cable) thereof are described. The cable can be inserted, installed, removed, and/or replaced with minimal disassembly of the exercise equipment and its parts. According to some examples, the insertion, installation, removal, and/or replacement of the cable can be performed by removing only a faceplate (e.g. a faceplate of the machine housing), which can be connected by a quick-connection arrangement, and, in some cases, a wrist portion of an arm of the exercise equipment, described in detail herein below. According to some examples, the exercise equipment can be wall mountable, and insertion, installation, removal, and/or replacement of the cable can be carried out without dismounting the exercise equipment from the wall.

An exercise equipment, according to the examples described herein, during use can have a cable with one end anchored within the exercise equipment and an opposite free end accessible to a user. The user can engage the free end, either directly or via a user interface (which can be a part of the exercise equipment or external thereto) and pull the free end away from the exercise equipment for performing one or more exercises. The exercise equipment can apply resistance on the cable against a direction of pulling by the user. The resistance can be applied by a resistance source, which can be a motorized resistance source. The motor can be an electronically adjustable weight resistance motor coupled, at least indirectly, to the resistance source. The cable of an exercise equipment may require maintenance and/or replacement, which can require removal of a cable from the exercise equipment, insertion of a (new or refurbished) cable into the exercise equipment, and coupling the cable at least indirectly to the resistance source or any anchor point.

In general, an exercise equipment can comprise a frame having a frame internal volume and a cable anchor positioned therewithin, to which a cable can be anchored. The exercise equipment can further comprise an arm having an arm internal volume and at least indirectly coupled to the frame. The arm includes a wrist portion at which an exercise interface engageable by a user can be connected at least indirectly.

A cable path can extend between the wrist portion and the cable anchor at least partially through the frame internal volume and the arm internal volume. A portion of the cable path that extends within the frame internal volume can be referred to as a frame cable path portion extending within the frame internal volume. The cable, when being inserted for the first time (a new cable) or when being replaced (replacement cable), is to be passed all along the cable path.

The frame can prevent access to at least a part of the frame cable path portion by a user. For instance, the frame can be an at least partially closed frame enclosing the frame internal volume and a user cannot access directly (e.g. by insertion of hands or fingers) into the frame internal volume. More particularly, the frame can be so structured that the user cannot manually engage at least some parts of the frame cable path portion. The cable needs to be guided through at least such portions of the cable path which the user cannot directly access.

An exercise equipment can include at least one cable receiving opening in communication with at least one of the frame internal volume and the arm internal volume. The cable receiving opening can be accessible by the user for inserting therethrough an end of a cable (either new cable or a replacement cable) onto the cable path and push the end of the cable into either of the frame internal volume and arm internal volume, which the cable receiving opening is in communication with.

A cable guiding arrangement can be positioned at least partially within the frame internal volume for guiding the end of the cable through the frame internal volume on the frame cable path portion while the cable is being pushed (threaded) through the cable receiving opening. The cable guiding arrangement can include one or more guiding elements shaped and positioned within the frame internal volume and/or the arm internal volume to guide the end of the cable onto the cable path when the while the cable is being pushed through the cable receiving opening. The cable guiding arrangement can guide the end of the cable at least onto those parts of the cable path which are not directly manually accessible by the user. The cable guiding arrangement can guide the end of the cable via curves, bends, and turns within the cable path without the need for the user to access portions of the frame or arm internal volume in which the curves, bends, and turns are located.

For instance, the cable path can include one or more curves, bends, and/or turns within at least one of the frame internal volume and arm internal volume. The frame and/or the arm can prevent access to at least one of the one or more curves, bends, and/or turns by a user, and the cable guiding arrangement can guide the end of the cable through the at least one of the one or more curves, bends, and/or turns.

In some examples, the cable receiving opening can be formed on the frame and can be in communication with the frame internal volume. In such examples, the end of the cable can be inserted directly into the frame internal volume.

In some examples, the cable receiving opening can be formed on the arm and can be in communication with the arm internal volume. In such examples, the end of the cable can be inserted into the arm internal volume and can be advanced, by pushing the cable through the cable receiving opening, into the frame internal volume. In some examples, an orientation of the arm with respect to the frame can be adjusted, for example as described further below herein, for assisting the insertion of the cable through the cable receiving opening.

The exercise equipment can comprise one or more sheaves (for example, rotatable disks, wheels, pulleys) located within at least one of the frame internal volume and arm internal volume, at least partially defining the cable path. The frame and/or the arm can prevent access to at least one of the one or more sheaves. The sheaves can be located at, and at least partially define the bends, curves, or turns on the cable path.

The guiding arrangement can guide the end of the cable onto the at least one of the one or more sheaves, while the cable is being pushed through the cable receiving opening. For instance, the cable guiding arrangement can comprise one or more guiding elements positioned within said at least one of the frame internal volume and the arm internal volume, and operatively associated with the one or more sheaves to guide the end of the cable onto the one or more sheaves while the cable is being pushed through the at least one cable receiving opening. It is to be understood for the purposes of the present description, a guiding element being operatively associated with a sheave is intended to mean that the guiding element has a shape (for example corresponding to the sheave), orientation, and/or position with respect to the sheave to engage the cable when the cable is advanced towards the sheave and guide the cable onto the sheave. For example, the guiding element can at least partially cover the one or more sheaves. A guiding element can have an entry opening through which the end of the cable enters the guiding element, and an exit opening through which the end of the cable exits the at least one guiding element. The entry opening can be larger than the exit opening such that the cable can enter into the guiding element with ease, and the smaller exit opening guides the end of the cable precisely onto the cable path. The guiding element can form together with the corresponding sheave, an at least partially closed channel, which defines at least partially the cable path. The guiding element guides the end of the cable through the corresponding channel.

Reference is now made to FIG. 1A schematically illustrating an exercise equipment 100 according to an example of the presently disclosed subject matter. The exercise equipment 100 comprises a frame, generally designated as 102, having a frame internal volume 103. A cable anchor 110 is positioned within the frame internal volume 103. An arm, generally designated as 120, is coupled to the frame 102, and has an arm internal volume 121. The arm 120 has a wrist portion 122 at which an exercise interface engageable by a user can be connected at least indirectly. The exercise interface can be a handle that a user can engage and pull for performing an exercise routine.

A cable path, generally designated as 130, extends between the wrist portion 122 and the cable anchor 110 through the frame internal volume 103 and the arm internal volume 121. The cable path 130 includes a frame cable path portion 132 that extends within the frame internal volume 103 and an arm cable path portion 134 that extends within the arm internal volume 121. The exercise equipment 100 includes a sheave 140 positioned partially in the frame internal volume 103 and partially in the arm internal volume 121. The frame and the arm are at least partially closed enclosing the frame internal volume and the arm internal volume, and prevents access to the sheave 140 by a user directly by hands or fingers.

A guiding arrangement 150 includes a guiding element 151 operatively associated with the sheave 140. The guiding element 151 partially covers the sheave 140 circumferentially (i.e., the guiding element 151 covers a part of the sheave 140 along its circumference), and has an entry opening 151A through which an end of a cable, for example the end EC1 of the cable EC, enters the guiding element 151, and an exit opening 151B through which the end EC1 of the cable EC exits the guiding element 151. The guiding element 151 forms together with the sheave 140, a partially closed channel 151C, which defines at least partially the cable path 130.

In the illustrated example, the wrist portion 122 comprises an open wrist connection end 123, which constitutes a cable receiving opening 123. A user can insert the end EC1 of the cable EC through the cable receiving opening 123 into the arm internal volume 121, and can push the cable EC through the cable receiving opening 123 for advancing the cable through the cable path 130. The guiding element 151 receives thereinto the end EC1 via the entry opening 151A and guides the end EC1 of the cable EC through the channel 151C and onto the sheave 140. The guiding element 151 guides the end EC1 of the cable EC onto the frame cable path portion 132, and the end EC1 of the cable EC exits the guiding element 151 via the exit opening 151B. The end EC1 of the cable EC can then be advanced through the frame internal volume, for example at least partially under influence of gravity and due to pushing of the cable through the cable receiving opening 123, and reach the anchor 110. The user can access the end EC1 of the cable, for example via an anchor access opening (not shown in FIG. 1A) in the frame 102, and can anchor the end EC1 to the anchor 110, thereby completing the insertion and installation of the cable EC in the exercise equipment 100.

In some examples, a cable receiving opening can be formed on the frame, for example, at a location where the arm is coupled to the frame. The cable receiving opening can be formed as a hole or a recess on a housing of the frame, and can optionally be marked (e.g. by a color marking, arrow or other indication) to facilitate being identified by a user.

In some examples, the arm can be rotated with respect to the frame to bring the wrist portion to a position higher than the frame, thereby allowing an easy insertion of the cable therethrough, for example at least partially under the influence of the gravity.

In some examples, a sheave can include a circumferential channel for receiving therein the cable. The circumferential channel can constitute a part of the cable path, and the guiding element can at least partially cover the circumferential channel and can guide the cable therein.

In general, an exercise equipment can comprise more than one sheave, for example, include a first sheave and a second sheave. In some examples, the cable guiding arrangement can include a single guiding element operatively associated with both of the first and second sheaves and operable to guide the end of the cable onto the first and second sheaves while the cable is being pushed through the cable receiving opening.

In some examples, the cable guiding arrangement can comprise a first guiding element operatively associated with the first sheave and operable to guide the end of the cable onto the first sheave, and a second guiding element operatively associated with the second sheave and operable to guide the end of the cable onto the second sheave. In such examples, the first guiding element can have a corresponding first element entry opening through which the end of the cable enters the first guiding element and a corresponding first element exit opening through which the end of the cable exits the first guiding element, and the second guiding element can have a corresponding second element entry opening through which the end of the cable enters the second guiding element and a corresponding second element exit opening through which the end of the cable exits the second guiding element.

It is to be understood herein for the purposes of the present description that a sheave or a guiding element can be referred to as first and second (or further in the sequence) based on an order in which the end of the cable arrives at the sheave or the guiding element during insertion of the cable into the exercise equipment. The order can be reversed if the direction of cable insertion is reversed, for example, based on the location of the cable receiving opening.

Accordingly, in examples with separate first and second guiding elements for first and second sheaves, the second element entry opening can be aligned with the first element exit opening for receiving the end of the cable within the second guiding element when the end of the cable exits the first guiding element, while the cable is being pushed through the cable receiving opening.

In general, an exercise equipment can comprise one or more frame sheaves positioned within the frame internal volume and defining at least partially a frame cable path portion. In some examples, the one or more frame sheaves can include a first frame sheave and a second frame sheave. In some of the examples in which the one or more frame sheaves include a first frame sheave and a second frame sheave, the exercise equipment can comprise a single frame guiding element positioned within the frame internal volume and operatively associated with both of the first and second frame sheaves. The frame guiding element can have a frame guiding element entry opening through which the end of the cable enters the frame guiding element, and a frame guiding element exit opening through which the end of the cable exits the frame guiding element. In some of the examples in which the one or more frame sheaves include a first frame sheave and a second frame sheave, the exercise equipment can comprise first and second frame guiding elements operatively associated with the respective ones of the first and second frame sheaves.

In general, an exercise equipment can comprise one or more arm sheaves positioned within the arm internal volume and defining at least partially an arm cable path portion. In some examples, the one or more arm sheaves can include a first arm sheave and a second arm sheave. In examples in which the one or more arm sheaves include a first arm sheave and a second arm sheave, the exercise equipment can comprise a single arm guiding element positioned within the arm internal volume and operatively associated with both of the first and second arm sheaves. The arm guiding element can have an arm guiding element entry opening through which the end of the cable enters the arm guiding element, and an arm guiding element exit opening through which the end of the cable exits the arm guiding element.

In examples in which the one or more arm sheaves include a first arm sheave and a second arm sheave, the exercise equipment can comprise first and second arm guiding elements operatively associated with the respective ones of the first and second arm sheaves. The first arm guiding element can have a corresponding first arm guiding element entry opening through which the end of the cable enters the first arm guiding element and a corresponding first arm guiding element exit opening through which the end of the cable exits the first arm guiding element. The second arm guiding element can have a corresponding second arm guiding element entry opening through which the end of the cable enters the second arm guiding element, and a corresponding second arm guiding element exit opening through which the end of the cable exits the second arm guiding element.

In some examples, the cable receiving opening can be located such that when the end of the cable is inserted therethrough, the end arrives first at the first arm sheave, then at the second arm sheave, then at the first frame sheave, and then at the second frame sheave. In some of such examples, the second arm guiding element entry opening can be aligned with the first arm guiding element exit opening for receiving the end of the cable within the second arm guiding element when the end of the cable exits the first arm guiding element, while the cable is being pushed through the at least one cable receiving opening. In some of such examples, the entry opening of the frame guiding element corresponding to the first frame sheave can be at least selectively aligned with the second arm guiding element exit opening for receiving the end of the cable within the frame guiding element when the end of the cable exits the second arm guiding element. In examples in which the exercise equipment comprises first and second frame guiding elements operatively associated with the respective ones of the first and second frame sheaves, the entry opening of the second frame guiding element can be at least selectively aligned with the exit opening of the first frame guiding element for receiving the end of the cable within the second frame guiding element when the end of the cable exits the first frame guiding element.

In general, selectively aligned openings may include openings (e.g. of the frame and arm) that are aligned along the same axis. The openings can be located adjacent each other, for example such that at least a part of their surface area overlaps. In some examples, the openings are arranged such that a cable end exiting one opening would be directly guided into the second opening. Additionally or alternatively, a user may manually guide the cable between the openings.

In some examples, the cable receiving opening can be located such that when the end of the cable is inserted therethrough, the end arrives first at the first frame sheave, then at the second frame sheave, then at the first arm sheave, and then at the second arm sheave. In such examples, the entry opening of each guiding element can be aligned with the exit opening of the previous guiding element for receiving the end of the cable within the guiding element when the end of the cable exits the previous guiding element.

Figure 1B:
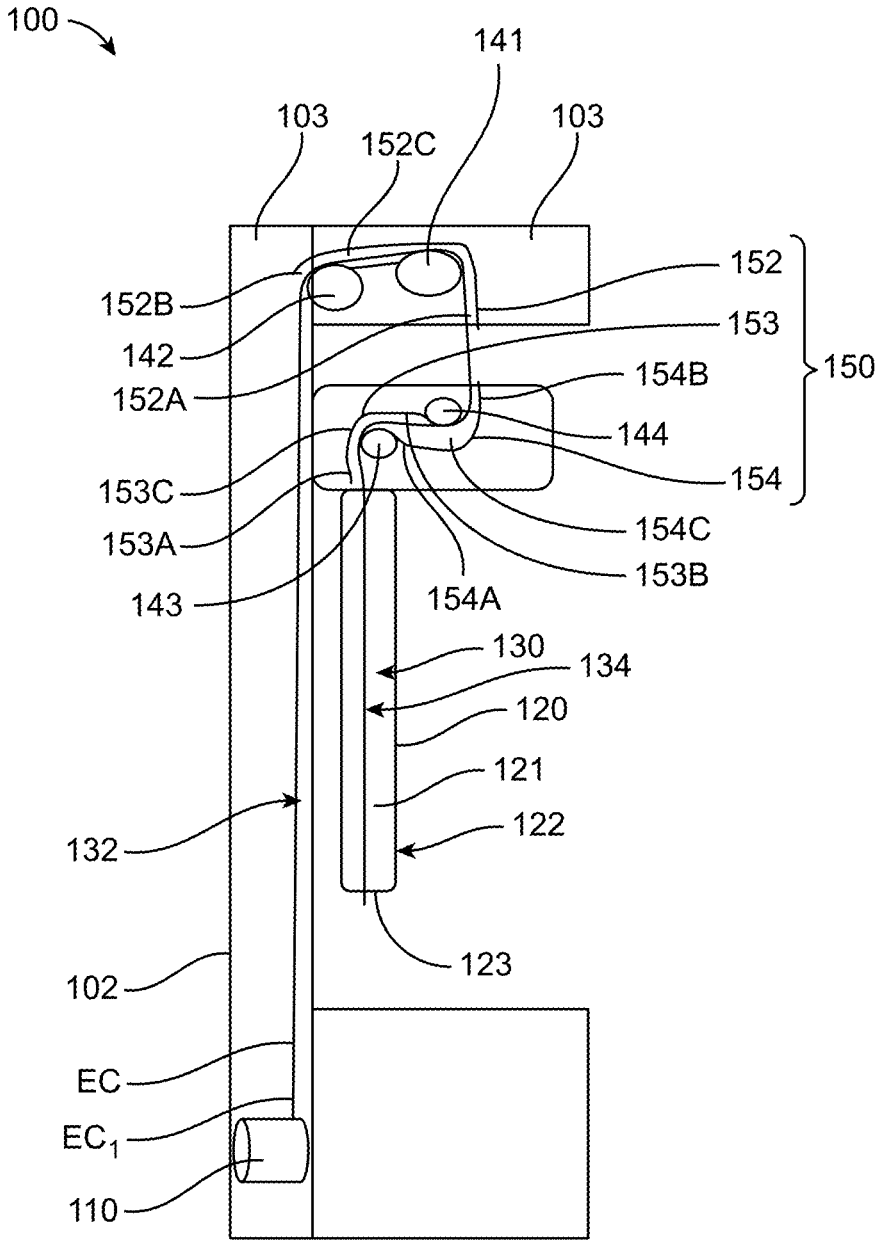
FIG. 1B illustrates a schematic side view of an exercise equipment according to another example of the presently disclosed subject matter.

Reference is now made to FIG. 1B schematically illustrating an exercise equipment 100 according to an example of the presently disclosed subject matter. It is to be understood herein that the exercise equipment 100 shown in FIG. 1B includes all the features of the exercise equipment 100 described above with reference to FIG. 1A, with the only difference being that instead of one sheave 140 and corresponding guiding element 151, the exercise equipment 100 shown in FIG. 1B includes more than one sheave and corresponding guiding elements, as described herein below. Accordingly, the description of features of the exercise equipment 100 of FIG. 1A applies analogously to corresponding features of the exercise equipment 100 of FIG. 1B. Same reference numerals have been used for corresponding features of the exercise equipment 100 of FIGS. 1A and 1B.

In the example illustrated in FIG. 1B, the exercise equipment 100 includes a first frame sheave 141 and a second frame sheave 142 positioned within the frame internal volume 103. The guiding arrangement 150 includes a frame guiding element 152 operatively associated with the first and second frame sheaves 141 and 142. The frame guiding element 152 partially covers the first and second frame sheaves 141 and 142 circumferentially (i.e., the frame guiding element 152 covers a part of the sheaves 141 and 142 along their circumference), and has a frame guiding element entry opening 152A through which an end of a cable, for example the end EC1 of the cable EC, enters the frame guiding element 152, and a frame guiding element exit opening 152B through which the end EC1 of the cable EC exits the frame guiding element 152. The frame guiding element 152 forms together with the frame sheaves 141 and 142, a partially closed channel 152C, which defines at least partially the cable path 130.

In the example illustrated in FIG. 1B, the exercise equipment 100 includes a first arm sheave 143 and a second arm sheave 144 positioned within the arm internal volume 121. The guiding arrangement 150 includes a first arm guiding element 153 operatively associated with the first arm sheave 143, and a second arm guiding element 154 operatively associated with the second arm sheave 144. The first and second arm guiding elements 153 and 154 partially cover respectively the first and second arm sheaves 143 and 144 circumferentially. The first arm guiding element 153 has a first arm guiding element entry opening 153A through which the end EC1 of the cable EC enters the first arm guiding element 153, and a first arm guiding element exit opening 153B through which the end EC1 of the cable EC exits the first arm guiding element 153. The first arm guiding element 153 forms together with the first arm sheave 143, a partially closed channel 153C, which defines at least partially the cable path 130. The second arm guiding element 154 has a second arm guiding element entry opening 154A through which the end EC1 of the cable EC enters the second arm guiding element 154, and a second arm guiding element exit opening 154B through which the end EC1 of the cable EC exits the second arm guiding element 154. The second arm guiding element 154 forms together with the second arm sheave 144, a partially closed channel 154C, which defines at least partially the cable path 130.

It is to be understood herein that reference to a sheave and/or a guiding element as being first and second (or further in sequence) depends on a sequence of that sheave and/or guiding element in the path of the end of the cable when the cable is inserted into the exercise equipment. Also, reference to an opening of a guiding element as being an entry or exit opening depends on the direction of the end of the cable entering into and exiting from that guiding element. For instance, the cable can inserted via different pathways into the exercise equipment depending on where the cable receiving opening(s) is/are located, and in which direction the insertion of cable is initiated. For example, there can be multiple pathways that can be followed by the end(s) of the cable during insertion and installment of the cable into the exercise equipment, one of which is illustrated in and described with respect to FIG. 1C, and another one of which is illustrated in and described with respect to FIG. 1D. It is to be understood herein that in some examples (not shown), the location of the cable receiving opening(s) can be different from the ones shown herein and accordingly the pathway followed by the end(s) of the cable can be different from those described herein.

Figure 1C:
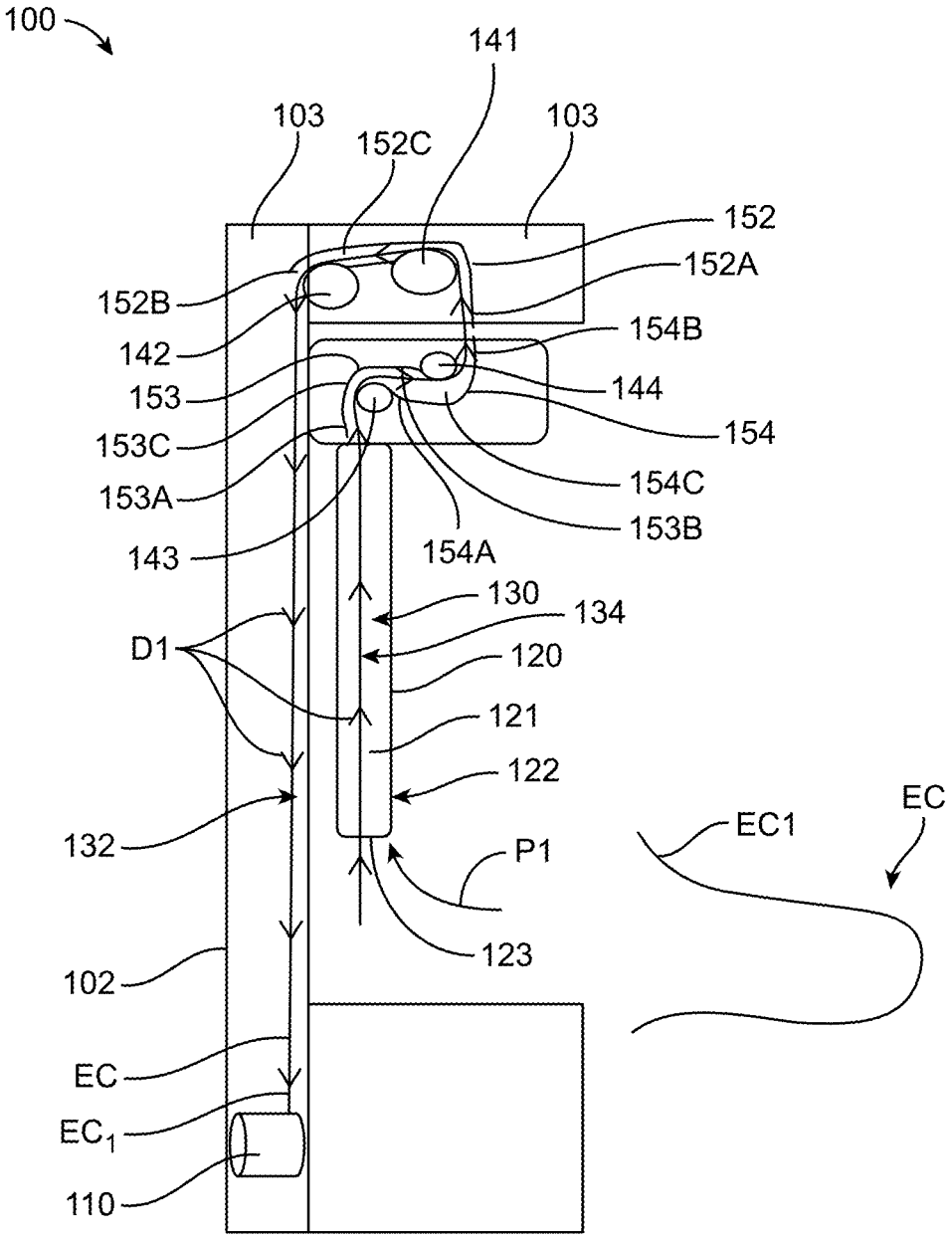
FIG. 1C illustrates the exercise equipment of FIG. 1B depicting a first pathway for insertion of a cable into the exercise equipment.

According to an example illustrated in FIG. 1C, the open wrist connection end 123 of the wrist portion 122 can constitute a cable receiving opening 123. In such an example, a user can insert the end EC1 of the cable EC through the cable receiving opening 123 into the arm internal volume 121, and can push the cable EC through the cable receiving opening 123 for advancing the cable through the cable path 130, for example in the direction of arrow P1, depicting a first pathway. The first arm guiding element 153 receives thereinto the end EC1 via the first arm guiding element entry opening 153A and guides the end EC1 of the cable EC through the channel 153C and onto the first arm sheave 143. The end EC1 of the cable exits the first arm guiding element 153 via the first arm guiding element exit opening 153B. The second arm guiding element 154 receives thereinto the end EC1 via the second arm guiding element entry opening 154A, which is aligned with the first arm guiding element exit opening 153B. The second arm guiding element 154 guides the end EC1 of the cable EC through the channel 154C and onto the second arm sheave 144. The end EC1 of the cable exits the second arm guiding element 154 via the second arm guiding element exit opening 154B.

In some examples, the frame guiding element entry opening 152A can be at least selectively aligned with the second arm guiding element exit opening 154B, for example by moving the arm with respect to the frame 102, for example as shown in FIG. 1C. In such examples, the frame guiding element 152 receives thereinto the end EC1 via the frame guiding element entry opening 152A and guides the end EC1 of the cable EC through the channel 152C and onto the first and second frame sheaves 141 and 142. The end EC1 of the cable EC exits the frame guiding element 152 via the frame guiding element exit opening 152B. In some examples, a guiding channel can be formed between the frame guiding element entry opening 152A and the second arm guiding element exit opening 154B for guiding the end of the cable from the second arm guiding element exit opening 154B to the frame guiding element entry opening 152A or vice versa. The rest of the advancement of the end EC1 of the cable EC (after exiting the frame guiding element 152 via the frame guiding element exit opening 152B) can remain the same as described above with reference to the FIG. 1A. The direction of advancement of the end EC1 has been depicted by arrows D1.

In some examples, the cable receiving opening can be constituted by a first cable receiving opening formed on the frame 102 at a portion proximal to the arm 120 (for example, adjacent and/or in communication with the frame guiding element entry opening 152A), and a second cable receiving opening formed on the arm 120 at a portion proximal to the frame 102 (for example, adjacent and/or in communication with the second arm guiding element exit opening 154B).

In some of the examples with first and second cable receiving openings, instead of the end EC1 entering automatically into the frame guiding element entry opening 152A from the second arm guiding element 154, the end EC1 can be manually entered by a user into the frame guiding element entry opening 152A after the end EC1 exits the second arm guiding element 154. For instance, when the end EC1 of the cable exits the second arm guiding element 154 via the second arm guiding element exit opening 154B, the end EC1 also exits the arm internal volume 121 from the opening formed on the arm adjacent and/or in communication with the second arm guiding element exit opening 154B, and the user can access the end EC1 (in the space between the arm and frame generated by moving the arm downwards along the frame as compared to that shown in FIG. 1C) and insert the end EC1 into the frame guiding element entry opening 152A via the opening formed on the frame adjacent and/or in communication with the frame guiding element entry opening 152A. The rest of the advancement of the end EC1 of the cable EC (after entering the frame guiding element 152 via the frame guiding element entry opening 152B) can remain the same as described above.

Figure 1D:
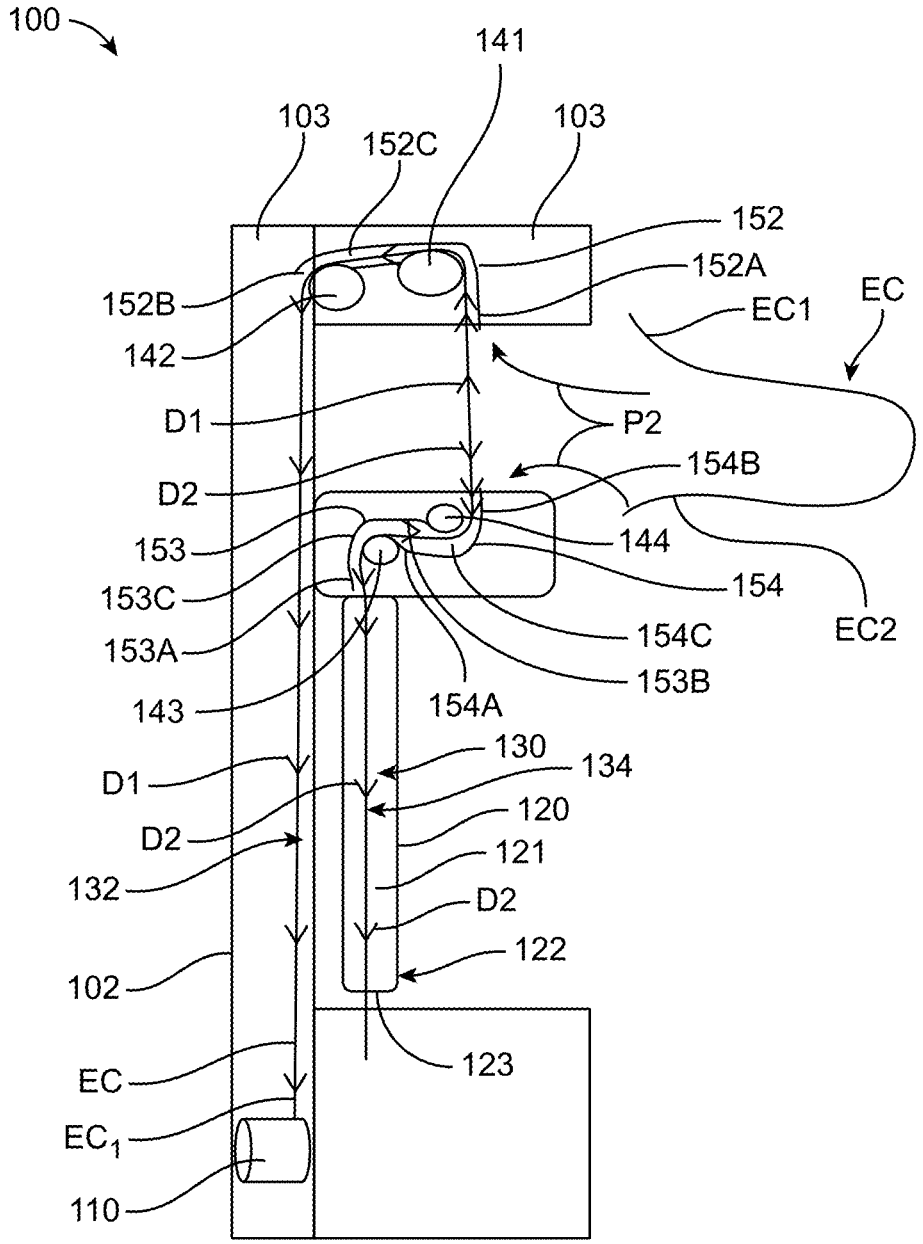
FIG. 1D illustrates the exercise equipment of FIG. 1B depicting a second pathway for insertion of a cable into the exercise equipment.

In an example, illustrated in FIG. 1D showing a second pathway depicted by arrow P2, with first and second cable receiving openings, the user can insert a first end of the cable EC, for example, the end EC1 through the first cable receiving opening formed on the frame adjacent and/or in communication with the frame guiding element entry opening 152A into the frame guiding element entry opening 152A, while the rest of the advancement of the end EC1 of the cable EC (after entering the frame guiding element 152 via the frame guiding element entry opening 152B) can remain the same as described above. Accordingly, a first part of the cable is inserted via the first cable receiving opening and advanced through the frame. The user can insert a second end of the cable EC, for example, the end EC2 through the second cable receiving opening formed on the arm adjacent and/or in communication with the second arm guiding element exit opening 154B into the second arm guiding element exit opening 154B, thereby reversing the sequence of advancement of the cable via the first and second arm guiding elements and the open wrist connection end 123 with respect to that described above. The direction of advancement of the end EC1 has been depicted by arrows D1.

For instance, in the example illustrated in FIG. 1D, the direction of advancement of the second end EC2 of the cable EC is reversed with respect to that of FIG. 1C. Accordingly, with reference to FIG. 1D, the sheave 144 can constitute (can be referred to as) the first arm sheave 144, and the sheave 143 can constitute (can be referred to as) the second arm sheave 143. Similarly, the guiding element 154 can constitute (can be referred to as) the first arm guiding element 154, and the guiding element 153 can constitute (can be referred to as) the second arm guiding element 153. Accordingly, the opening 154B can constitute (can be referred to as) the first arm guiding element entry opening 154B, and the opening 154A can constitute (can be referred to as) the first arm guiding element exit opening 154A. Similarly, the opening 153B can constitute (can be referred to as) the second arm guiding element entry opening 153B, and the opening 153A can constitute (can be referred to as) the second arm guiding element exit opening 153A.

In the example illustrated in FIG. 1D, a user can insert the end EC2 of the cable EC through the cable receiving opening formed on the arm adjacent and/or in communication with the first arm guiding element entry opening 154B into the first arm guiding element entry opening 154B. The first arm guiding element 154 receives thereinto the end EC2 via the first arm guiding element entry opening 154B and guides the end EC2 of the cable EC through the channel 154C and onto the first arm sheave 144. The end EC2 of the cable exits the first arm guiding element 154 via the first arm guiding element exit opening 154A. The second arm guiding element 153 receives thereinto the end EC2 via the second arm guiding element entry opening 153B, which is aligned with the first arm guiding element exit opening 154A. The second arm guiding element 153 guides the end EC2 of the cable EC through the channel 153C and onto the second arm sheave 143. The end EC2 of the cable exits the second arm guiding element 153 via the second arm guiding element exit opening 153A, and advances through the arm internal volume 121 and exits the arm via the opening 123. Accordingly, a second part of the cable is inserted via the second cable receiving opening and advanced through the arm. The direction of advancement of the end EC2 has been depicted by arrows D2.

In some examples, the cable receiving opening can be formed in the frame and the whole sequence of inserting the cable can be reversed.

In some examples, at least one of the frame and arm sheaves can include a circumferential channel for receiving therein the cable. The circumferential channel can constitute a part of the cable path, and the corresponding guiding element can at least partially cover the circumferential channel and can guide the cable therein.

Figure 2A:
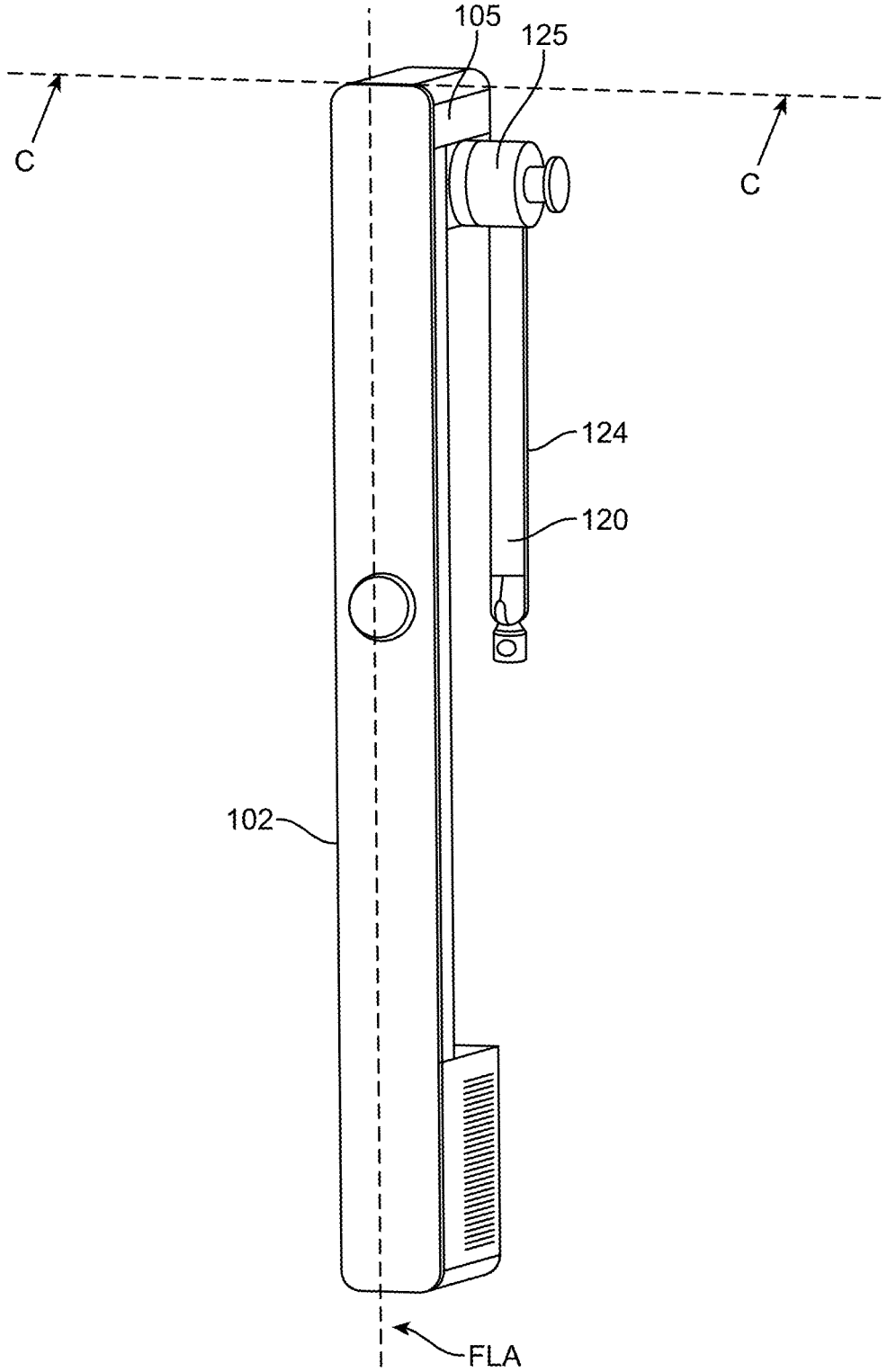
FIG. 2A illustrates a front perspective view of an exercise equipment according to yet another example of the presently disclosed subject matter.
Figure 2B:
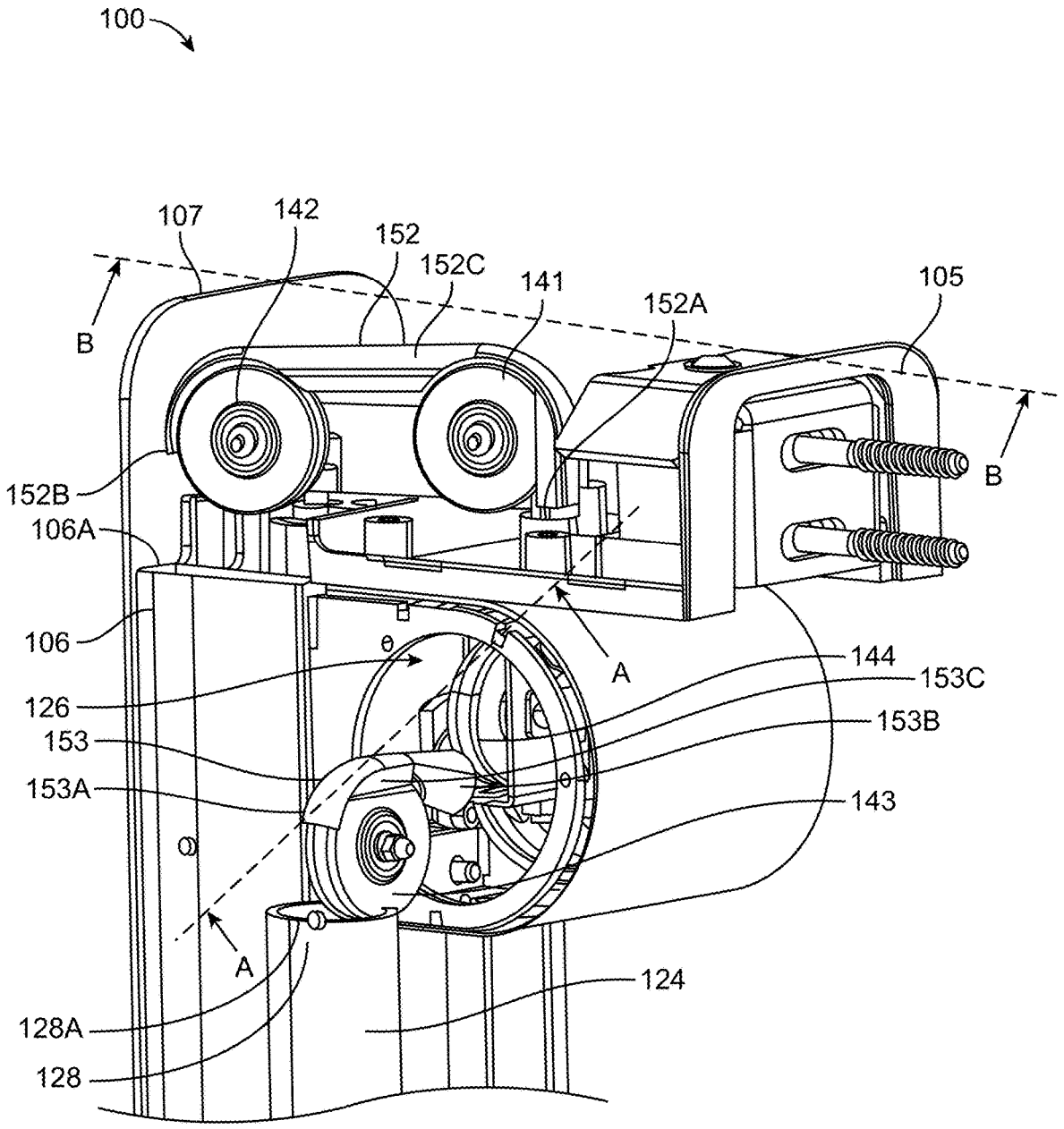
FIG. 2B illustrates a rear perspective view of a portion of the exercise equipment of FIG. 2A with some components removed to show internal structure.
Figure 2C:
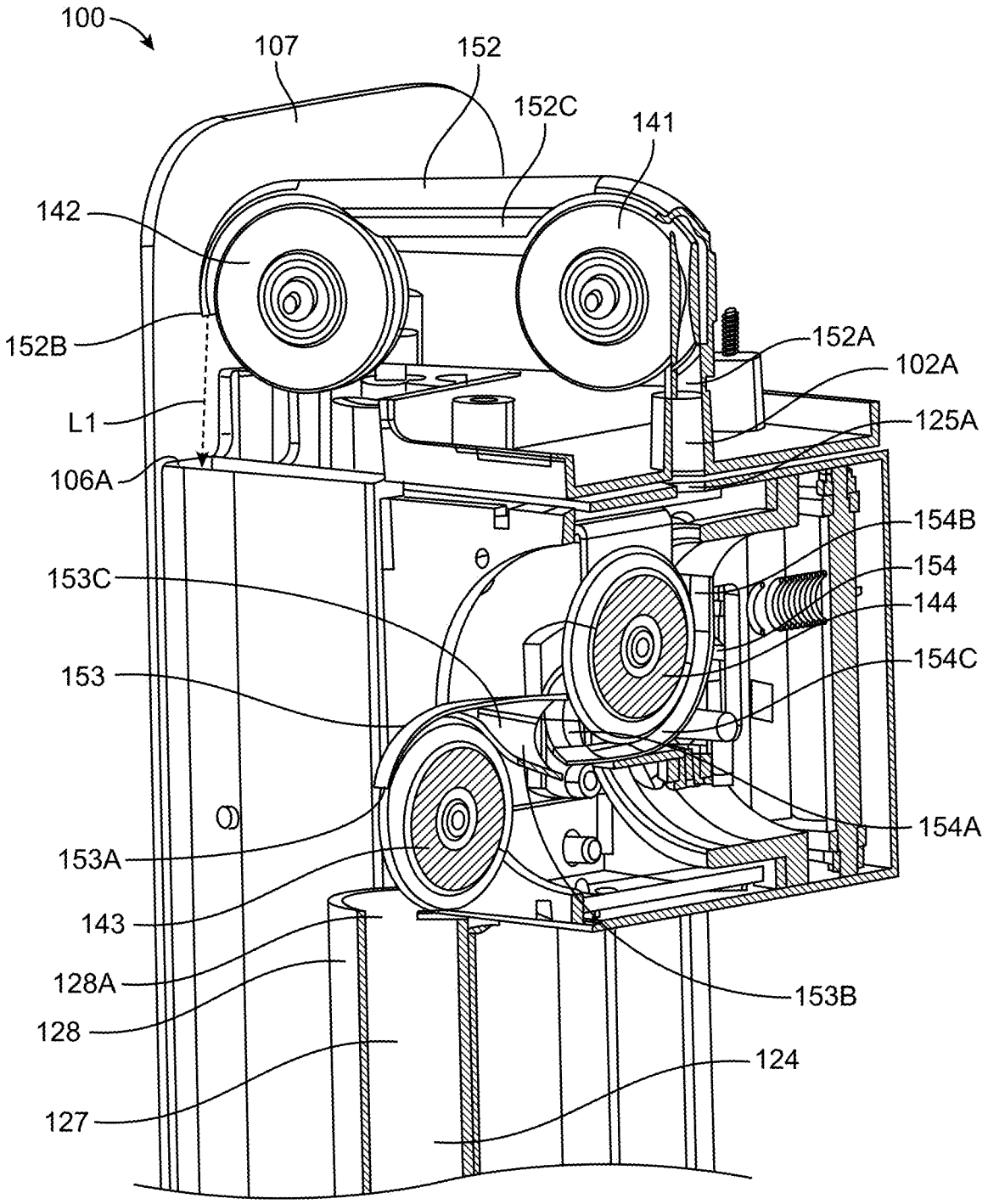
FIG. 2C illustrates a cross-section taken along line A-A in FIG. 2B.
Figure 2D:
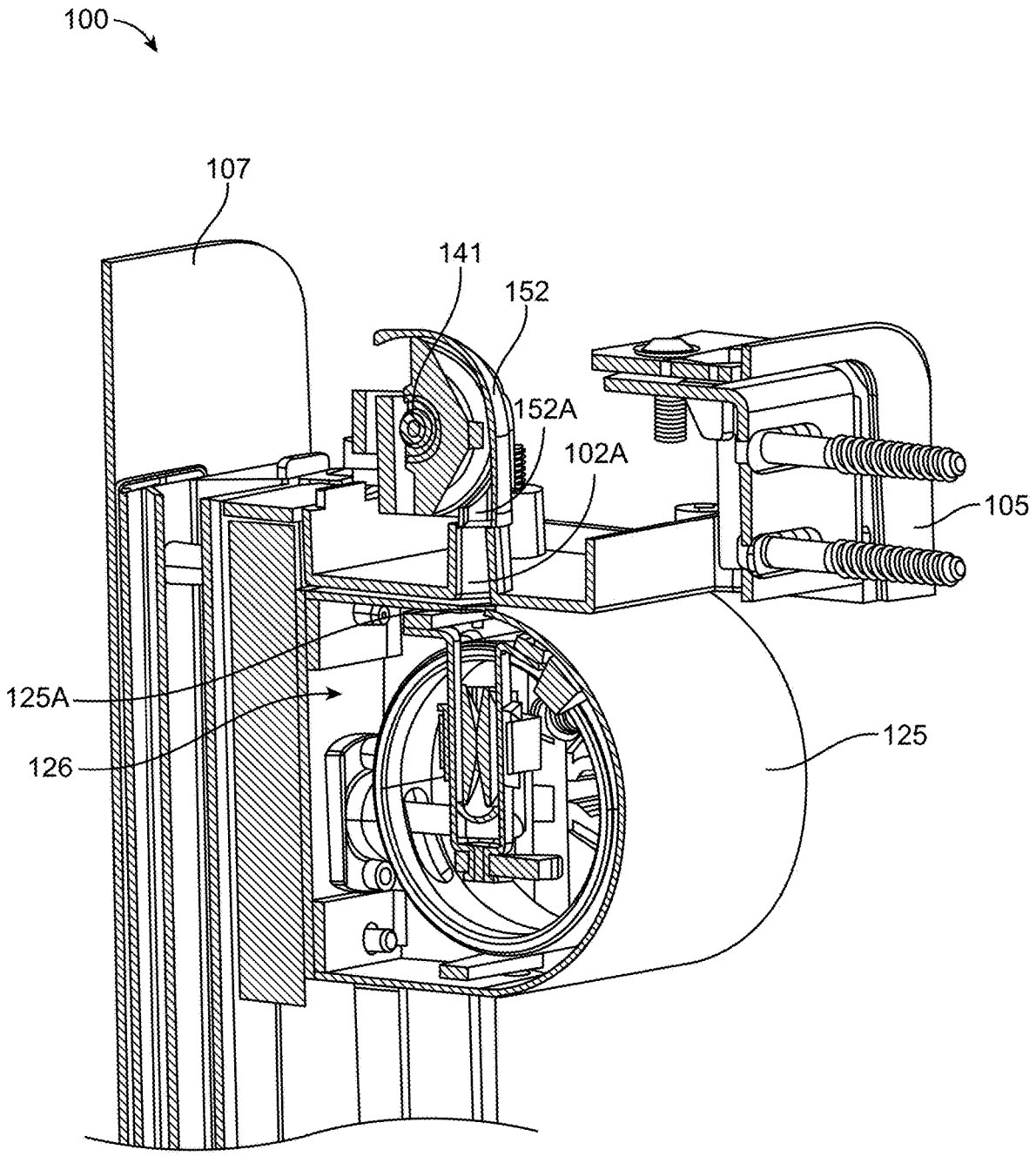
FIG. 2D illustrates a cross-section taken along line B-B in FIG. 2B.
Figure 2E:
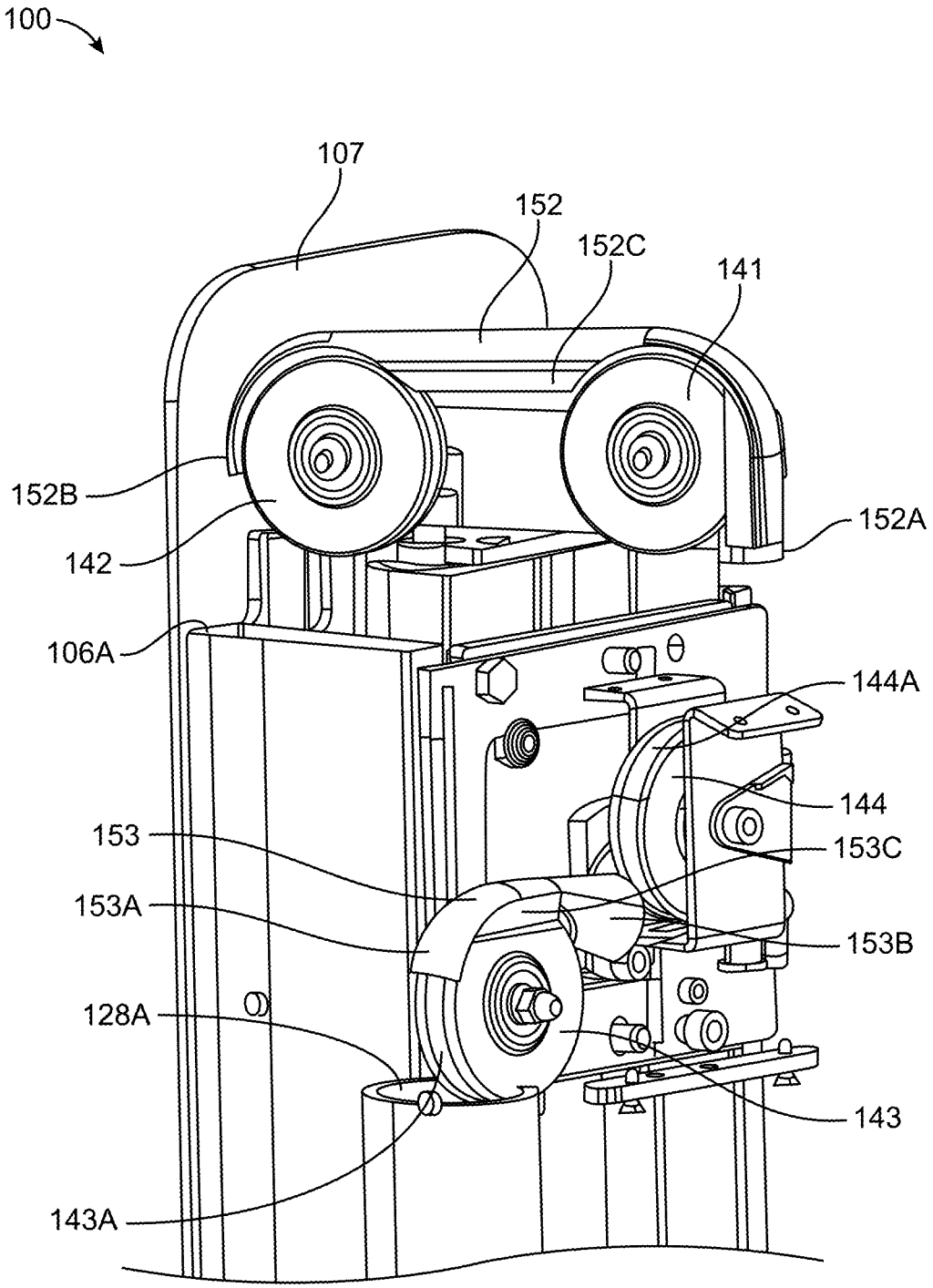
FIG. 2E illustrates the same view as that of FIG. 2B of the portion of the exercise equipment shown in FIG. 2B with some more components removed to show internal structure.
Figure 2F:
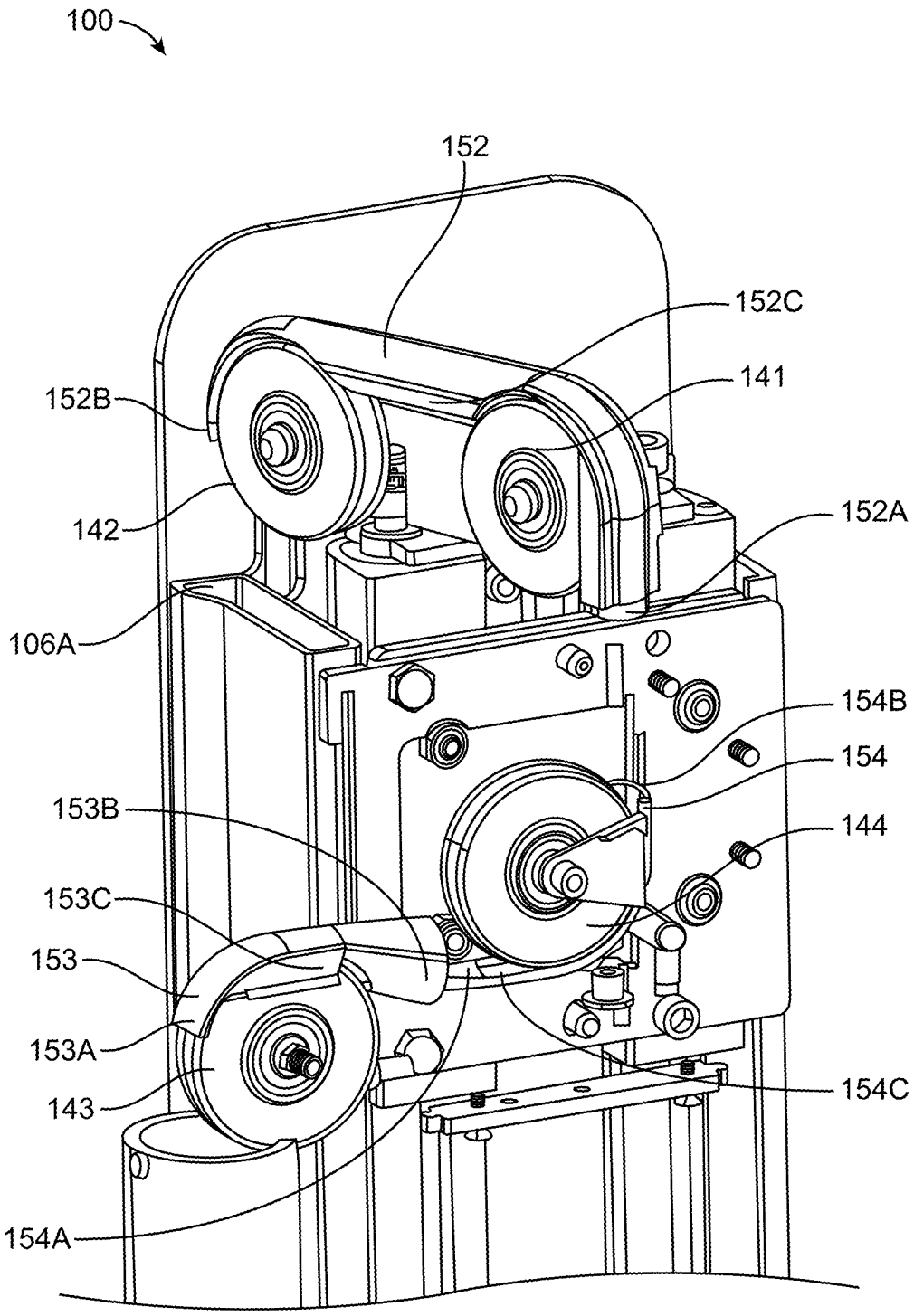
FIG. 2F illustrates another rear perspective view of the portion of the exercise equipment shown in FIG. 2B with some more components removed to show internal structure.
Figure 2G:
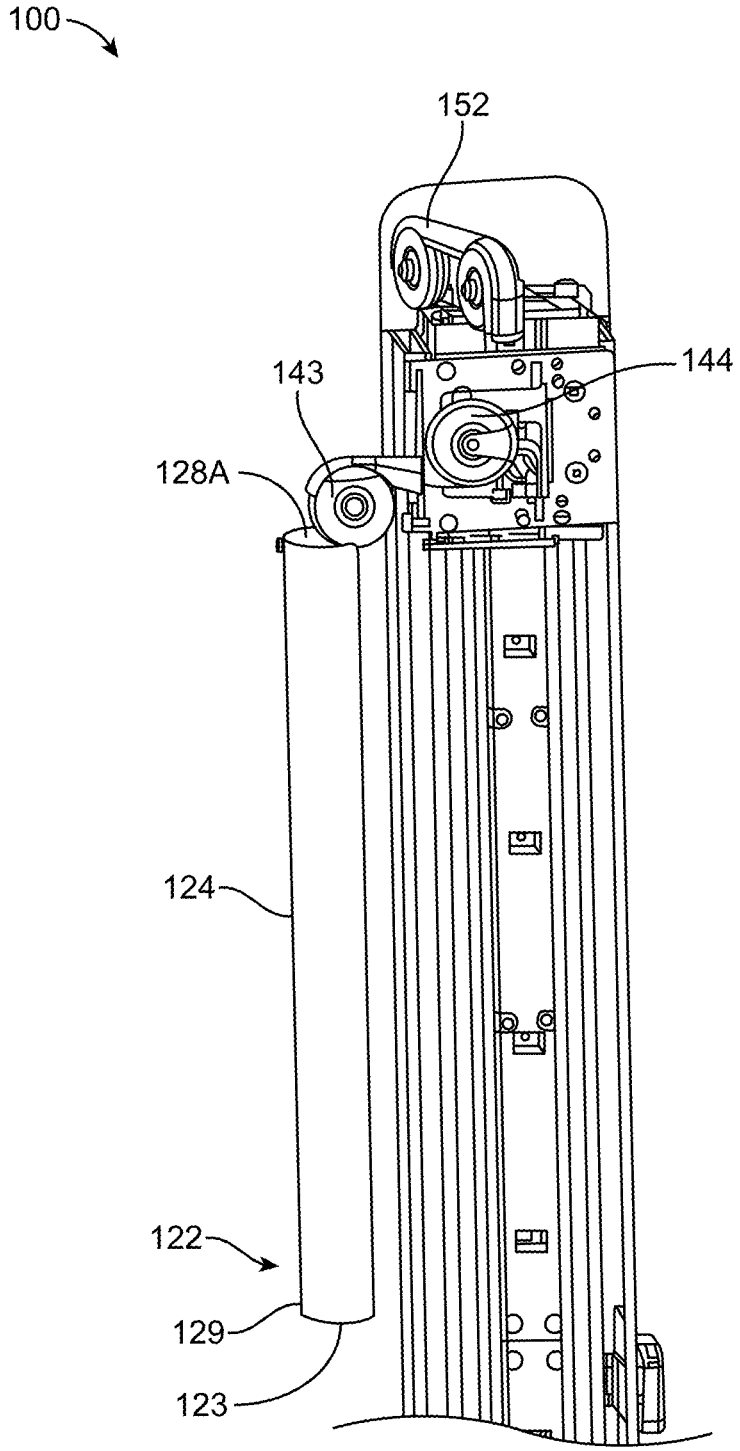
FIG. 2G illustrates a rear view of another portion of the exercise equipment of FIG. 2A with some components removed to show internal structure.
Figure 2H:
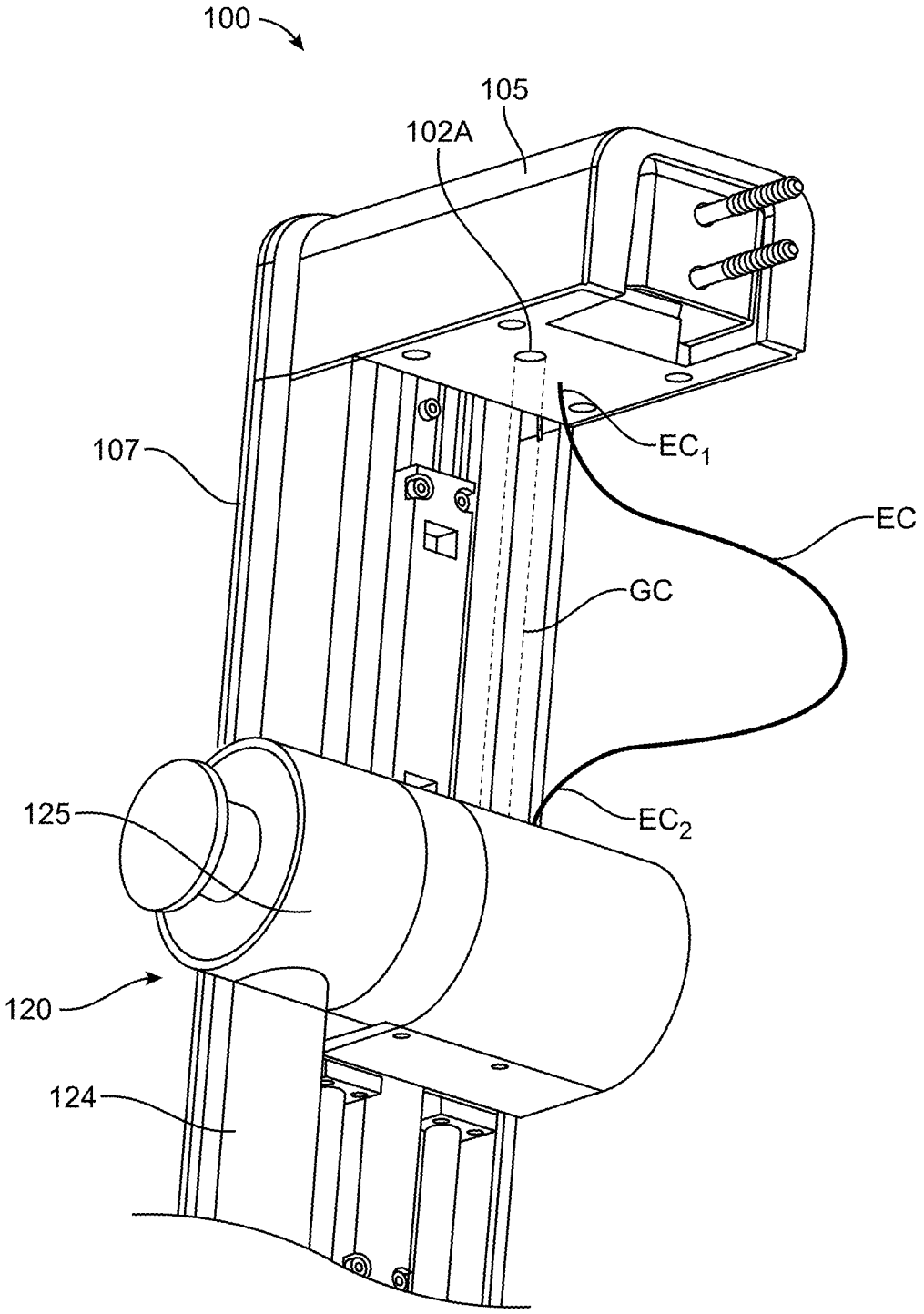
FIG. 2H illustrates a rear perspective view of yet another portion the exercise equipment of FIG. 2A.
Figure 2I:
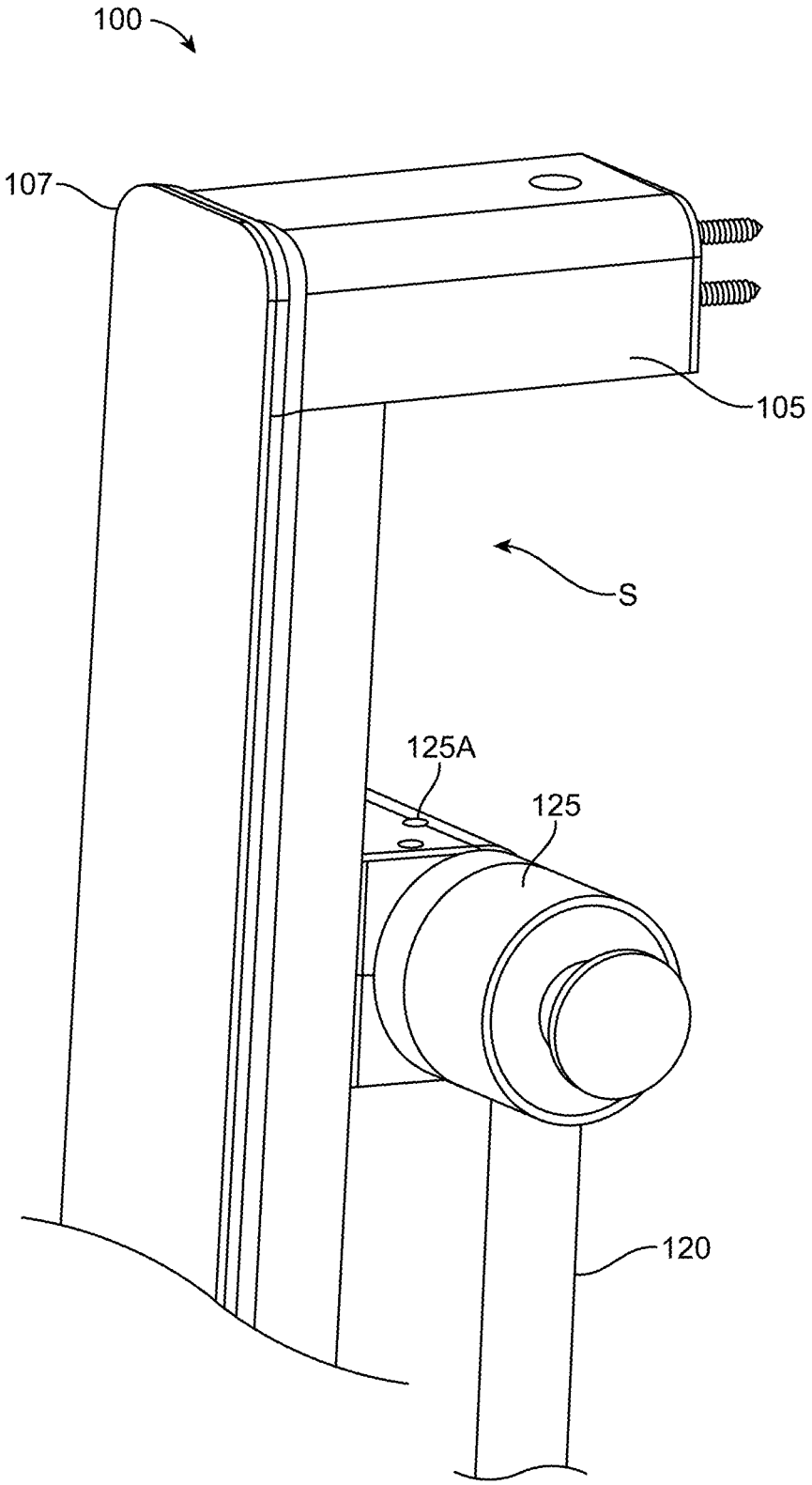
FIG. 2I illustrates a side perspective view of the portion of the exercise equipment shown in FIG. 2H.
Figure 2J:
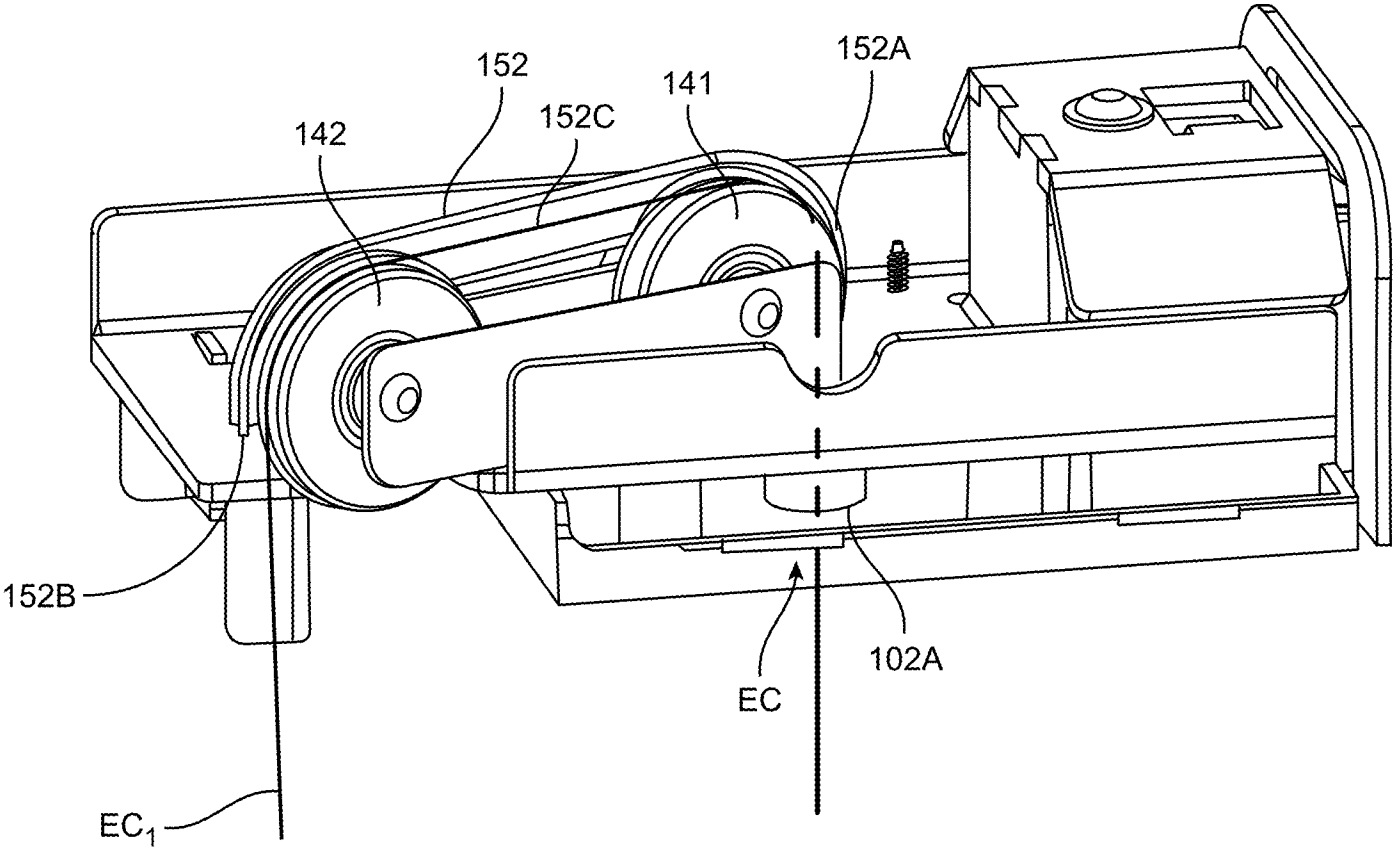
FIG. 2J illustrates a side perspective view of yet another portion of the exercise equipment of FIG. 2A showing frame sheaves and frame guiding elements.
Figure 2K:
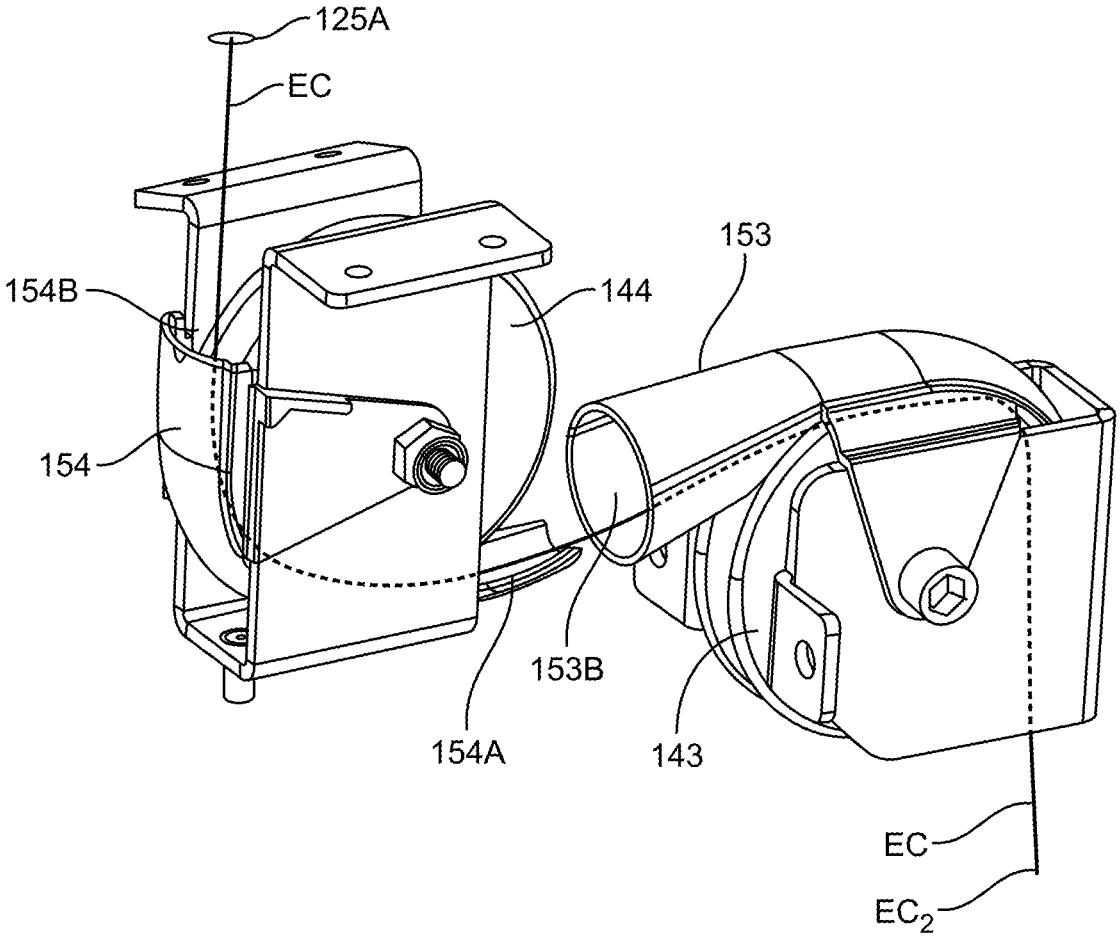
FIG. 2K illustrates a side perspective view of yet another portion the exercise equipment of FIG. 2A showing arm sheaves and arm guiding elements.
Figure 2L:
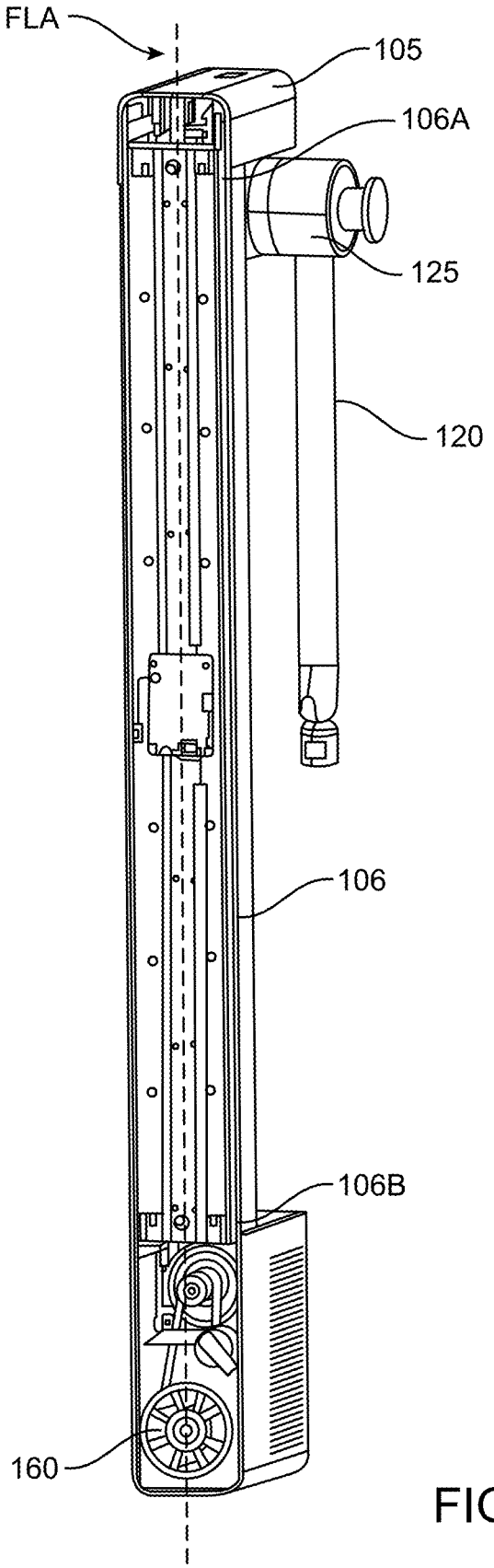
FIG. 2L illustrates a cross-section taken along line C-C in FIG. 2A.
Figure 2M:
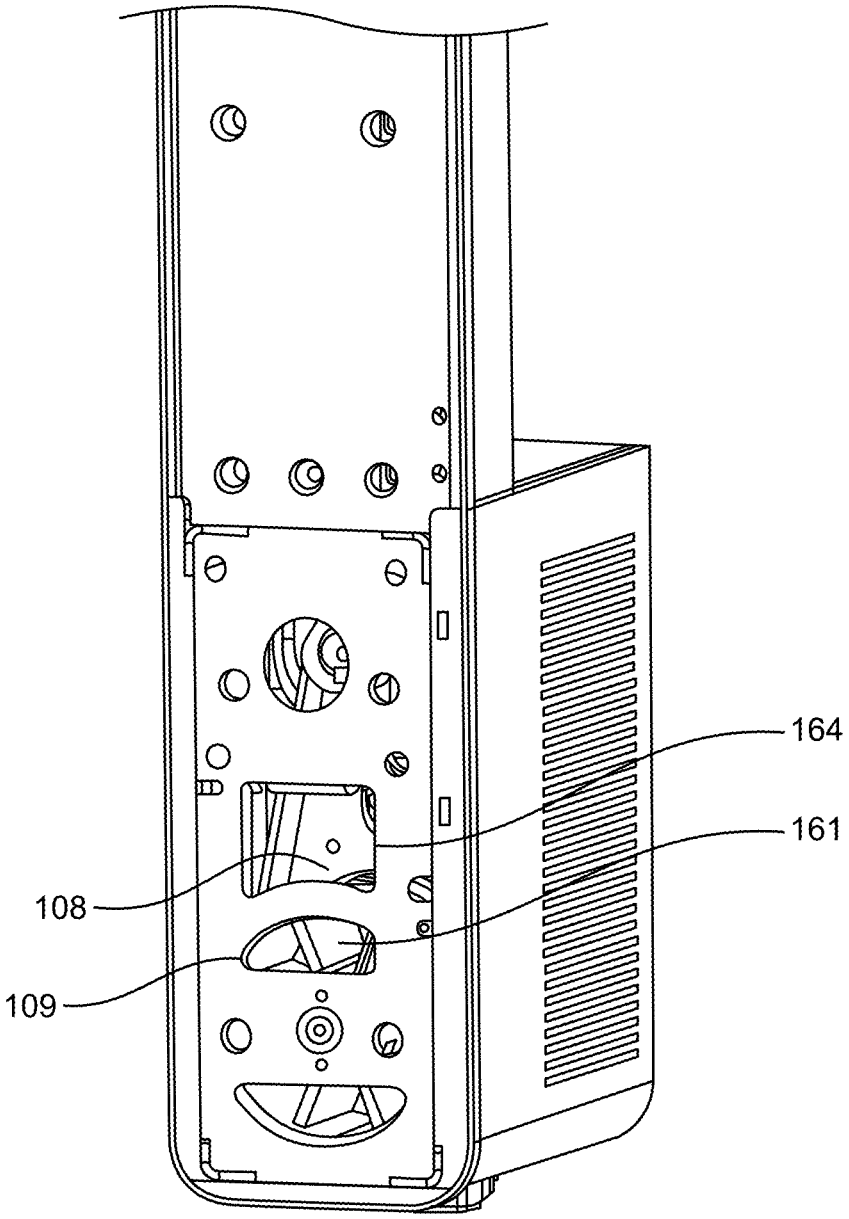
FIG. 2M illustrates a front perspective view of yet another portion of the exercise equipment of FIG. 2A showing a spool inside a frame of the exercise equipment.
Figure 2N:
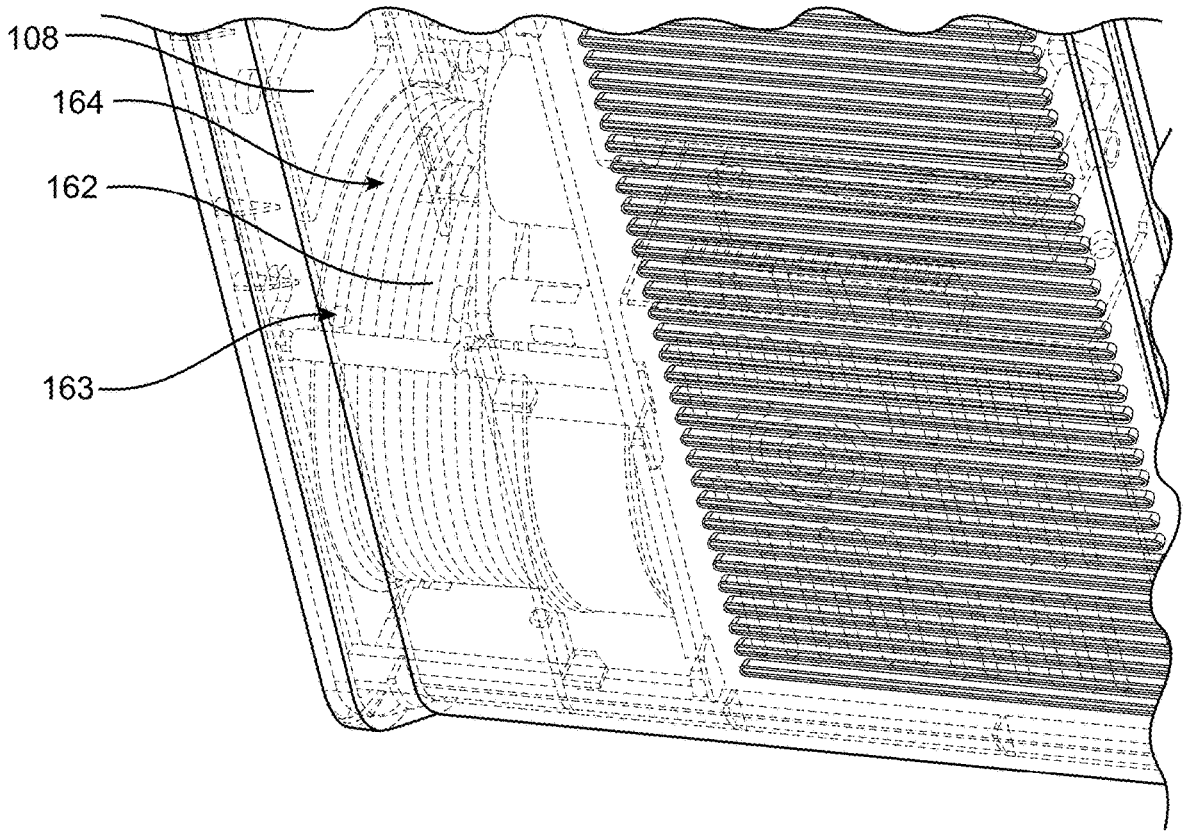
FIG. 2N illustrates a rear perspective view of yet another portion of the exercise equipment of FIG. 2A showing the spool inside the frame of the exercise equipment.
Figure 2O:
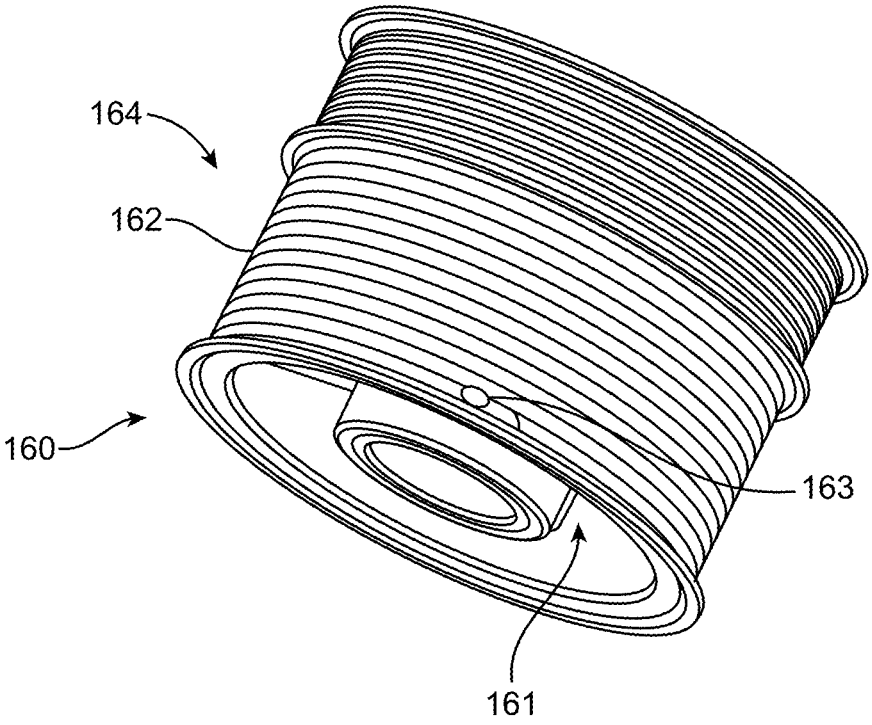
FIG. 2O illustrates a top perspective of the spool of the exercise equipment of FIG. 2A.
Figure 2P:
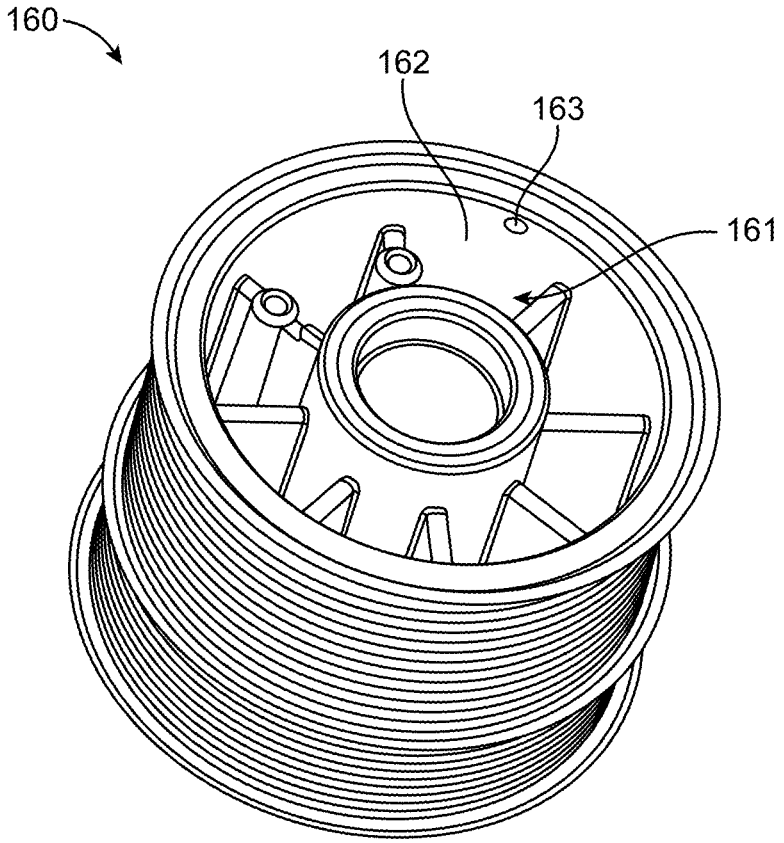
FIG. 2P illustrates a bottom perspective of the spool of the exercise equipment of FIG. 2A.

Reference is now made to FIGS. 2A to 2P illustrating an exercise equipment 100 according to an example of the presently disclosed subject matter. It is to be understood herein that the exercise equipment 100 shown in FIGS. 2A to 2P includes all the features of the exercise equipment 100 described above with reference to FIG. 1B, with some additional features, as described herein below. Accordingly, the description of features of the exercise equipment 100 of FIG. 1B applies analogously to corresponding features of the exercise equipment 100 of FIGS. 2A to 2P. Same reference numerals have been used for corresponding features of the exercise equipment 100 of FIGS. 1B and 2A to 2P.

In the example illustrated in FIGS. 2A to 2P, the arm 120 includes an elongated arm member 124 and a shoulder 125. The arm 120 is coupled to the frame 102 at least via the shoulder 125. In some examples, a shoulder can be a separate element from an elongated arm member, or even may not constitute a part of an arm. In some examples, a shoulder can be integrally formed with an elongated arm member. In some examples, a shoulder can be unitarily formed with an elongated arm member.

As generally referred to herein, an "elongate" or an "elongated" member, element or other component may include a component having a generally extended form, for example having a long dimension which is substantially greater than other dimensions of the component. For instance, the elongate or elongated beam, in the example of a substantially rectangular profile beam, can have a long axis which is at least 50%, 70%, 90% or intermediate or higher percentages longer than the beam's width and depth axes.

In the illustrated example, the shoulder 125 couples the elongated arm member 124 to the frame 102. The shoulder has a shoulder internal volume 126 constituting a part of the arm internal volume 123 and the elongated arm member 124 is a hollow tube defining an arm member internal volume 127 (FIG. 2C) constituting a part of the arm internal volume 121 (FIG. 2G). The first and second arm sheaves 143 and 144 and the first and second arm guiding elements 153 and 154 are positioned within the shoulder internal volume 126.

The elongated arm member 124 comprises a shoulder connection end 128 having a shoulder connection opening 128A establishing communication between the arm member internal volume 127 and the shoulder internal volume 126, and a wrist connection end 129 at the wrist portion 122 opposite the shoulder connection end 128. The wrist connection end 129 has the wrist connection opening 123 (interchangeably referred to herein as open wrist connection end 123) operable for connecting a wrist member thereto. The wrist member can include an exercise interface engageable by the user, optionally via an accessory such as a handle, for performing one or more exercise routines.

The first arm guiding element entry opening 153A is aligned with the shoulder connection opening 128A (as best seen in FIG. 2C and FIG. 2K) for receiving the end of the cable within the first arm guiding element 153 when the end of the cable exits the elongated arm member 124 via the shoulder connection opening 128A.

In the illustrated example, the shoulder 125 comprises a shoulder cable opening 125A aligned with and in communication with the second arm guiding element exit opening 154B (as shown for example in FIG. 2K), and the frame 102 comprises a frame cable opening 102A aligned with and in communication with the frame guiding element entry opening 152A (as best seen in FIG. 2D).

According to an example, the wrist connection opening 123 can constitute a cable receiving opening 123. In such an example, a user can insert the end EC1 of the cable EC through the cable receiving opening 123 into the arm internal volume 121, and can push the cable EC through the cable receiving opening 123 for advancing the cable through the arm cable path portion 134 of the cable path 130 within the elongated arm member 124. The end EC1 of the cable EC is guided by the hollow tube of the elongated arm member 124, which is free of obstructions to allow the end of the cable to pass therethrough. The end EC1 exits the hollow tube of the elongated arm member 124 via the shoulder connection opening 128A. The first arm guiding element entry opening 153A is aligned with the shoulder connection opening 128A, and thus the first arm guiding element 153 receives thereinto the end EC1 via the first arm guiding element entry opening 153A and guides the end EC1 of the cable EC through the channel 153C and onto the first arm sheave 143, within the circumferential channel 143A thereof. The end EC1 of the cable exits the first arm guiding element 153 via the first arm guiding element exit opening 153B. The second arm guiding element 154 receives thereinto the end EC1 via the second arm guiding element entry opening 154A, which is aligned with the first arm guiding element exit opening 153B. The second arm guiding element 154 guides the end EC1 of the cable EC through the channel 154C and onto the second arm sheave 144, within the circumferential channel 144A thereof. The end EC1 of the cable exits the second arm guiding element 154 via the second arm guiding element exit opening 154B. The end EC1 of the cable exits the arm 120 the shoulder cable opening 125A aligned with the second arm guiding element exit opening 154B.

In some examples, the frame cable opening 102A can be at least selectively aligned with the shoulder cable opening 125A, for example by moving the arm 120 with respect to the frame 102 to be at an uppermost position along the length of the frame 102 such that the shoulder 125 is positioned adjacent an upper bracket 105 of the frame 102. The arm can be moved with respect to the frame by a trolley arrangement, for example, as described herein further below. In such examples, the frame cable opening 102A receives therein the end EC1 when the end EC1 exits the shoulder cable opening 125A. In some examples, a guiding channel or conduit, for example, the guiding channel GC as shown by dotted lines (being optional) in FIG. 2H, can be formed between the frame cable opening 102A and the shoulder cable opening 125A for guiding the end of the cable from the shoulder cable opening 125A to the frame cable opening 102A or vice versa. Such a guiding channel can be flexible so as not to interfere with movement of the arm with respect to and along the frame. The end EC1 of cable EC can enter into the frame cable opening 102A from the shoulder cable opening 125A by either or both of alignment of the frame cable opening 102A and the shoulder cable opening 125A or the guiding channel GC. Once the end EC1 enters into the frame cable opening 102A, the frame guiding element 152, which is aligned with the frame cable opening 102A, receives thereinto the end EC1 via the frame guiding element entry opening 152A and guides the end EC1 of the cable EC through the channel 152C and onto the first and second frame sheaves 141 and 142. The end EC1 of the cable EC exits the frame guiding element 152 via the frame guiding element exit opening 152B.

In general, a guiding channel, conduit or other suitable element suitable for conveying a cable therethrough can be positioned between openings, such as in areas external to the frame and the arm, to bridge between the openings and allow continuity of the cable path.

In some examples, instead of the end EC1 entering automatically into the frame cable opening 102A from the shoulder cable opening 125A, the end EC1 can be manually entered by a user into the frame cable opening 102A after the end EC1 exits the shoulder cable opening 125A. For instance, when the end EC1 of the cable exits the shoulder cable opening 125A, the user can access the end EC1 (at a space S in FIG. 2I between the arm 120 and the upper bracket 105 of the frame 102) and insert the end EC1 into the frame cable opening 102A.

In some of the examples, the user can insert a first end of the cable EC, for example, the end EC1 through the frame cable opening 102A into the frame internal volume 103, and the first end of the cable can then be advanced as described above. The user can insert a second end of the cable EC, for example, the end EC2 through the shoulder cable opening 125A into the arm internal volume 121, and the second end of the cable can then be advanced in a reverse sequence as compared to the sequence of advancement of the cable via the first and second arm guiding elements and the elongated arm member 124 as described above. Accordingly, the frame cable opening 102A can constitute a first cable receiving opening, and the shoulder cable opening 125A can constitute a second cable receiving opening. In such example, the direction of advancement of the second end EC2 of the cable EC into the arm 120 is reversed. Accordingly, in such example, the sheave 144 can constitute (can be referred to as) the first arm sheave 144, and the sheave 143 can constitute (can be referred to as) the second arm sheave 143. Similarly, the guiding element 154 can constitute (can be referred to as) the first arm guiding element 154, and the guiding element 153 can constitute (can be referred to as) the second arm guiding element 153. Accordingly, the opening 154B can constitute (can be referred to as) the first arm guiding element entry opening 154B, and the opening 154A can constitute (can be referred to as) the first arm guiding element exit opening 154A. Similarly, the opening 153B can constitute (can be referred to as) the second arm guiding element entry opening 153B, and the opening 153A can constitute (can be referred to as) the second arm guiding element exit opening 153A. The reference to a sheave and/or a guiding element as being first and second is according to a sequence of that sheave and/or guiding element in the path of the end of the cable when the cable is inserted into the exercise equipment. Also, reference to an opening of a guiding element as being an entry or exit opening is according to the direction of the end of the cable entering into and exiting from that guiding element. It is to be understood herein that the advance of the end EC2 of the cable EC through the arm 120 in such example can be similar to that described above with reference to FIG. 1D. Once the second end of the cable exits the wrist connection opening 123, the second end of the cable can be attached to an exercise interface, which a user can engage and manipulate the cable. The exercise interface can be a handle, bar, or any exercise accessory that a user can engage directly or indirectly to manipulate the cable for performing one or more exercise routines.

In the illustrated example, the frame 102 is an elongated frame extending along a frame longitudinal axis FLA (FIG. 2A), and comprises an elongated frame channel 106 (FIG. 2L) extending along the frame longitudinal axis FLA. The frame channel 106 defines at least partially a frame cable path portion. The frame channel is a closed channel which has a frame channel top opening 106A and a frame channel bottom opening 106B (FIG. 2L) for allowing the end EC1 of the cable EC to be conveyed through the frame channel 106. The frame channel 106 is at least partially isolated from the other components located in the frame internal volume 103, for example control knob(s), electronic/electrical components, etc. Accordingly, the frame channel 106 is free of obstructions, enabling the end EC1 of the cable to pass therethrough.

The frame channel top opening 106A is aligned (as shown by dotted arrow line L1 in FIG. 2C) with the frame guiding element exit opening 152B. Once the end EC1 of the cable EC reaches the frame guiding element 152, for example by any of the sequences and examples described above, and exits the frame guiding element exit opening 152B, the end EC1 advances into the frame channel top opening 106A. The cable end EC1 then advances through the frame channel 106 and exits the frame channel bottom opening 106B.

In general, a frame can include an anchor access opening, via which a user can access, e.g. manually, the end EC1 of the cable EC and a cable anchor from outside the frame for anchoring the end EC1 to the cable anchor, for completing installation of the cable in the exercise equipment. In some examples, the frame can include a removable faceplate connected to a frame chassis via a quick-connection arrangement. The quick connection arrangement can include any one or more of a snap connection arrangement, a magnetic connection, a snug-fit connection arrangement, and equivalents thereof. In such examples, the anchor access opening can be accessible by hands of a user after removal of the faceplate. For instance, the anchor access opening can be located behind the removable faceplate.

In the example illustrated in FIGS. 2A to 2P, the removable faceplate has been generally designated as 107, and the anchor access opening has been designated as 108. In the illustrated example, the cable anchor is constituted by a spool 160. The spool 160 has a spool internal volume 161 defined by a spool wall 162 operable for winding at least a segment of the cable EC thereon. The spool wall 162 comprises a spool wall hole 163 extending from an exterior side 164 of the spool 160 to the spool internal volume 161. The anchor access opening 108 is aligned with the exterior side 164 of the spool 160, which is positioned in alignment with the frame channel bottom opening 106B, such that when the end EC1 of the cable EC exits the frame channel bottom opening 106B, it reaches the exterior side 164 of the spool 160. Upon removal of the faceplate 107, the user can access, through the anchor access opening 108, the cable end EC1 as well as the spool wall hole 163 from the exterior side 164 of the spool 160.

The frame 102 further comprises a spool internal volume access opening 109. Upon removal of the faceplate 107, the user can access the spool internal volume 161 from outside the frame 102.

Once the end EC1 of the cable EC reaches the exterior side 164 of the spool 160, the user, via the anchor access opening 108, engages (e.g. grasps with their fingers) the end EC1 and inserts the end EC1 into the spool internal volume 161 via the spool wall hole 163. Then, via the spool internal volume access opening 109, the user accesses the end EC1 from within the spool internal volume 161 and anchors the end EC1 within the spool internal volume 161. For example, to anchor the cable end to the spool, the user can tie a knot on the end EC1, which is larger than the spool wall hole 163 and allows the end EC1 to be maintained inside the spool internal volume 161. Due the knot being larger than the spool wall hole 163, the knot cannot be detached from the spool when the cable is pulled.

It is noted that in some examples, additionally or alternatively to tying a knot, a user may place (e.g. by threading) a bead element or other element suitable to prevent the end of the cable from detaching from the spool. In some examples, the cable can be anchored using fixation means, e.g. bolts. In some examples, the end of the cable can be configured for an interference-fit anchoring, for example with the spool wall.

The other end EC2 of the cable EC can be operatively engaged with the wrist member when connected to the arm 120, for being pulled by a user to perform one or more exercise routines, or for other purposes including attaching the cable to an add-on accessory.

The cable EC is wound on the spool along a part of its length. For instance, the spool is at least indirectly coupled to a resistance source that is operable to apply resistance onto the cable, once the cable is anchored to the spool, and the resistance source is operable to rotate the spool in a winding direction thereby causing the cable to wind onto the spool once the cable is anchored to the spool. When a user performs an exercise routine, for example by engaging a user interface element connected to the end of the cable opposite to the end which is anchored to the spool, the user pulls the cable against the resistance force applied on the cable by the resistance source, and causes the spool to rotate in an unwinding direction, opposite the winding direction, and to unwind from the spool. Once the user releases the pulling force, the resistance applied by the resistance source and/or coupling of the spool to the resistance source causes the cable to wind onto the spool.

In order to remove the cable EC from the exercise equipment 100 of any of the examples described above, for example in a situation in which the cable is damaged or worn out, the user can release the end EC1 of the cable EC from within the spool internal volume 161 by accessing via the spool internal volume access opening 109 of the frame 102, and then pulling the cable out of the exercise equipment via any cable receiving opening, or even via a wrist member, if connected to the arm.

Accordingly, the exercise equipment according to various examples described herein may enable easy insertion, installation, removal, and/or replacement by minimal disassembly of parts of the exercise equipment, for example, requiring only the faceplate (if any) and the wrist member to be disassembled. In some examples, the anchor access opening and/or the spool internal volume access opening can be formed in the faceplate thereby eliminating the need for removal of the faceplate. Insertion or replacement of the cable can be performed without detaching the exercise equipment from the wall.

It is noted that in some embodiments, advancement of the cable end(s) through the inner volume of the frame and/or the arm can be assisted externally, for example, with the aid of a rotary handle, rollers, a ratchet mechanism or other suitable means. Alternatively, no tools or accessories are used for advancing the cable, and pushing of the cable is performed manually. In some examples, a stiffer, external guiding cable may be used for introducing the actual cable into the exercise machine.

It is noted that the cable is rigid enough to enable it to be pushed into and through its pathway, without interfering with its ability to curve or turn. In some cases, the cable is coated with a smooth coating One or more examples of the exercise equipment described above can include one or more features of the exercise equipment described below according to various examples.

In some examples, the exercise equipment (e.g. one or more controllers thereof) are configured to track usage so that when an inserted cable passes a certain threshold of use cycles, the user is alerted (e.g. via a cellphone application) and is required to replace the cable. In some examples, the exercise equipment tracks a time period from insertion of a cable, and the user is alerted when a predefined time period has passed. In some examples, the user is encouraged (e.g. via the cellphone application) to check the cable periodically, e.g. by visually inspecting the cable for tears or other damages, and determine whether cable replacement is needed.

In some examples, the user is guided, e.g. via the cellphone application, regarding the process of replacing the cable. Optionally, a step-by-step guide is provided (e.g. by text, a movie, a series of photos, or the like). In some examples, the user may contact a support center and receive live guidance from a technician, assisting the user during replacement of the cable.

Referring now to adjustment and selection of orientation of an arm with respect to a body (e.g. a longitudinal beam)

of the exercise equipment, the adjustment of the orientation of the arm with respect to the longitudinal beam can include locking the arm with respect to the longitudinal beam at an orientation selected out of multiple different orientations. In some examples, locking is carried out using a locking mechanism, which can be suitable to firmly restrain the arm in a selected orientation as well as maintain a robust connection to a chassis of the exercise equipment.

One or more examples of the exercise equipment described below can include one or more features of the exercise equipment described above according to various examples.

An exercise equipment, according to the examples described herein, during use can have a cable with one end anchored within the exercise equipment and an opposite free end accessible to a user via an arm of the exercise equipment. The user can engage the free end, either directly or via a user interface (which can be a part of the exercise equipment or externally connected thereto) and pull the free end away from the exercise equipment for performing one or more exercises. The exercise equipment can apply resistance on the cable against a direction of pulling by the user. The resistance can be applied by a resistance source, which can be a motorized resistance source. The motor can be an electronically adjustable weight resistance motor coupled, at least indirectly, to the resistance source.

Adjustment of the arm orientation can be performed, for example, for setting the arm at a position suitable for a user, for setting the arm at a position suitable for a certain exercise to be performed, etc.

In general, an exercise equipment can comprise a longitudinal beam (interchangeably referred to herein as a beam) having a beam longitudinal axis. The beam can be a part of a frame and/or constitute a part of a chassis of the exercise equipment. An arm can be rotatably coupled, at least indirectly, to the longitudinal beam, for example for adjusting an orientation of the arm with respect to the beam. The arm can be rotatable about the beam in a vertical plane, for example, when the beam is oriented upright. More particularly, the arm can be rotatable about an arm rotation axis extending along a first direction transverse to the beam longitudinal axis.

The arm can comprise a rotatable element selectively rotatable about the arm rotation axis. The rotatable element can be selectively, and not freely, rotatable due to the use of a locking mechanism operable for locking the rotation of the rotatable element at different orientations of the arm with respect to the beam. In some examples, the locking mechanism can comprise a locking base fixedly connected, at least indirectly, to the longitudinal beam, and a locking element pivotably coupled, at least indirectly, to the locking base. The locking element can be pivotable between a locking position and an unlocking position about a pivot axis. The locking element, in the locking position, can engage the rotatable element and prevent the rotation thereof about the arm rotation axis, and in the unlocking position, can be distant (disengaged or otherwise at least partially moved away) from the rotatable element to allow the rotation thereof about the arm rotation axis.

According to some examples, the locking element and the rotatable element can include at least one pair of engageable mating surfaces or portions, one surface of a pair being associated (by way of being formed on, mounted, connected, etc.) with the rotatable element and the other surface of the pair being associated (by way of being formed on, mounted, connected, etc.) with the locking element. The locking element engaging the rotatable element is to be understood as meaning that the engageable mating surfaces thereof mate each other so as to prevent rotation of the rotatable element about the arm rotation axis. It is to be understood herein that engageable mating surfaces can refer to contoured structures designed to contact each other and establish a connection, fix, or fit with each other. Such surfaces are designed to interact and lockingly engage with each other to prevent movement of one with respect to the other at least in one direction. Engageable mating surfaces can have specific shapes, dimensions, and features that allow them to fit together, and may include grooves, slots, tabs, ridges, or equivalents thereof. In some examples, the engageable mating surfaces can include one or more pairs of interlocking teeth that enable an interlocking connection and/or engagement therebetween. In some examples, the engageable mating surfaces can include gear teeth in a gear system, zipper teeth in a zipper mechanism, interlocking tabs and slots, and/or interlocking flanges. In some examples, the engageable mating surfaces can include one or more pairs of protrusion and recess, in which a protrusion on one component (of the rotatable element and the locking element) fits into a corresponding recess on the other component (of the rotatable element and the locking element) creating a locked interference engagement. The protrusion(s) can include one or more projections, ridges, and/or any other protruding feature. The corresponding recess(es) may be channels, depressions, notches, cavities and/or any recessed area. In some examples, the locking element can include an elongate element, for example in the form of pin, rod, etc., selectively lockingly engageable with the rotatable element.

The exercise equipment can comprise a lock controller operatively associated with the locking mechanism and operable for pivoting the locking element at least from the locking position to the unlocking position. It is to be understood herein for the purposes of the present description that two elements being operatively associated, operatively connected, or operatively coupled to each other is intended to mean that the two elements can co-operate with each other, for example, such that operating one of the two elements can operate the other one of the two elements either directly or indirectly.

The lock controller can include any mechanical, electrical, and/or magnetic structure suitable to displace the locking element, for example by pivoting the locking element at least from the locking position to the unlocking position. In some examples, the lock controller can include a lever arrangement. In some examples, the lock controller can include a button, switch, knob, or an equivalent thereof.

Figure 3A:
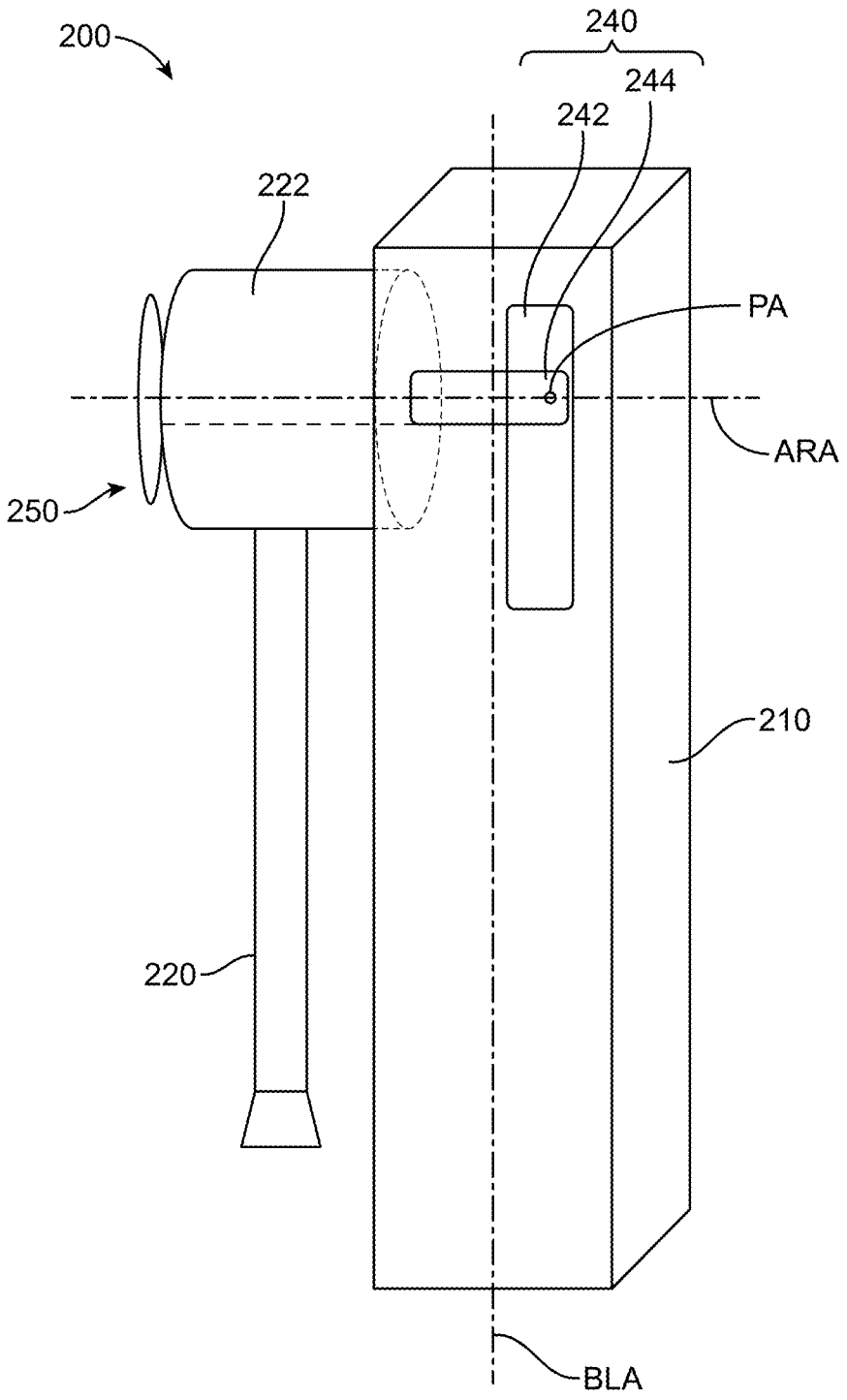
FIG. 3A illustrates a schematic rear perspective view of an exercise equipment according to yet another example of the presently disclosed subject matter with its locking element in locking position.
Figure 3B:
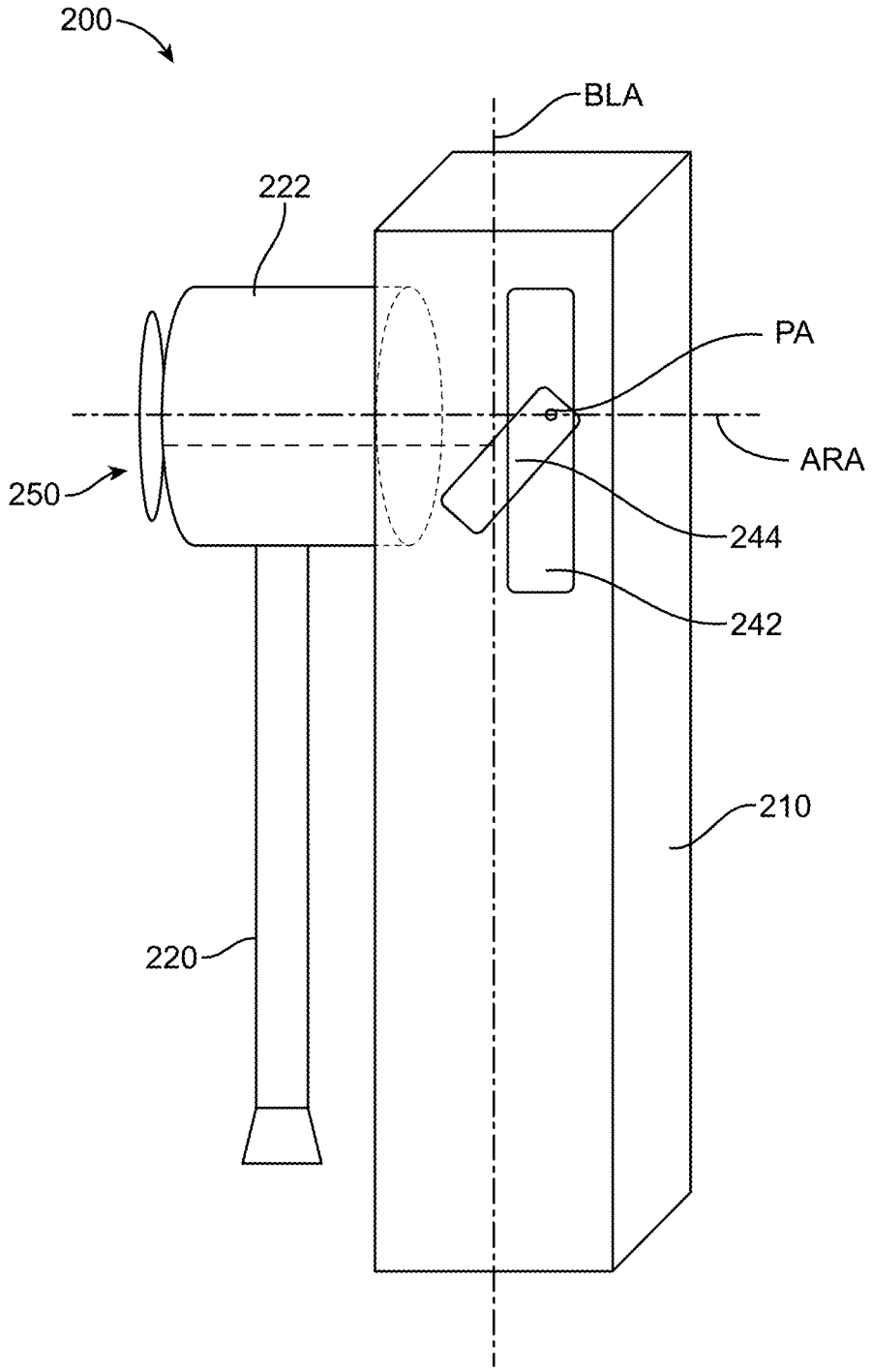
FIG. 3B illustrates the same view as shown in FIG. 3A of the exercise equipment of FIG. 3A with its locking element in unlocking position.
Figure 4A:
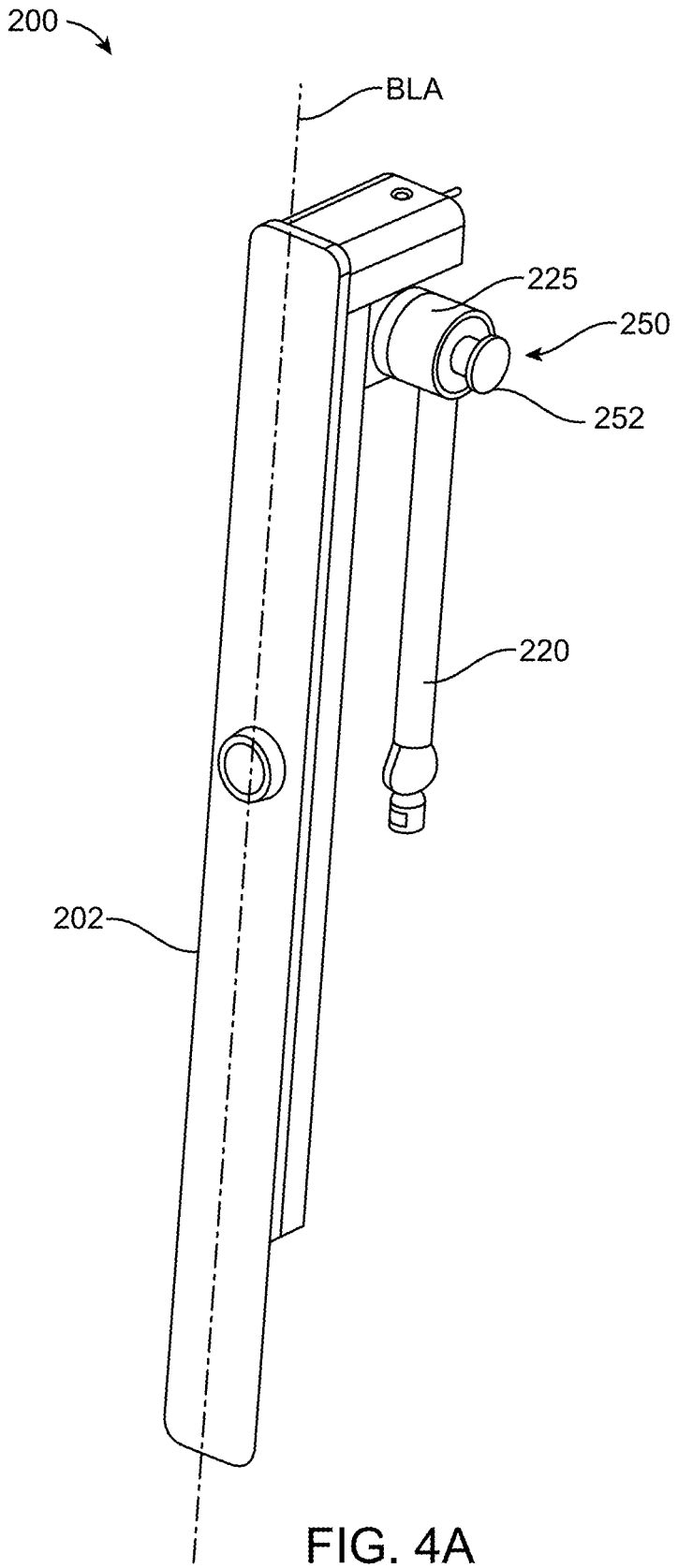
FIG. 4A illustrates a side perspective view of an exercise equipment according to yet another example of the presently disclosed subject matter.
Figure 4B:
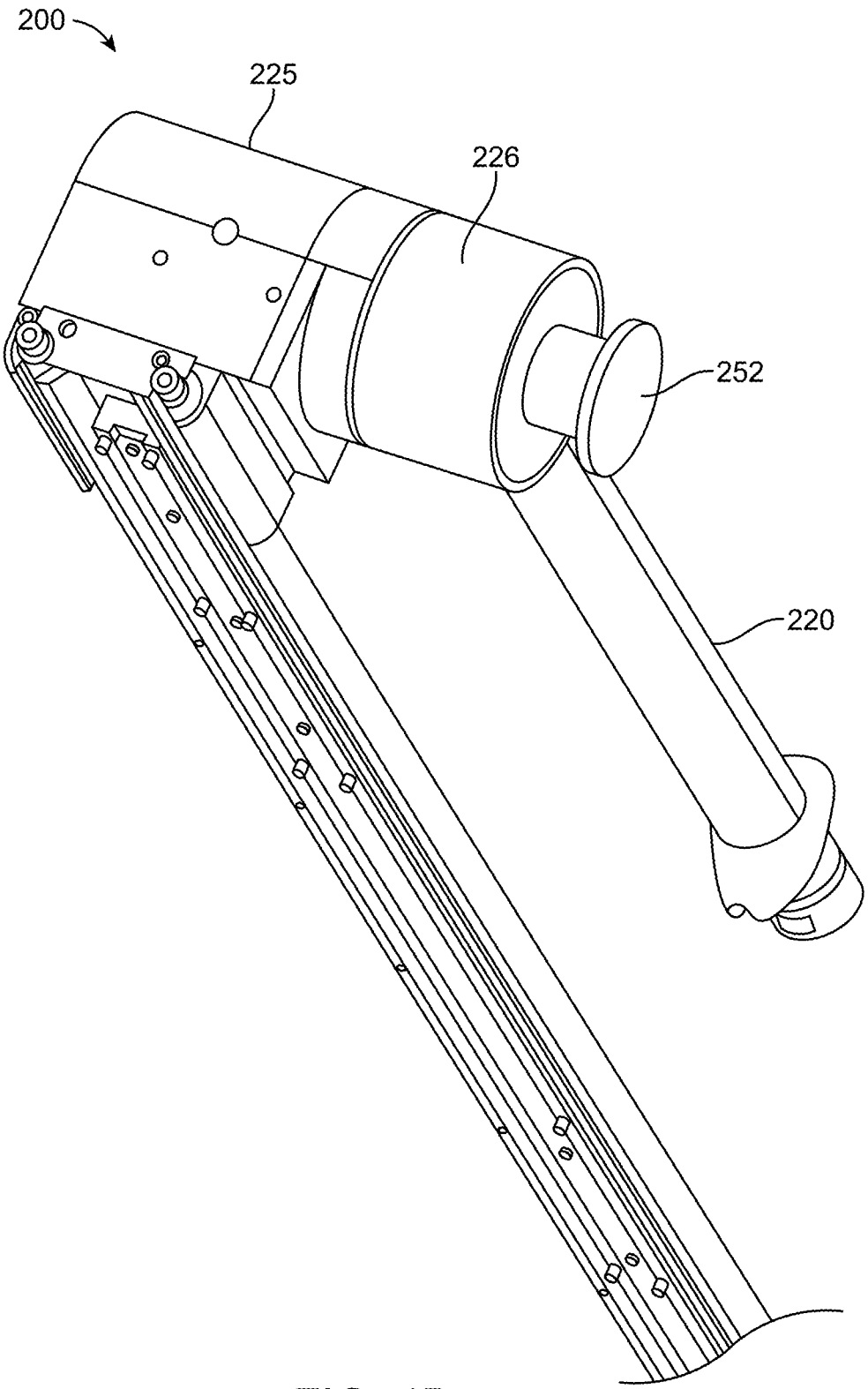
FIG. 4B illustrates a top perspective view of a portion of the exercise equipment of FIG. 4A with some components removed to show internal structure.
Figure 4C:
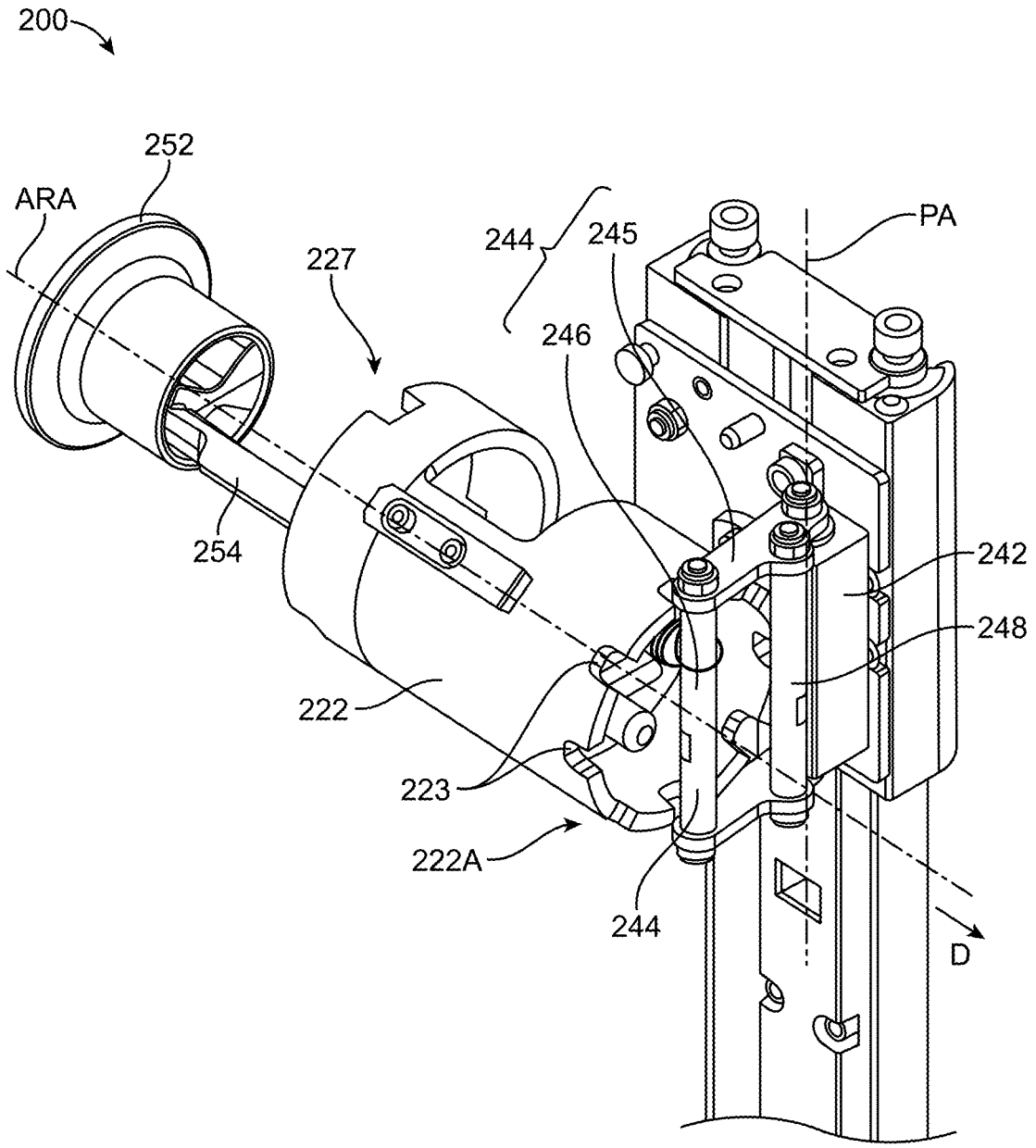
FIG. 4C illustrates a rear perspective view of another portion of the exercise equipment of FIG. 4A with some components removed to show internal structure.
Figure 4D:
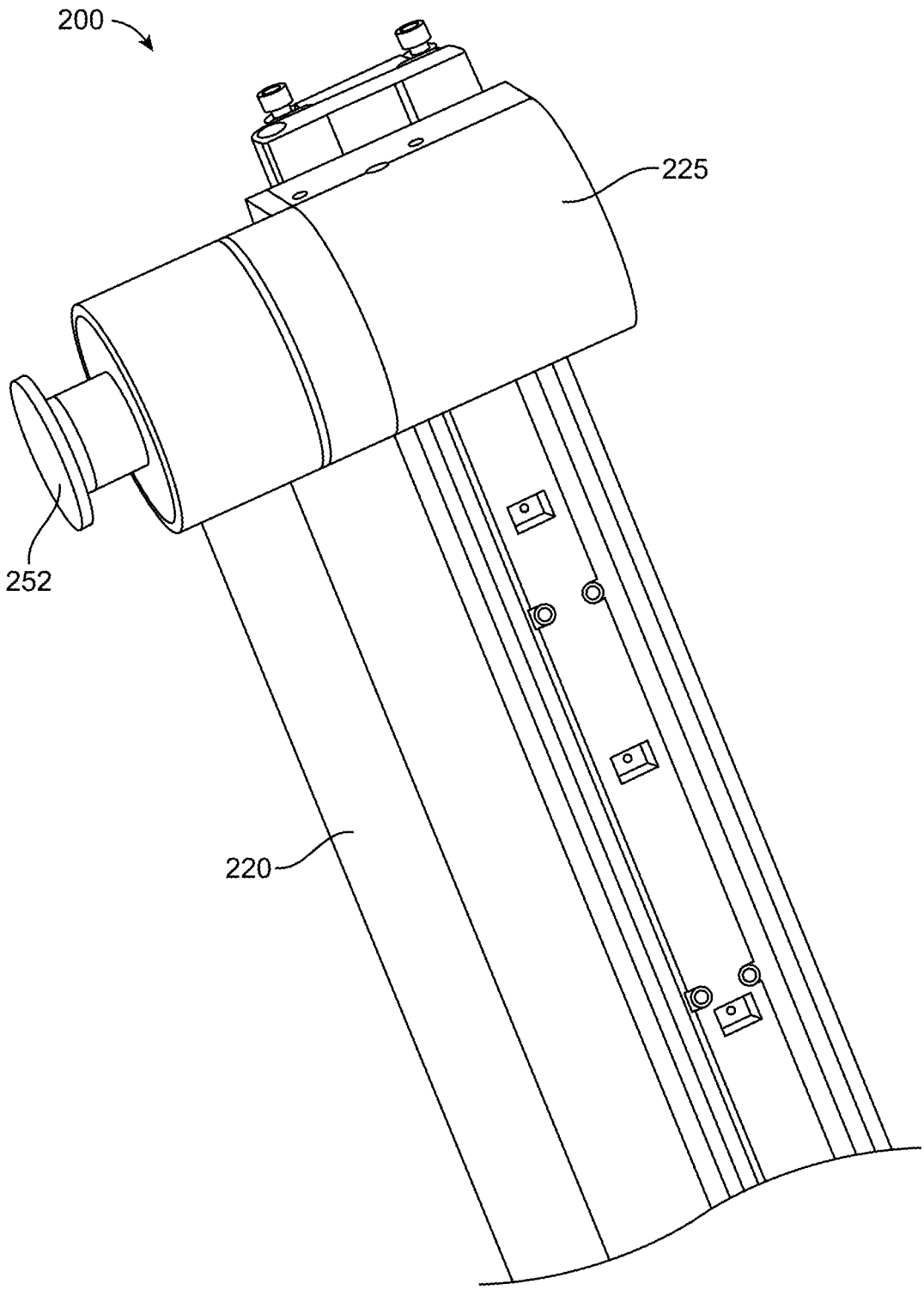
FIG. 4D illustrates a rear perspective view of yet another portion of the exercise equipment of FIG. 4A with some components removed to show internal structure.
Figure 4E:
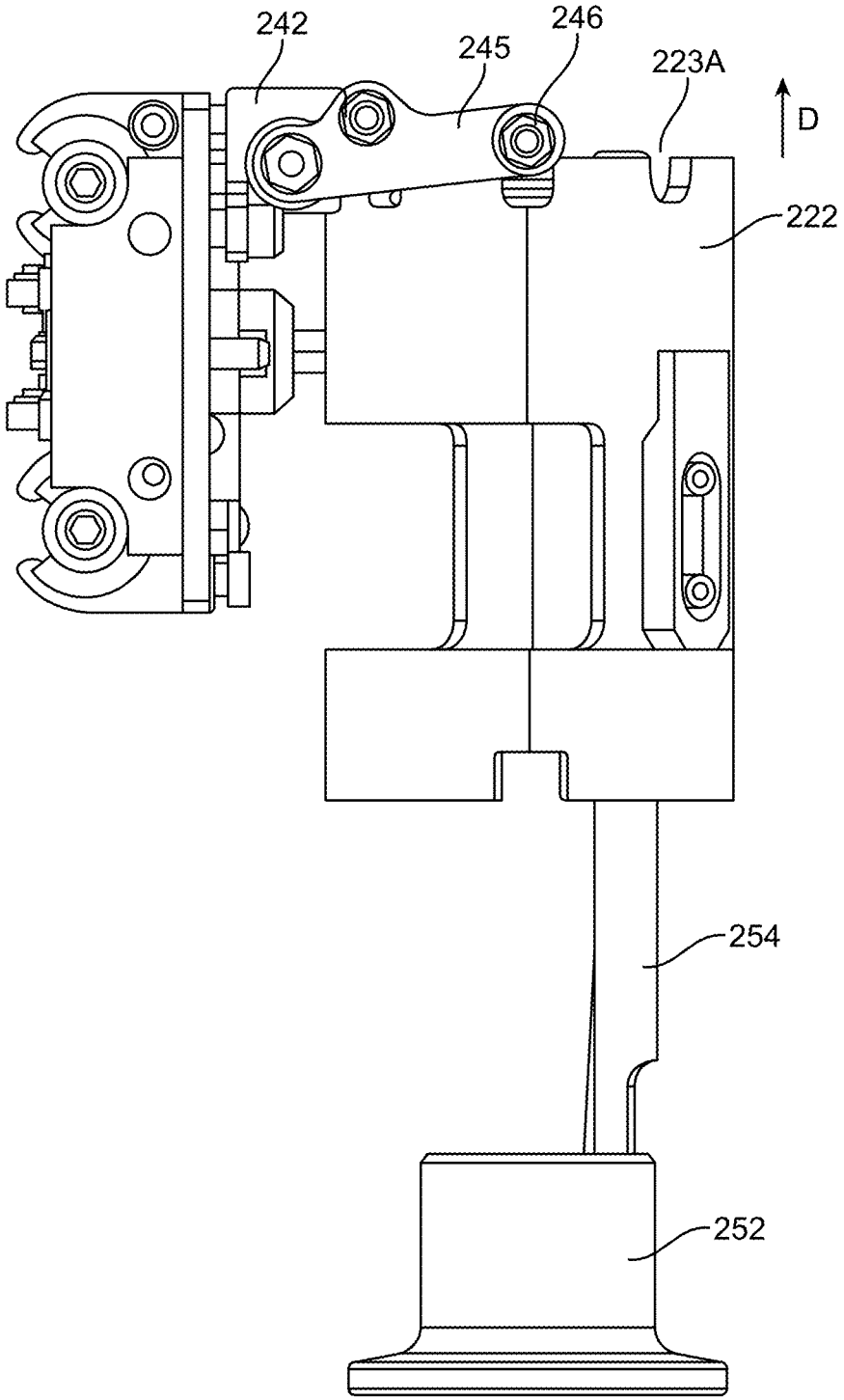
FIG. 4E illustrates a top view of yet another portion of the exercise equipment of FIG. 4A with some components removed to show internal structure.
Figure 4F:
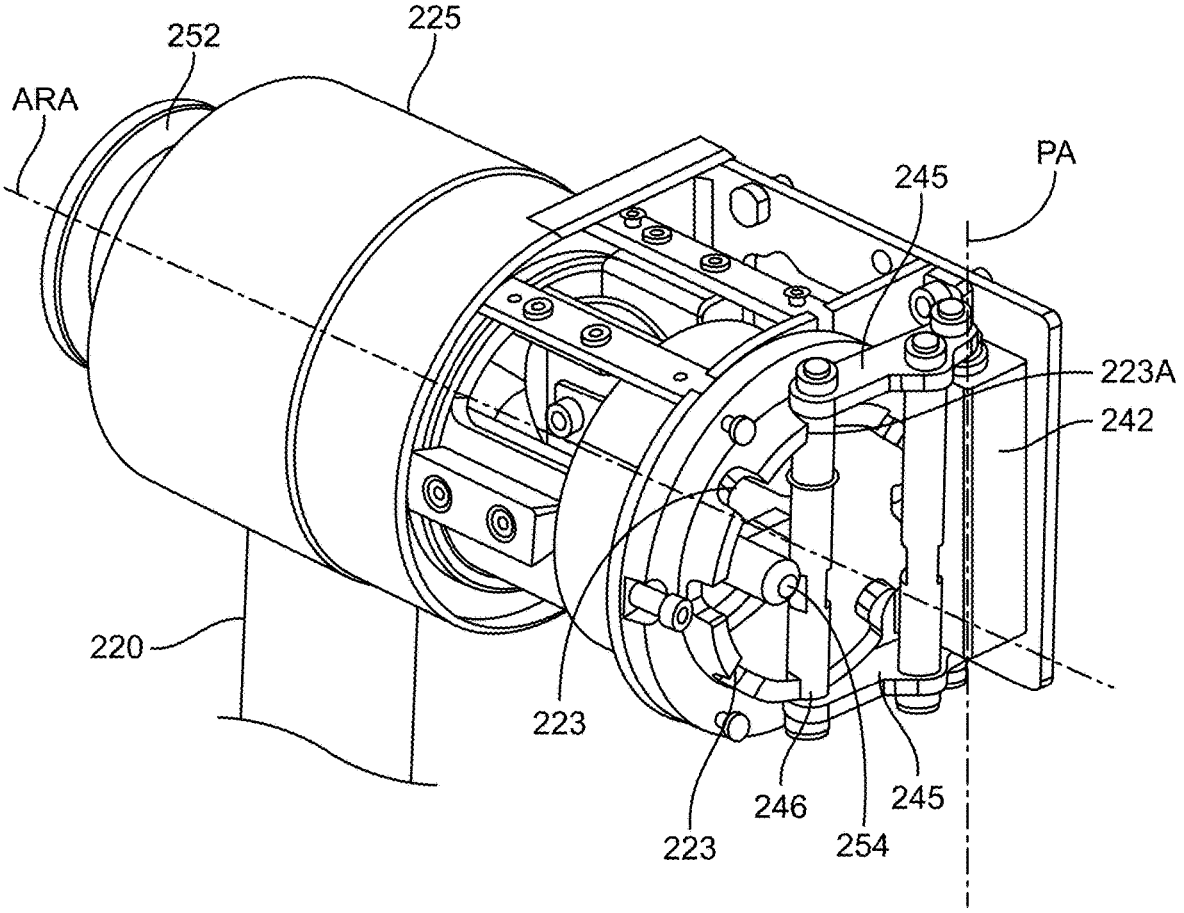
FIG. 4F illustrates a rear perspective view of yet another portion of the exercise equipment of FIG. 4A with some components removed to show internal structure.
Figure 4G:
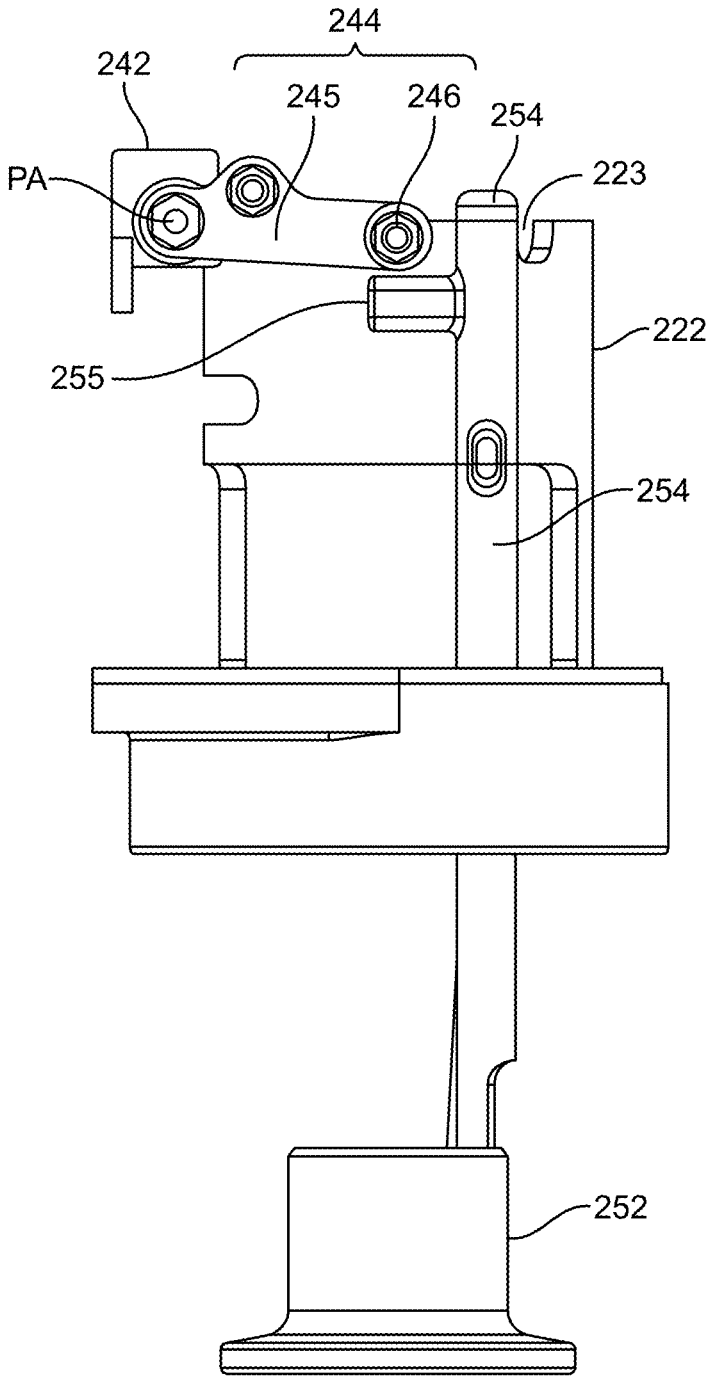
FIG. 4G illustrates a top view of yet another portion of the exercise equipment of FIG. 4A with some components removed to show internal structure.
Figure 4H:
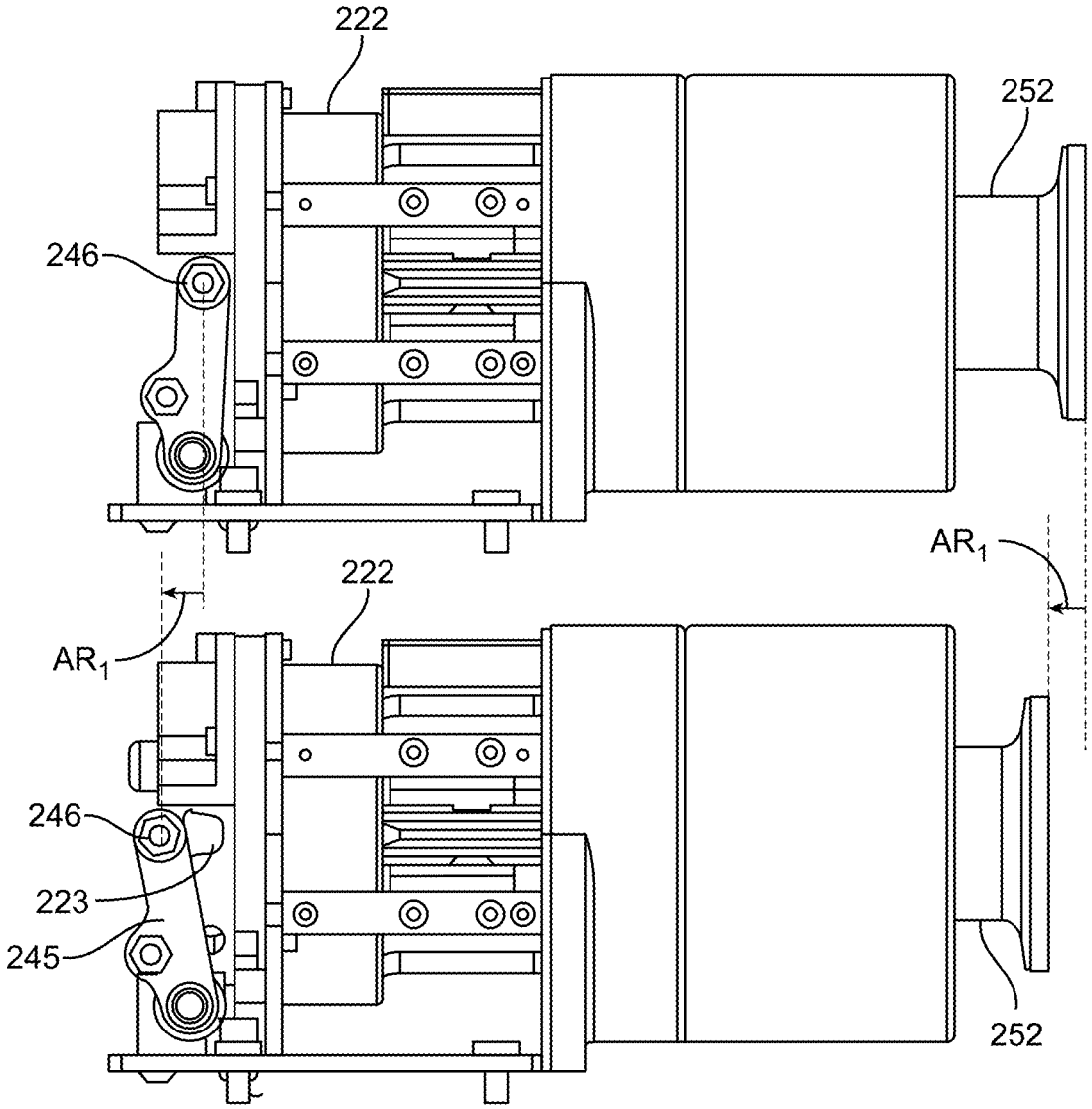
FIGS. 4H and 4I illustrate displacement of locking element of the exercise equipment of FIG. 4A from locking position to unlocking position.
Figure 4I:
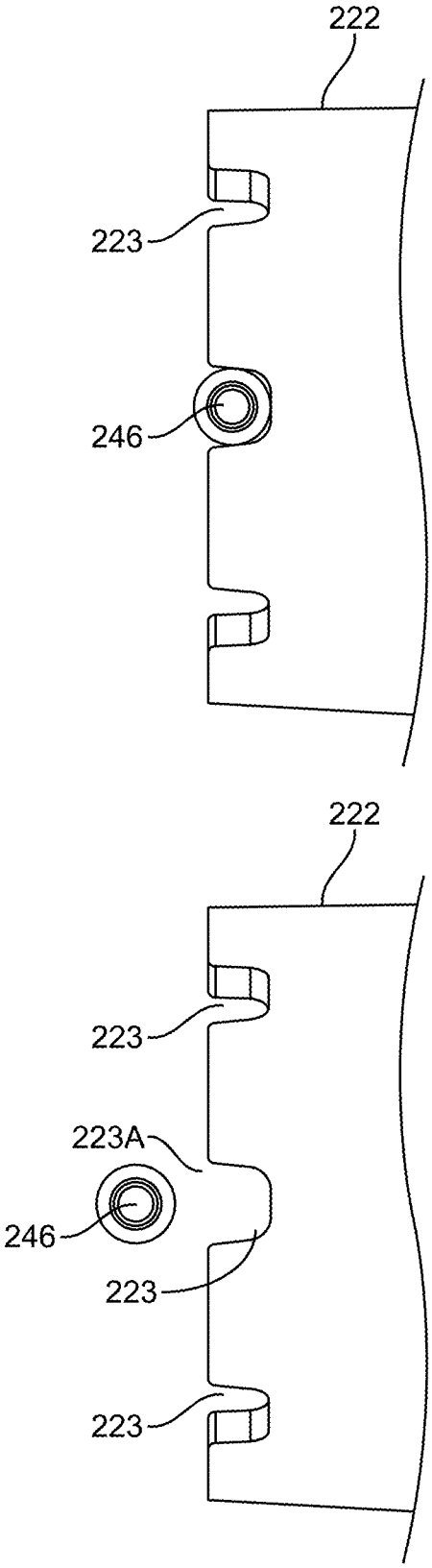
Figure 4J:
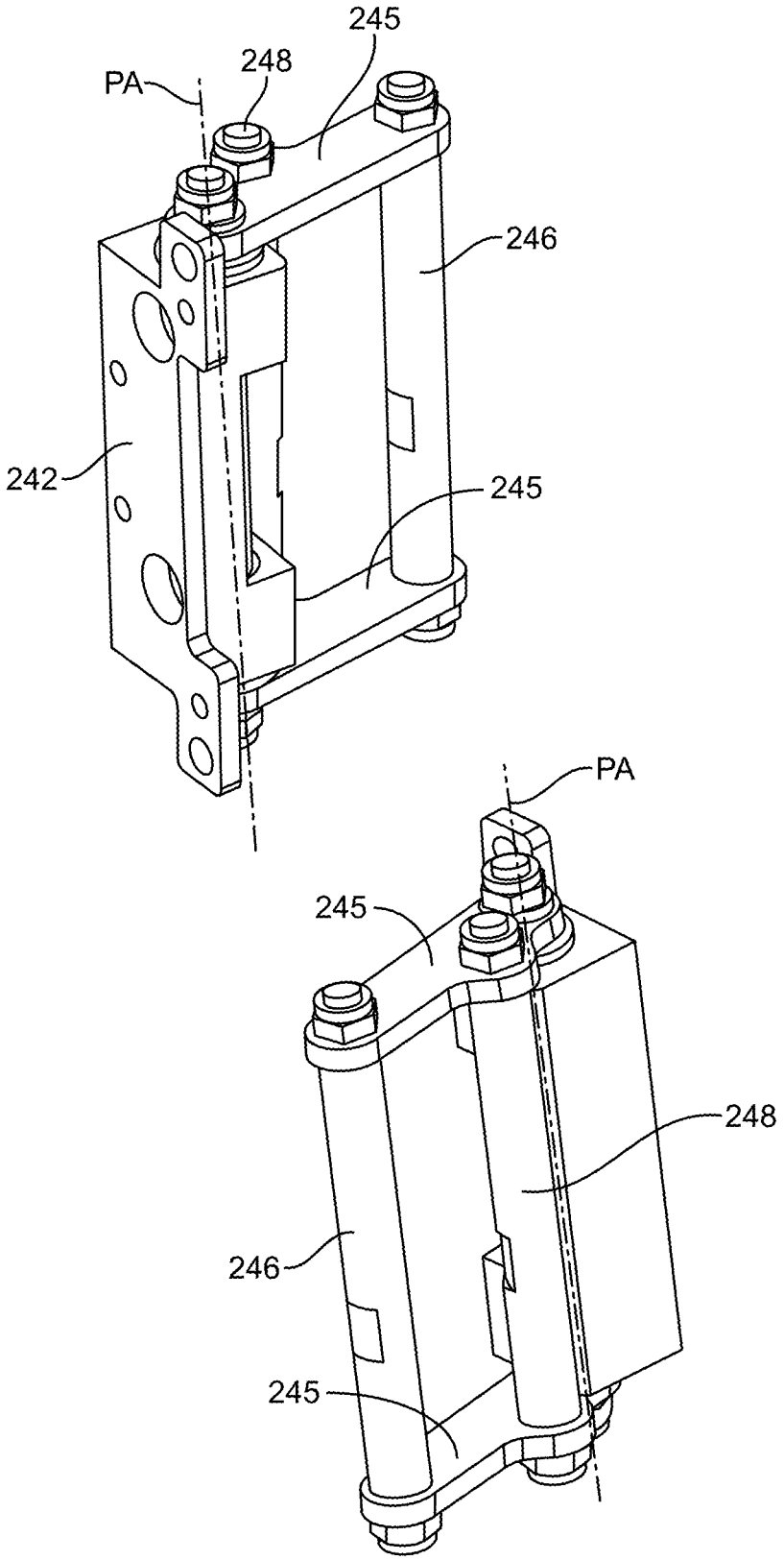
FIG. 4J illustrates a perspective view of a locking mechanism of the exercise equipment of FIG. 4A.

Reference is now made to FIGS. 3A and 3B schematically illustrating a rear perspective view of an exercise equipment 200 according to an example of the presently disclosed subject matter. It is to be understood herein that the exercise equipment 200 can include one or more features of any example of the exercise equipment 100 described above, and the description of such features of the exercise equipment 100 can apply to corresponding features of the exercise equipment 200.

In the illustrated example, the exercise equipment 200 includes a beam 210 having a beam longitudinal axis BLA. It is to be understood herein that the beam 210 can constitute a part of a frame, which can include one or more features of the frame of the exercise equipment described above according to various examples of the presently disclosed subject matter. The beam 210 can constitute a part of a chassis of the exercise equipment. An arm, generally designated as 220, is rotatably coupled to the longitudinal beam 210. It is to be understood herein that the arm 220 can include one or more features of the arm of the exercise equipment described above according to various examples of the presently disclosed subject matter.

The arm 220 comprises a rotatable element 222 selectively rotatable about the arm rotation axis ARA. Rotation of the rotatable element about the arm rotation axis ARA can be selectively locked in different orientations of the arm 220 by a locking mechanism, generally designated as 240, of the exercise equipment. In some examples, as shown, the locking mechanism 240 comprises a locking base 242 fixedly connected to the longitudinal beam 210 and a locking element 244 pivotably coupled to the locking base 242 so as to be pivotable between a locking position (FIG. 3A) and an unlocking position (FIG. 3B) about a pivot axis PA. As can be seen in FIGS. 3A and 3B, the locking element 244, in the locking position, engages the rotatable element 222 and prevents the rotation thereof about the arm rotation axis ARA, and in the unlocking position, can be distant (disengaged) from the rotatable element 222 and allow the rotation thereof about the arm rotation axis ARA.

The exercise equipment 200 further comprises a lock controller 250 operatively associated with the locking mechanism 240 and operable for pivoting the locking element at least from the locking position to the unlocking position.

Although the pivot axis in the example illustrated in FIGS. 3A and 3B has been shown as being horizontal, while the arm rotation axis is also horizontal, and perpendicular to the arm rotation axis, it is to be understood herein that in other examples, the pivot axis can extend in any other direction with respect to the arm rotation axis. In some examples, the pivot axis can extend along a second direction transverse to the first direction, which more particularly can be perpendicular to the first direction. In some examples, the pivot axis can extend in a vertical plane while the arm rotation axis extends in a horizontal plane. In some examples, while the arm rotation axis extends in a horizontal plane, the pivot axis can extend in a plane transverse the horizontal plane.

Also, although the pivot axis in the example illustrated in FIGS. 3A and 3B has been shown as intersecting the arm rotation axis, it is to be understood herein that in other examples, the pivot axis can be spaced apart from the arm rotation axis. In some examples, the pivot axis can be at least partially located at the locking base, which can be spaced from the arm rotation axis.

Reference is now made to FIGS. 4A to 4J illustrating an exercise equipment 200 according to an example of the presently disclosed subject matter. It is to be understood herein that the exercise equipment 200 shown in FIGS. 4A to 4J includes all the features of the exercise equipment 200 described above with reference to FIGS. 3A and 3B, with some additional features, as described herein below. Accordingly, the description of features of the exercise equipment 200 of FIGS. 3A and 3B apply analogously to corresponding features of the exercise equipment 200 of FIGS. 4A to 4J. Same reference numerals have been used for corresponding features of the exercise equipment 200 of FIGS. 3A and 3B, and 4A to 4J.

In the example illustrated in FIGS. 4A to 4J, the longitudinal beam 210 constitutes a part of a frame 202, and the arm 220 is rotatably coupled to the frame 202. The rotatable element 222 is rotatable about the arm rotation axis ARA extending along a first direction D transverse to the beam longitudinal axis BLA.

The arm 220 comprises a shoulder 225 and an elongated arm member 224 extending from the shoulder 225. The arm 220 is coupled to the beam 210 via the shoulder 225. In some examples, the shoulder can be integrally coupled with the elongate arm member, while in some examples, the shoulder can be unitarily formed with the elongate arm member. The shoulder 225 includes a hollow shoulder housing 226 having a shoulder internal volume 227, and the rotatable element 222 is positioned within the shoulder housing 226, for example within the shoulder internal volume 227. In some examples, the rotatable element 222 can be positioned partially within the shoulder housing 226.

In general, a rotatable element can comprise one or more lockable elements, at least one of which can be engaged by the locking element in its locking position. In some examples, the one or more lockable elements can comprise a plurality of lockable elements, and the locking element in the locking position can lockingly engage at least two of the plurality of lockable elements. The lockable elements can have any structure corresponding to the structure of the locking elements such that the lockable elements and the lockable element can constitute engageable mating surfaces according to any one or more of the examples described above. Each lockable element can correspond to a respective position of the rotatable element about the arm rotation axis, and accordingly correspond to orientation or position of the arm with respect to the beam. When the locking element engages a lockable element of the one or more lockable elements, it can lock the rotatable element in a corresponding position about the arm rotation axis, and accordingly can lock the arm in a corresponding orientation or position with respect to the beam.

In some examples, the lockable elements can be formed as recesses, and the locking element in its locking position can be positioned at least partially inside one or more of the recesses thereby lockingly engaging the rotatable element. In some examples, the locking element in its locking position can be positioned at least partially inside at least two of the recesses thereby lockingly engaging the rotatable element.

In some examples, the locking element can include one or more recesses and the lockable elements can be positioned within at least one of the recesses when the locking element is in its locking position. In some examples, the rotatable element can comprise a single lockable element and the locking elements can include a plurality of locking members, each corresponding to a position of the rotatable element about the arm rotation axis. The single lockable element can rotate about the arm rotation axis with respect to the locking element, and can be locked with any one or more of the locking members setting an orientation of the arm.

In general, the locking element can comprise an elongate element, which can extend along the pivot axis and engage the rotatable element in the locking position. In some examples, the elongate element can include a single elongate member, for example in the form of a rod or pin that can lockingly engage the rotatable element at two diametrically opposite points (for example, two diametrically opposite lockable elements, e.g. recesses) with respect to the arm rotation axis. In some examples, the elongate element can include two members, for example in the form of protrusions that can lockingly engage the rotatable element at two diametrically opposite points (for example, two diametrically opposite lockable elements, e.g. recesses) with respect to the arm rotation axis.

In the example illustrated in FIGS. 4A to 4J, the rotatable element 222 comprises recesses 223 positioned about the circumference of a rim 222A of the rotatable element 222.

Each of the recesses 223 is formed as a depression 223 in the rim 222A of the rotatable element 222. Each of the recesses 223 comprise an open end 223A facing in the first direction D for receiving at least partially within the recess 223 the locking element 244. Every pair of diametrically opposite recesses 223 correspond to a position of the rotatable element 222, and thus the arm 220, with respect to the arm rotation axis ARA and the beam 210, in which the rotatable element 222, and thus the arm 220, can be locked.

The locking mechanism 240 comprises the locking base 242 fixedly connected to the beam 210, and the locking element 244 pivotably connected to the locking base 242. The locking element 244 is pivotable about the pivot axis PA extending vertically (when the arm rotation axis ARA extends horizontally) and passing through the locking base 242 which is spaced apart from the arm rotation axis ARA. The locking element 244 comprises two extension members 245 extending from the locking base 242 towards the arm rotation axis ARA, and a locking pin 246 connecting the two extension members 245 and extending perpendicular to the arm rotation axis ARA and parallel to (along) the pivot axis PA. In some examples, the locking pin can be constituted by two discrete members (for example, in the form of protrusions) each extending (or protruding) towards the other from a respective one of the extension members. In the locking position (FIGS. 4F and 4G, and upper portion of FIGS. 4H and 4I), the locking pin 246 is seated within two diametrically opposite recesses 223 thereby locking the rotatable element 222 and preventing its rotation. In the unlocking position (lower portions of FIGS. 4H and 4I), the locking pin 246 is distant from the rotatable element 222 thereby allowing its rotation about the arm rotation axis ARA. The locking mechanism 240 further comprises a locking support member 248 connecting the extension members 245.

In the locking position, the arm is firmly held at the selected orientation due to the fitted engagement of the pin inside the recesses. As a result of the locking base being fixedly connected to the beam, a robust locking structure is thus provided.

In some examples, a lock controller can pivot the locking element at least from the locking position to the unlocking position. It is to be understood herein that a lock controller being operable to pivot the locking element at least from the locking position to the unlocking position is intended to mean that in some examples, the locking mechanism can be pivoted automatically into the locking position, while in some examples, the lock controller can pivot the locking element from the unlocking position to the locking position as well. For instance, in some examples, the locking mechanism can comprise a biasing arrangement operable to bias the locking element towards one of the locking position and the unlocking position.

In the examples in which the biasing arrangement biases the locking element towards the unlocking position, the lock controller can act against the biasing arrangement to hold the locking element in the locking position, whereas the lock controller can be actuated by a user to release the hold thereby triggering the pivoting of the locking element into the unlocking position by the biasing arrangement.

In the examples in which the biasing arrangement biases the locking element towards the locking position, the lock controller can be actuated by a user to pivot the locking element into the unlocking position.

In any of the above examples, the lock controller can be operable to pivot the locking element from the locking position to the unlocking position as well as from the unlocking position to the locking position. In any case, the lock controller is operable to pivot the locking element at least from the locking position to the unlocking position.

In general, a lock controller can be displaceable between an arm orienting position associated with the unlocking position of the locking element and a neutral position associated with the locking position of the locking element. The arm orienting position being associated with the unlocking position is intended to mean that when the lock controller is in its arm orienting position, the locking element is in the unlocking position. In other words, when the lock controller is displaced into its arm orienting position, it causes the pivoting of the locking element into the unlocking position. Similarly, the neutral position being associated with the locking position is intended to mean that when the lock controller is in its neutral position, the locking element is in the locking position. In other words, when the lock controller is displaced into its neutral position, it causes the pivoting of the locking element into the locking position.

The lock controller can at least selectively (i.e., either temporarily upon actuation or permanently) engage the locking element for pivoting the locking element at least from the locking position to the unlocking position. In the examples in which the lock controller selectively engages the locking element, the lock controller engages the locking element in, or during displacement towards, the arm orienting position, and disengages from the locking element in, or during displacement towards, the neutral position. Accordingly, the lock controller during displacement towards the arm orienting position from the neutral position can at least indirectly engage the locking element to pivot the locking element into the unlocking position from the locking position.

In the examples in which the lock controller permanently engages the locking element, the lock controller can be operable to pivot the locking element from the unlocking position to the locking position in addition to pivoting the locking element from the unlocking position to the locking position.

A lock controller can include an actuator operable to be actuated by a user for pivoting the locking element at least from the locking position to the unlocking position. In other words, the actuator can be operable to displace the lock controller at least from the neutral position to the arm orienting position. The actuator can include one or more of a knob, joystick, button, switch, lever, or equivalents thereof.

It is to be understood herein that an actuator being operable to displace the lock controller at least from the neutral position to the arm orienting position is intended to mean that in some examples, the lock controller can be displaced automatically into the neutral position, while in some examples, the lock controller can be displaced from the arm orienting position to the neutral position manually by a user by actuating the actuator. For instance, in some examples, the exercise equipment can comprise a lock controller biasing arrangement operable to bias the lock controller towards the neutral position. In some examples, the biasing arrangement that biases the locking element towards the locking position can serve as the lock controller biasing arrangement as well.

In examples in which the lock controller biasing arrangement biases the lock controller towards the neutral position, the actuator can be actuated by a user to displace the lock controller into the arm orienting position, and the lock controller automatically moves into the neutral position upon release of the actuator by the user.

A lock controller can further include a controlling element operable, upon actuation of the actuator, to pivot the locking element at least from the locking position to the unlocking position. In some examples, the controlling element can indirectly, for example via an intermediate locking element engaging member, engage the locking element to pivot the locking element. In some examples, the locking element engaging member can constitute a part of the controlling element, and thus in such examples, the controlling element can directly engage the locking element to pivot the locking element. In any of the examples, the controlling element can include any mechanical structure extending from the actuator to, at least indirectly, engage the locking element.

In the example illustrated in FIGS. 4A to 4J, the lock controller 250 comprises an actuator 252, which in the illustrated example is a knob 252, and a controlling element 254, which in the illustrated example is a rod 254 that extends through the shoulder 225. In some examples, the controlling element can include any other structure or shape while meeting the requirement of pivoting the locking element upon actuation of the actuator by a user. The controlling element 254 comprises the locking element engaging member 255 which engages the locking pin 246 at a location spaced apart from the pivot axis, to pivot the locking pin 246 into the unlocking position when the actuator 252 is actuated by a user to displace (as indicated by arrow AR1) the lock controller 250 into the arm orienting position (lower portion of FIG. 4H) from the neutral position (upper portion of FIG. 4H).

It is to be understood herein that although in the illustrated example, the lock controller has been shown as displacing from the neutral position to the arm orienting position by a pushing action, in some other examples, the lock controller can be operable to be displaced from the neutral position to the arm orienting position by a pulling action by a user. In some examples, the displacement of the lock controller from the neutral position to the arm orienting position and/or vice versa may include rotational actuation of the actuator in the alternative of or in addition to linear actuation of the actuator.

In the illustrated example, the locking mechanism 240 comprises a biasing arrangement 247, in the form of a spring 247. The spring 247 biases the locking pin 246 into the locking position. When the user pushes the actuator 252, the locking element engaging member 255 pushes the locking pin 246 against the bias of the spring 247, and pivots the locking pin 246 into the unlocking position. When the user releases the pushing force, the spring 247 causes the locking pin 246 as well as the lock controller 250 to displace into the locking position and the neutral position respectively. Accordingly, in the illustrated example, the spring 247 acts as the lock controller biasing arrangement as well. In some examples, the lock controller biasing arrangement can be separate from the biasing arrangement that biases the locking element. Other suitable biasing members may be used in addition or instead of a spring, for example elastic elements such as a band.

When the user intends to set an orientation of the arm with respect to the frame 202, the user pushes the lock controller 250, via the actuator 252, into the arm orienting position of the lock controller 250, thereby pivoting the locking pin 246 into the unlocking position. Then, the user can rotate the arm to adjust the orientation thereof and subsequently can lock the arm in a set orientation by releasing the actuator 252.

Figure 5A:
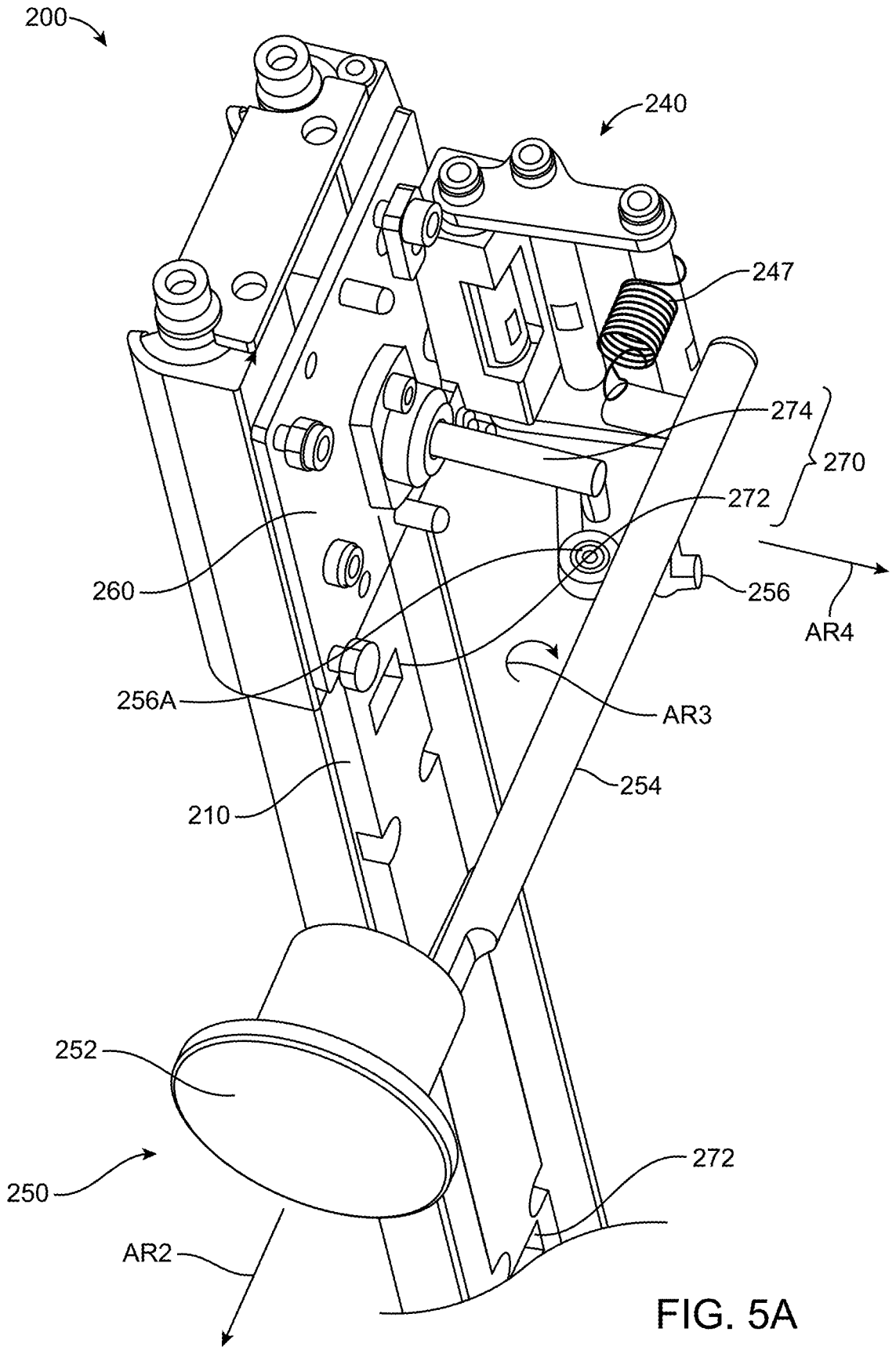
FIG. 5A illustrates a top perspective view of an exercise equipment according to yet another example of the presently disclosed subject matter, with some components removed to show internal structure.
Figure 5B:
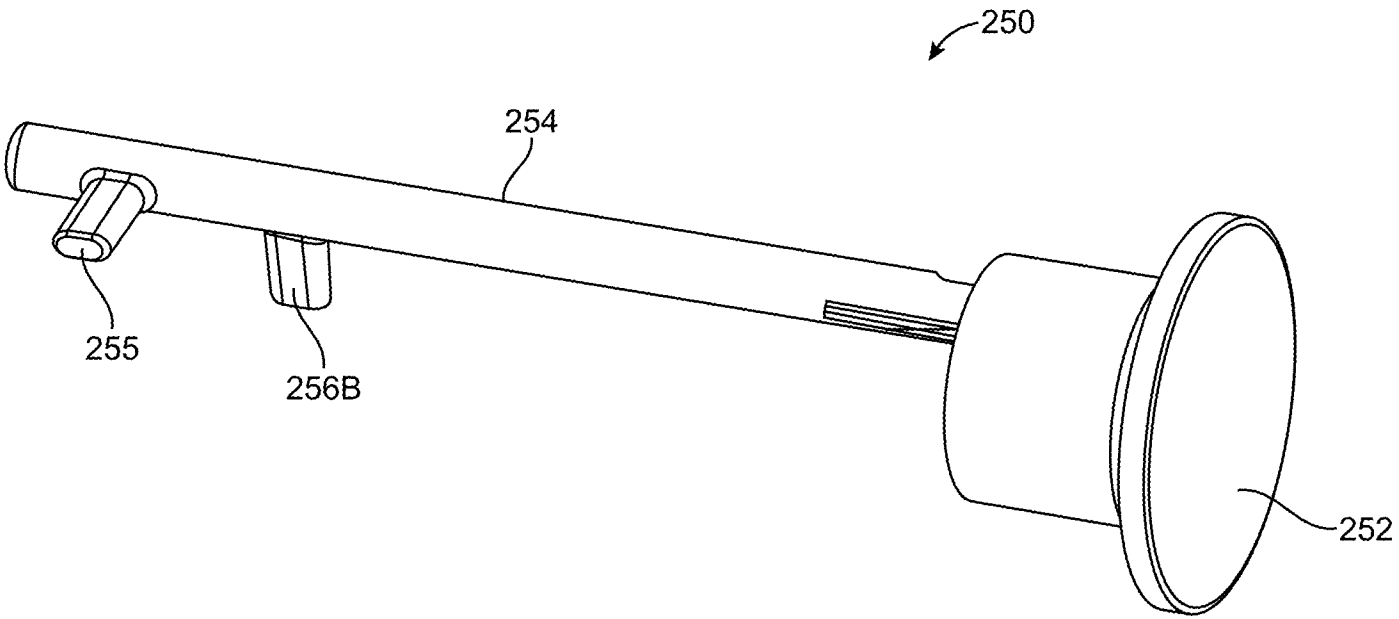
FIG. 5B illustrates a perspective view of a lock controller of the exercise equipment of FIG. 5A.

Reference is now made to FIGS. 5A and 5B illustrating an exercise equipment 200 according to an example of the presently disclosed subject matter. It is to be understood herein that the exercise equipment 200 shown in FIGS. 5A and 5B can include some or all the features of the exercise equipment 200 described above with reference to FIGS. 4A to 4J, with some additional features, as described herein below. Accordingly, the description of features of the exercise equipment 200 of FIGS. 4A to 4J apply analogously to corresponding features of the exercise equipment 200 of FIGS. 5A and 5B. Same reference numerals have been used for corresponding features of the exercise equipment 200 of FIGS. 4A to 4J and 5A and 5B.

In the example illustrated in FIGS. 5A and 5B, the exercise equipment 200 comprises a trolley 260 slidably coupled to the longitudinal beam 210 and operable to move along the beam longitudinal axis BLA. It is to be understood herein that a trolley can be coupled to a longitudinal beam via a moving mechanism facilitating movement or riding of the trolley along the beam. The trolley and the moving mechanism can have corresponding structures suitable for riding or moving along the longitudinal beam and locking the trolley at different positions along the beam. Some examples of such structures of the trolley are described in U.S. provisional patent Ser. No. 63/611,051 filing date Dec. 15, 2023, which is incorporated herein in its entirety. Accordingly, the trolley 260 can have any structure, including those described in U.S. provisional patent Ser. No. 63/611,051, suitable for allowing or facilitating movement of the trolley 260 along the beam 210 and locking the trolley 260 at different positions along the beam 210.

In the illustrated example, the exercise equipment 200 comprises a trolley locking arrangement 270 operable to lock the trolley 260 at different trolley locking positions along the longitudinal beam 210. In general, a trolley locking arrangement can comprise a plurality of trolley locking first elements associated with the longitudinal beam and positioned along the beam longitudinal axis. Each of the trolley locking first elements can correspond to a respective trolley locking position of the different trolley locking positions. The trolley locking arrangement can further comprise a trolley locking second element displaceable between a trolley locking state and a trolley unlocking state. At the trolley locking state, the trolley locking second element can engage one of the trolley locking first elements thereby locking the trolley at a corresponding trolley locking position, and at the trolley unlocking state, the trolley locking second element can be free of engagement with the trolley locking first elements thereby allowing the trolley to be moved along the longitudinal axis.

The trolley locking first elements and the second element can include one or more pairs of engageable mating surfaces, one surface of each pair associated with the trolley locking first elements and other surface of each pair associated with trolley locking second element. It is to be understood herein that the engageable mating surfaces of the trolley locking arrangement can include a structure according to any one or more of the examples described above of the engageable mating surfaces of the locking mechanism described above that can lock the rotation of the rotatable element. Accordingly, the corresponding description of those engageable mating surfaces can apply to the engageable mating surfaces of the trolley locking arrangement as well.

In the example illustrated in FIGS. 5A and 5B, the trolley locking first elements, generally designated as 272, are formed as trolley locking recesses 272 on the longitudinal beam 210. The trolley locking second element, generally designated as 274, is a trolley locking bolt 274, that can be received in any one (at a time) of the trolley locking recesses 272 to lock the movement of the trolley at a trolley locking position corresponding to that trolley locking recess 272. At the trolley locking state, the trolley locking bolt 274 is lockably engaged with, for example by being received at least partially within, any of the trolley locking recesses 272, and at the trolley unlocking state, the trolley locking bolt 274 is not received in any of the trolley locking recesses 272.

The lock controller 250 is operatively associated with the trolley locking arrangement 270 and is operable for displacing the trolley locking second element 274 at least from the trolley locking state to the trolley unlocking state. It is to be understood herein that a lock controller being operable to displace the trolley locking second element at least from the trolley locking state to the trolley unlocking state is intended to mean that in some examples, the trolley locking second element can be displaced automatically into the trolley locking state, while in some examples, the lock controller can displace the trolley locking second element from the trolley unlocking state to the trolley locking state as well. For instance, in some examples, the trolley locking arrangement can comprise a trolley lock biasing mechanism operable to bias the trolley locking second element towards one of the trolley locking state and the trolley unlocking state. The trolley lock biasing mechanism can include a spring, or any other equivalent biasing mechanism.

In the examples in which the trolley lock biasing mechanism biases the trolley locking second element towards the trolley unlocking state, the lock controller can act against the trolley lock biasing mechanism to hold the trolley locking second element in the trolley locking state, whereas the lock controller can be actuated by a user to release the hold thereby triggering the displacement of the trolley locking second element into the trolley unlocking state by the trolley lock biasing mechanism.

In the examples in which the trolley lock biasing mechanism biases the trolley locking second element towards the trolley locking state, the lock controller can be actuated by a user to displace the trolley locking second element into the trolley unlocking state.

In any of the above examples, the lock controller is operable to displace the trolley locking second element at least from the trolley locking state to the trolley unlocking state.

In general, a lock controller can be displaceable between a trolley releasing position associated with the trolley unlocking state of the trolley locking second element and the neutral position being associated with the trolley locking state, together with the locking position of the locking element that locks the rotation of the rotatable element. The trolley releasing position being associated with the trolley unlocking state is intended to mean that when the lock controller is in its trolley releasing position, the trolley locking second element is in the trolley unlocking state. In other words, when the lock controller is displaced into its trolley releasing position, it causes the displacement of the trolley locking second element into the trolley unlocking state. Similarly, the neutral position being associated with the trolley locking state is intended to mean that when the lock controller is in its neutral position, the trolley locking second element is in the trolley locking state. In other words, when the lock controller is displaced into its neutral position, it causes the pivoting of the trolley locking second element into the trolley locking state.

The lock controller can at least selectively (i.e., either temporarily upon actuation or permanently) engage the trolley locking second element for displacing the trolley locking second element at least from the trolley locking state to the trolley unlocking state. In the examples in which the lock controller selectively engages the trolley locking second element, the lock controller engages the trolley locking second element in, or during displacement towards, the trolley releasing position, and disengages from the trolley locking second element in, or during displacement towards, the neutral position. Accordingly, the lock controller during displacement towards the trolley releasing position from the neutral position can at least indirectly engage the trolley locking second element to displace the trolley locking second element into the trolley unlocking state from the trolley locking state.

In general, an actuator can be operable to be actuated by a user to displace the lock controller at least from the neutral position to the trolley releasing position. In some examples, the same actuator can be operable to be actuated to displace the lock controller at least from the neutral position to the trolley releasing position and at least from the neutral position to the arm orienting position, and all the description provide above with respect to structure of the actuator can apply here as well.

It is to be understood herein that an actuator being operable to displace the lock controller at least from the neutral position to the trolley releasing position is intended to mean that in some examples, the lock controller can be displaced automatically into the neutral position, while in some examples, the lock controller can be displaced from the trolley releasing position to the neutral position manually by a user by actuating the actuator. For instance, in some examples, the lock controller biasing arrangement can be operable to bias the lock controller towards the neutral position from trolley releasing position as well as from the arm orienting position.

In the examples in which the lock controller biasing arrangement biases the lock controller towards the neutral position, the actuator can be actuated by a user to displace the lock controller into the trolley releasing position, and the lock controller automatically displaces into the neutral position upon release of the actuator by the user.

In some examples, the controlling element of the lock controller can be operable, upon actuation of the actuator, to displace the trolley locking second element at least from the trolley locking state to the trolley unlocking state. In some examples, the controlling element can indirectly, for example via an intermediate trolley locking second element engaging member, engage the trolley locking second element to displace the trolley locking second element. In some examples, the trolley locking second element engaging member can constitute a part of the controlling element, and thus in such examples, the controlling element can directly engage the trolley locking second element to displace the trolley locking second element.

In general, the arm orienting position and the trolley releasing position can be located at opposite sides of the neutral position, and the lock operator can be operable to be displaced from the neutral position to the arm orienting position by one of a pushing and pulling action on the lock operator, and to be displaced from the neutral position to the trolley releasing position by other one of a pushing and pulling action on the lock operator. In some examples, the arm orienting position and the trolley releasing position can be located at same side of the neutral position. In such examples, the lock controller can be displaced from the neutral position to one of the arm orienting position and the trolley releasing position by moving the lock controller to a first extent in a direction, and can be displaced from the neutral position to other one of the arm orienting position and the trolley releasing position by moving the lock controller to a second extent in the same direction.

In the example illustrated in FIGS. 5A and 5B, the controlling element 254 comprises the trolley locking second element engaging member 256 which engages the trolley locking second element 274, to displace the trolley locking second element 274 into the trolley unlocking state when the actuator 252 is actuated by a user to displace the lock controller 250 into the trolley releasing position from the neutral position (as indicated by arrow AR2 in FIG. 5A). The trolley locking second element engaging member 256 is pivotably fixed at pivot point 256A, and is pivotable about a vertical pivot axis at the pivot point 256A, when engaged by a protrusion 256B formed on the controlling element 254. It is clear from FIG. 5A that moving the controlling element 254 in the direction of arrow AR2 would pivot the trolley locking second element engaging member 256 clockwise (as indicated by arrow AR3) (as seen from top) about the vertical pivot axis at the pivot point 256A thereby moving the trolley locking second element 274 in the direction of arrow AR4, thereby displacing the trolley locking second element 274 into the trolley unlocking state.

It is to be understood herein that although in the illustrated example, the lock controller has been shown as displacing from the neutral position to the trolley releasing position by a pulling action, in some other examples, the lock controller can be operable to be displaced from the neutral position to the trolley releasing position by a pushing action by a user. In some examples, the displacement of the lock controller from the neutral position to the trolley releasing position and/or vice versa may include rotational actuation of the actuator in the alternative of or in addition to linear actuation of the actuator.

In the illustrated example, the spring 247 serves as the lock controller biasing arrangement 247 that is operable to bias the lock controller 250 towards the neutral position from the arm orienting position as well as the trolley releasing position. When the user pulls the actuator 252, the trolley locking second element engaging member 256 causes the trolley locking second element 274 to displace into the trolley locking state. When the user releases the pulling force, the spring 247 causes the trolley locking second element engaging member 256 as well as the lock controller 250 to displace into the trolling unlocking state and the neutral position respectively.

The arm 220 is coupled to the longitudinal beam 210 at least via the trolley 260. For instance, the shoulder 225 is coupled to the longitudinal beam 210 via the trolley 260. When the user intends to set a position of the arm along the frame 202, the user pulls the lock controller 250, via the actuator 252, into the trolley releasing position of the lock controller 250, thereby displacing the trolley locking second element 274 into the trolley unlocking state. Then, the user can slide the trolley 260 and thus the arm 220 to adjust the position thereof along the frame 202, and subsequently can lock the trolley 260 and thus the arm 220 in a set position by releasing the actuator 252.

Figure 5C:
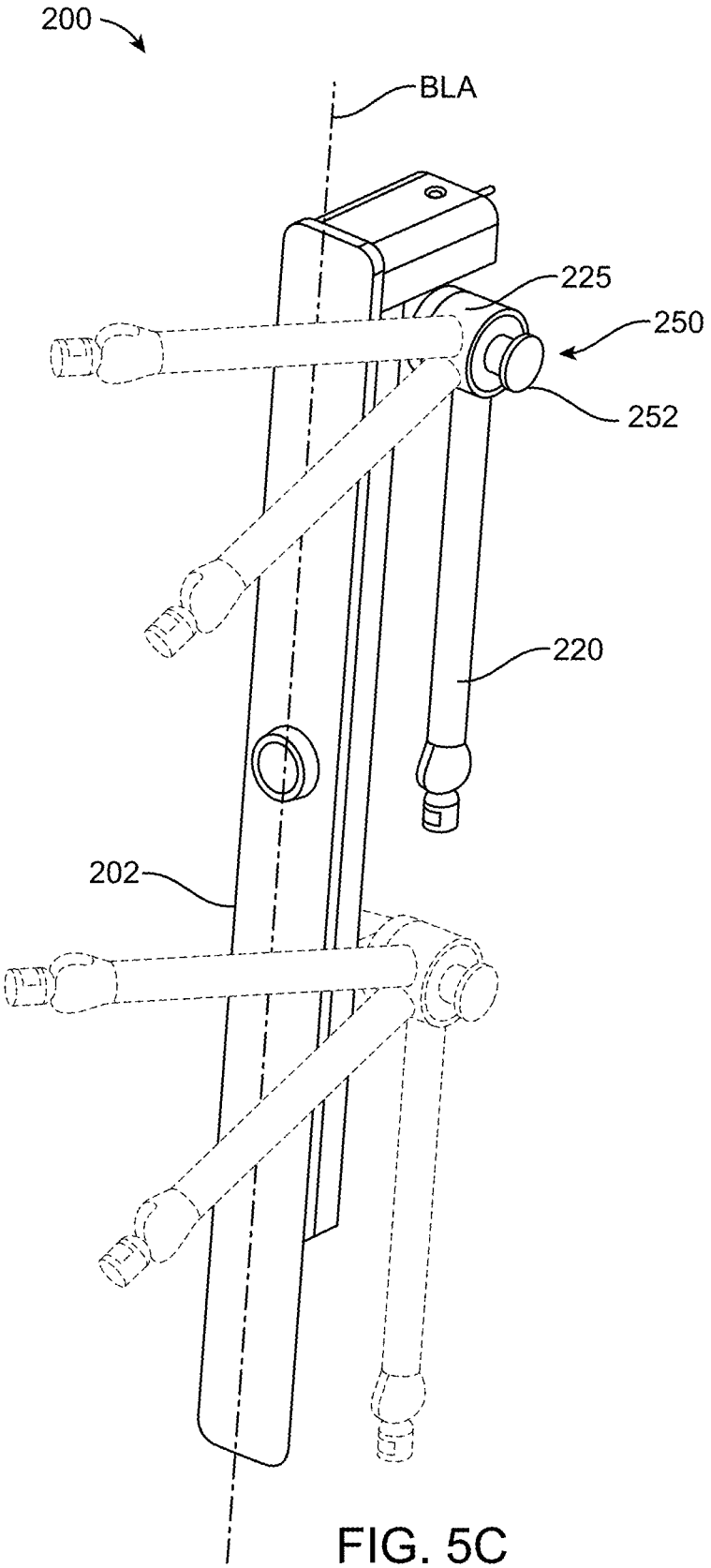
FIG. 5C illustrates a side perspective view of an exercise equipment according to yet another example of the presently disclosed subject matter, depicting different orientations and positions of an arm with respect to a longitudinal beam of the exercise equipment.

In examples as described, control over the trolley locking and unlocking states and control over arm orientation locking and unlocking are achieved via the same lock controller, such that by simple operation of the lock controller actuator (e.g. knob) by the user, both the arm and trolley structures are simultaneously and associatively controlled. In examples of such structure, a user can push the knob (in the direction of the elongated beam) to adjust the arm orientation (angular position of the arm) and pull the knob in the opposite direction (away from the elongated beam) to adjust the trolley position (height) along the frame. FIG. 5C schematically illustrates three possible orientations of the arm with respect to the beam and two possible positions of the arm along the beam. It is to be understood herein that the orientations and positions of the arm shown in FIG. 5C are exemplary, and there can be other orientations and/or positions in which the arm can be locked or set.

In some examples, the exercise equipment is configured to detect and/or verify the arm orientational position (e.g. the arm angle with respect to a long axis of the elongated beam), for example with the aid of one or more sensors. Optionally, a controller of the system receives the indication of arm position from the one or more sensors and verifies that the position is suitable for carrying out a selected exercise. For example, for a certain exercise (selected, for example, by a user via the cellphone app), the controller verifies that the arm had been adjusted to an angular orientation of, for example, 0 degrees, 45 degrees, 90 degrees, or other angle. One or more sensors for detection of an arm position and/or orientation (e.g. an angle of the arm relative, for example, to a long axis of the beam) may include one or more sensors mounted on the beam, or any other location, and can include at least one of: micro-switch, magnetic sensor (hall sensor), electrical contact sensor, angle sensor (potentiometer or encoder), or equivalents thereof. The sensors may be static (e.g. fixed to the beam) or instead movable with the arm.

Referring now to add-on accessories to be connected to and used with an exercise equipment, for example, for enhancing the use of the exercise equipment. An exercise equipment, with which the add-on accessories described herein can be used, can include any exercise equipment described herein above according to various examples or an exercise equipment including one or more features of the exercise machines described in U.S. provisional patent Ser. No. 63/611,051 filing date Dec. 15, 2023, which is incorporated herein in its entirety. In general, an exercise equipment can comprise an equipment cable (interchangeably referred to herein as cable), which can be engaged (at least indirectly) by a user for performing one or more exercise routines, for example, by pulling the equipment cable, and a resistance source for applying resistance to the equipment cable. In some examples, the resistance source can include an electronically adjustable weight resistance motor that can apply adjustable resistance to the cable.

In general, the cable can be manipulated by a user for performing a number of exercises (or exercise routines) in different manners and from different positions. The cable can be at least selectively connected to the add-on accessories described herein to increase the number and/or type of available exercises that can be performed using an exercise equipment. In some examples, the add-on accessories or parts thereof are configured for modifying (e.g. increasing, decreasing) the resistance applied onto the cable by the resistance source. An example of such an add-on accessory includes a platform as described herein below.

In general, a platform can comprise a platform base, which can be a support structure to support components of the platform. In some examples, the platform base can constitute a housing defining an inner volume and one or more components of the platform can be positioned at least partially within the inner volume of the housing. In some examples, the platform base can have a flat bottom surface for placing the platform on a flat surface, for example, during use. The flat surface can be a floor, ground, mat, or any other surface on which the platform can be placed. In use, a user may stand, sit, lie down or otherwise be positioned on or aside the platform for performing an exercise routine. In some examples, the platform base can have a top surface for supporting a weight of a user thereupon.

In some examples, the platform can be formed as a frame or infrastructure (e.g. of a plurality of beams connected to each other), with components for example as described below being operably connected to the frame.

Generally, at least one quick-release interface can be at least indirectly connected to the platform base, for example configured at least partially within the housing (if the platform includes the housing), providing for operable connection of an equipment cable thereto. An equipment cable of an exercise equipment can be connected, at least indirectly, to the quick-release interface thereby operably connecting the equipment cable, and thus the exercise equipment, to the quick-release interface and thus to the platform. Accordingly, the quick-release interface, and thus the platform, can co-operate with the equipment cable, and thus the exercise equipment, such that operating the quick-release interface can operate the equipment cable, for example as detailed below.

As referred to herein, "quick-release" may refer to rapid and simple connection and removal of the equipment cable to and from the platform, and more specifically, to and from the quick-release interface of the platform. The attachment can be carried out manually (e.g. by user), without requiring the use of tools.

Generally, at least one platform cable, separate or distinct from the equipment cable and thus also referred to herein as add-on cable, can be operatively associated with a quick-release interface, for example such that operating the platform cable affects the quick-release interface, thereby affecting the equipment cable, if and when the equipment cable is connected to the platform via the quick-release interface. In some examples, operating the platform cable can include engaging the platform cable at least indirectly and manipulating it, for example, pulling the platform cable. The quick-release interface can be operable to transfer a resistance applied to the equipment cable by the resistance source (of or associated with the exercise equipment) to the platform cable when the equipment cable is connected to the at least one quick-release interface. For instance, once the equipment cable is connected to the quick-release interface, the resistance applied to the equipment cable is transferred to the quick-release interface and thus to the platform cable (which is connected to the quick-release interface as well). Accordingly, when a user manipulates (for example, pulls) the platform cable, the user experiences (and thus acts against) the resistance applied to the equipment cable. In some examples, the resistance transferred to the platform cable can be of a similar magnitude as the resistance applied on the equipment cable by the resistance source. In other examples, the resistance transferred to the platform cable can be different from (greater or lower than) the resistance applied on the equipment cable by the resistance source. This difference in resistance can be generated by arrangement and/or structure of the quick-release interface or other components of the platform, and accordingly the platform can act as a resistance multiplier, as described herein further below.

In general, the quick-release interface can include any structure operable for acting as an interface between the equipment cable and the platform for transferring the resistance and/or force applied to one of the equipment cable and the platform cable to the other of the equipment cable and the platform cable. Such a structure can include one or more rotatable members, sliding members, or combinations thereof that allow co-operation of the equipment cable and the platform cable. In some examples, the quick-release interface can include one or more spools, pulleys, sheaves, wheels, or combinations thereof. In some examples, a resistance source can apply continuous resistance onto the equipment cable, which is transferred to the platform cable and maintains the platform cable continuously tensioned, when the equipment cable is attached to the quick-release interface.

A platform can include at least one user interface position configured as part of the base and operable for providing to a user access to at least indirectly engage and manipulate the at least one platform cable. The user interface position can be any location on the platform which a user can access, for example directly (e.g. by hands) or indirectly via user interface element, and manipulate the platform cable for performing a exercise routine. In the examples in which the platform base comprises a housing, a user interface position can be formed as an opening in the housing allowing the user to access the platform cable (at least indirectly) and manipulate it.

In some examples, the platform can include a cable transfer mechanism facilitating the transfer and movement of the cable at least partially along the platform. For instance, when a user manipulates the platform cable, the platform cable transfers and moves via the cable transfer mechanism. In general, a cable transfer mechanism can include any structure that allows, for example, smooth travel of the cable therethrough. Such a structure can include a rotatable member that by rotation can allow travel of the cable, a sliding member that allows sliding of the cable therealong, or any equivalent structure. In some examples, the cable transfer mechanism can be a part of the quick-release interface. In some examples, the cable transfer mechanism can include one or more spools, pulleys, sheaves, wheels, or combinations thereof. The cable transfer mechanism can be at least partially positioned within the inner volume of the housing in the examples in which the platform includes a housing.

Figure 6A:
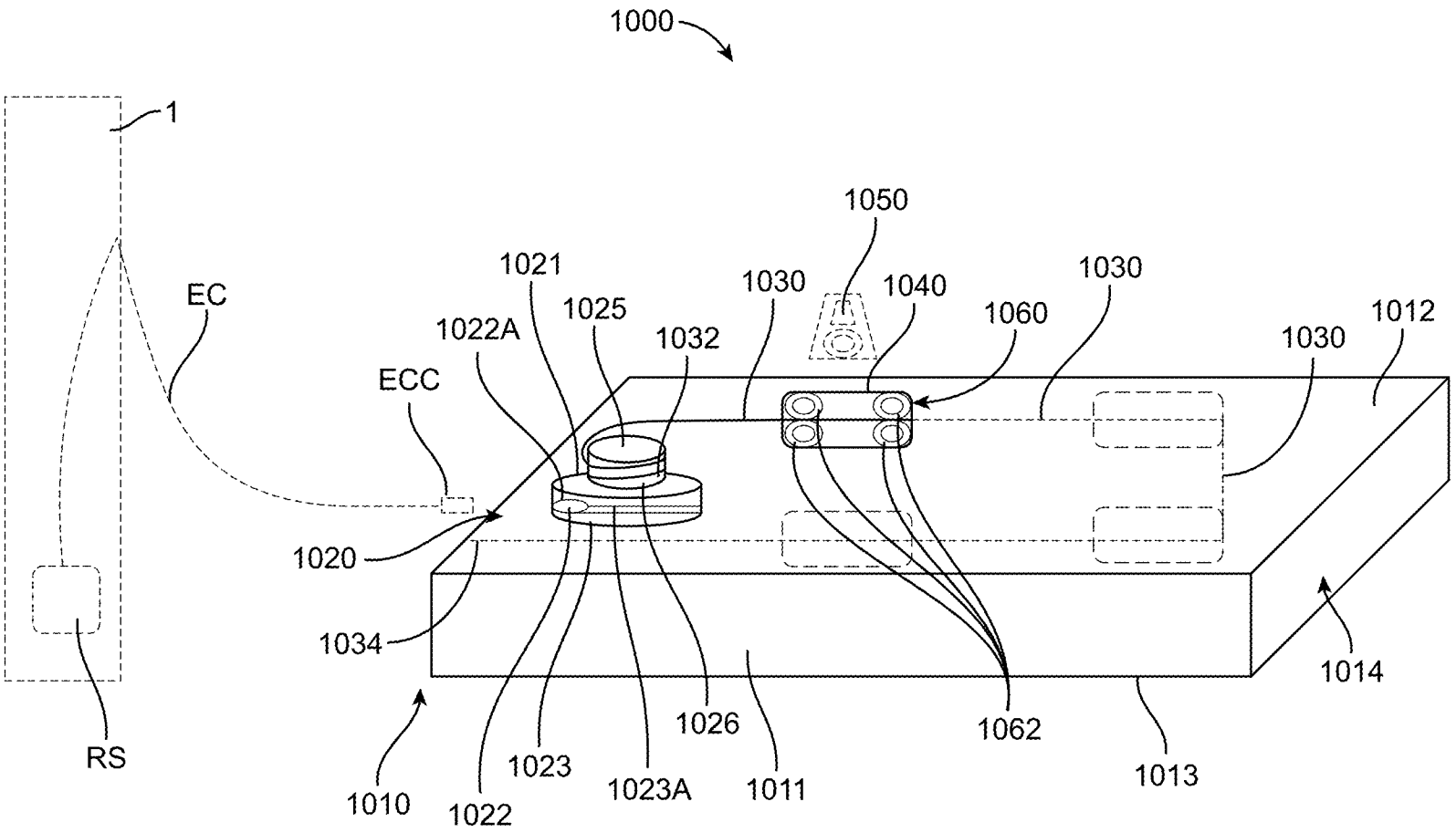
FIG. 6A schematically illustrates a side perspective view of a platform for use with an exercise equipment according to an example of the presently disclosed subject matter.
Figure 6B:
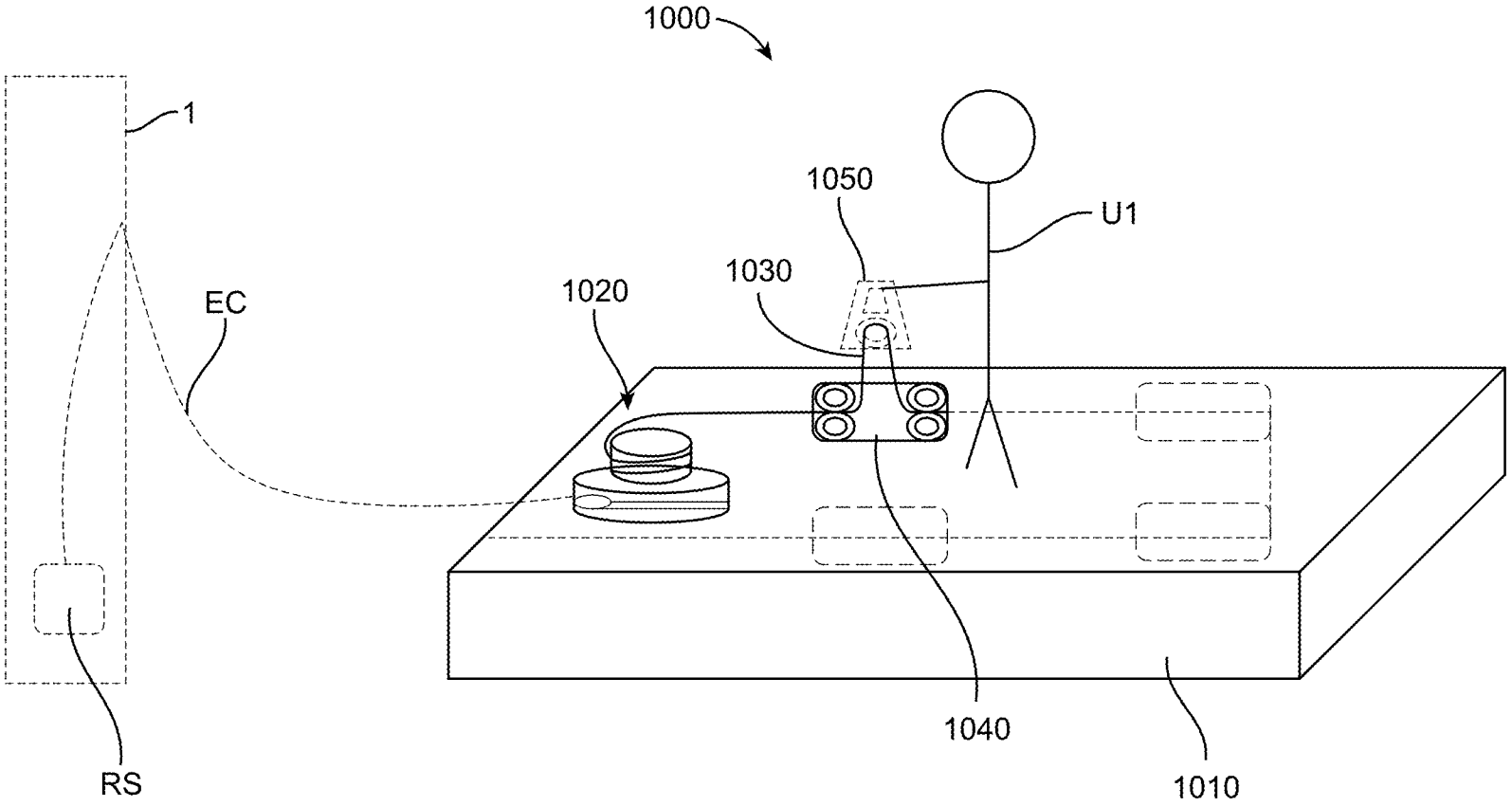
FIG. 6B schematically illustrates the platform of FIG. 6A in use by a user.

Reference is now made to FIGS. 6A and 6B schematically illustrating a platform 1000 for use with an exercise equipment 1 according to an example of the presently disclosed subject matter. It is to be understood herein that the exercise equipment 1 schematically shown in FIGS. 6A and 6B (as well as in FIGS. 7 to 10) can include some or all the features of any of the exercise equipment described herein above. Accordingly, the description of features of the exercise equipment described above can apply analogously to the exercise equipment 1. The exercise equipment 1 includes an equipment cable EC and a resistance source RS that applies resistance to the equipment cable EC, such that when a user pulls the equipment cable EC away from the resistance source RS, the user experiences the resistance.

The platform 1000 comprises a platform base 1010 having a housing 1011 with a top surface 1012, a flat bottom surface 1013, and side walls, defining an inner volume 1014 therebetween. In the illustrated example, the quick-release interface, generally designated as 1020, is a spool assembly 1020. The spool assembly 1020 has been schematically shown in FIGS. 6A, 6B, and 7 to 10, and one example thereof has been shown in FIGS. 12A to 12C. The description below of the spool assembly applies to all the illustrated examples. The quick-release interface 1020 (shown in more detail in FIGS. 12A to 12C) or the spool assembly 1020 comprises a first rotatable element 1021 rotatable about a first element rotation axis FRA, and including a quick-release connection member 1022 operable for at least indirectly connecting to the equipment cable, for example, EC, and a first element surface 1023 for winding of the equipment cable thereon. In some examples, as illustrated, the equipment cable EC has a connector (equipment cable connector) ECC for connecting to the quick-release connection member 1022. In some examples, connector ECC is configured to connect directly to an exercise accessory (e.g. a handle, a hoop, a rope, a bar, etc.), for example, as shown in FIG. 13, used solely with the exercise equipment, when the platform is not in use. The same connector ECC can then be used with the platform, for example by pulling on it from the exercise equipment (e.g. from the wrist portion of the arm of the exercise equipment) and connecting it to the quick-release interface of the platform.

In other examples, the equipment cable EC can be directly, or by any other connection means, connected to the quick release interface 1020. The direct connection can be, for example, by tying an end of the equipment cable to the quick-release connection member 1022. Some examples of the other means include connection by threading, via a bead element, or other element suitable to prevent the end of the equipment cable from detaching from a quick-release interface.

In the illustrated examples, the quick-release connection member 1022 is operable for removably attaching thereto the connector ECC associated with the equipment cable EC. It is to be understood herein that the quick-release connection member 1022 can include any structure suitable for attachment of the connector ECC, for example depending on the structure of the connector ECC. In some examples, the connector ECC can include a recess and the quick-release connection member 1022 can include a protrusion for being at least partially inserted into the recess, thereby being removably and lockingly connected thereto. In some examples, the quick-release connection member 1022 can include a recess and the connector ECC can include a protrusion for being at least partially inserted into the recess, thereby being removably and lockingly connected thereto. In an example, the protrusion is formed as a cylindrical stub which is respectively received within a cylindrical recess formed in the housing of the quick-release interface.

In some examples, the quick-release connection member 1022 can constitute a part of a snap-fit or snug-fit connection arrangement, and the connector ECC can constitute another part of the snap-fit or snug-fit connection arrangement, both parts being removably attachable to each other. In some examples, connector ECC is configured to lockingly engage the quick-release connection member via a "click-type" interface. Other examples of attachments between connector ECC and the quick-release connection member may include: magnetically attracted elements; a twist-lock mechanism (in which the connector is rotated to be secured in or with the quick-release connection member; a latch mechanism; a threaded attachment (e.g. a screw-type connection); a friction-fit attachment, for example enhanced by textured or rubberized surfaces; a pin and slot mechanism, in which the pin is slidable into a slot; bayonet fitting, involving axial insertion and twisting; a spring-loaded lock mechanism; a clamp or clip; or other attachments which enable a durable and reliable attachment between the equipment cable and the platform (via the quick-release interface).

In the illustrated example, the quick-release connection member 1022 comprises a recess 1022A and the connector ECC constitutes a protrusion that can be at least partially received within the recess 1022A to constitute a snap-fit connection arrangement. The snap-fit connection arrangement is constituted by buttons ECC-1 (see FIG. 12B) formed on the connector ECC and the opposite slots 1022A-1 (only one seen in FIGS. 12A and 12B) formed in the recess 1022A. The buttons ECC-1 are biased outwardly and when are aligned with the slots 1022A-1, enter at least partially into the slots 1022A-1, thereby connecting the connector ECC to the quick-release connection member 1022. The buttons ECC-1 can be pressed through slots 1022A-1 for quick-release of the connector ECC from the quick-release connection member 1022. It is to be understood herein that the quick connection and quick release of the connector ECC to the quick-release connection member 1022 can be performed by any other equivalent structure for quick connection and quick-release.

Once the equipment cable EC is connected to the quick-release interface 1020, for example as described above, rotation of the first rotatable element 1021 of the quick-release interface in one direction causes the equipment cable to be wound onto the first element surface 1023, and in the opposite direction causes the equipment cable EC to be unwound from the first element surface 1023. In the illustrated example, the first element surface 1023 comprises a channel 1023A for at least partially receiving therein the equipment cable EC when the equipment cable EC is wound on the first element surface 1023. In some examples, the channel 1023A can be spiral channel such that no part of the equipment cable EC overlaps another part of the equipment cable EC when the when the equipment cable EC is wound on the first element surface 1023. The winding of the equipment cable EC1 on the first element surface 1023 causes the equipment cable EC1 to be pulled from the exercise equipment 1.

The quick-release interface 1020 or the spool assembly 1020 further comprises a second rotatable element 1025 rotatable about a second element rotation axis SRA, and operatively connected to the first rotatable element 1021 for rotating together therewith. The second rotatable element 1025 comprises a second element surface 1026 for winding thereon a platform cable (also referred to herein as an add-on cable) different from the equipment cable, for example, the platform cable 1030. The platform cable 1030 comprises a first platform cable end 1032 (also referred to herein as first add-on cable end 1032) and a free platform cable end 1034 (also referred to herein as free add-on cable end 1034). The first platform cable end 1032 is connected to the second rotatable element 1025. It is to be understood herein that the first platform cable end 1032 can be connected to the second rotatable element 1025, directly or indirectly, for example by any connection arrangement described herein above with respect to connection of an end of a cable to a spool or any other anchor, and accordingly the second rotatable element 1025 can include the connection arrangement suitable for such connection of the first platform cable end 1032.

Once the platform cable 1030 is connected to the second rotatable element 1025 of the quick-release interface 1020, for example as described above, rotation of the second rotatable element 1025 in one direction causes the platform cable 1030 to be wound onto the second element surface 1026, and rotation of the second rotatable element 1025 in opposite direction causes the platform cable 1030 to be unwound from the second element surface 1026.

In general, the platform cable 1030 is wound on the second element surface 1026, and once a user engages and manipulates the platform cable 1030, for example by pulling the platform cable 1030 by a force counteracting the resistance applied by the resistance source (onto the equipment cable and thereby, via the quick-release interface, onto the platform cable), the platform cable 1030 is unwound from the second element surface 1026. The pulling and unwinding of the platform cable 1030 causes the second rotatable element 1025 of the quick-release interface 1020 to rotate. Since rotatable element 1025 is operatively connected to the first rotatable element 1021, the first rotatable element 1021 is caused to rotate. Rotation of the first rotatable element 1021 causes the equipment cable EC (when the equipment cable EC is connected to the quick-release interface 1020) to be wrapped onto the first element surface 1023, thereby pulling the equipment cable EC from the exercise equipment 1. Accordingly, the quick-release interface 1020 transfers the resistance applied onto the equipment cable EC by the resistance source RS to the platform cable 1030, such that when a user pulls, or in any other way manipulates, the platform cable 1030, the user experiences the resistance applied by the resistance source RS. Once the user releases the force applied onto the platform cable 1030, the platform cable is wound onto the second element surface 1026 by virtue of the resistance applied onto the equipment cable EC and transferred to the platform cable 1026. During winding of the platform cable 1030 onto the second element surface 1026, the equipment cable unwinds from the first element surface 1023 and is pulled towards the exercise equipment by virtue of the resistance applied by the resistance source.

In some examples, a quick release interface can include a biasing mechanism to bias the second rotatable element towards a winding direction of the platform cable thereon, so that when the platform is not in use, the platform cable remains wound on the second element surface.

Figure 12A:
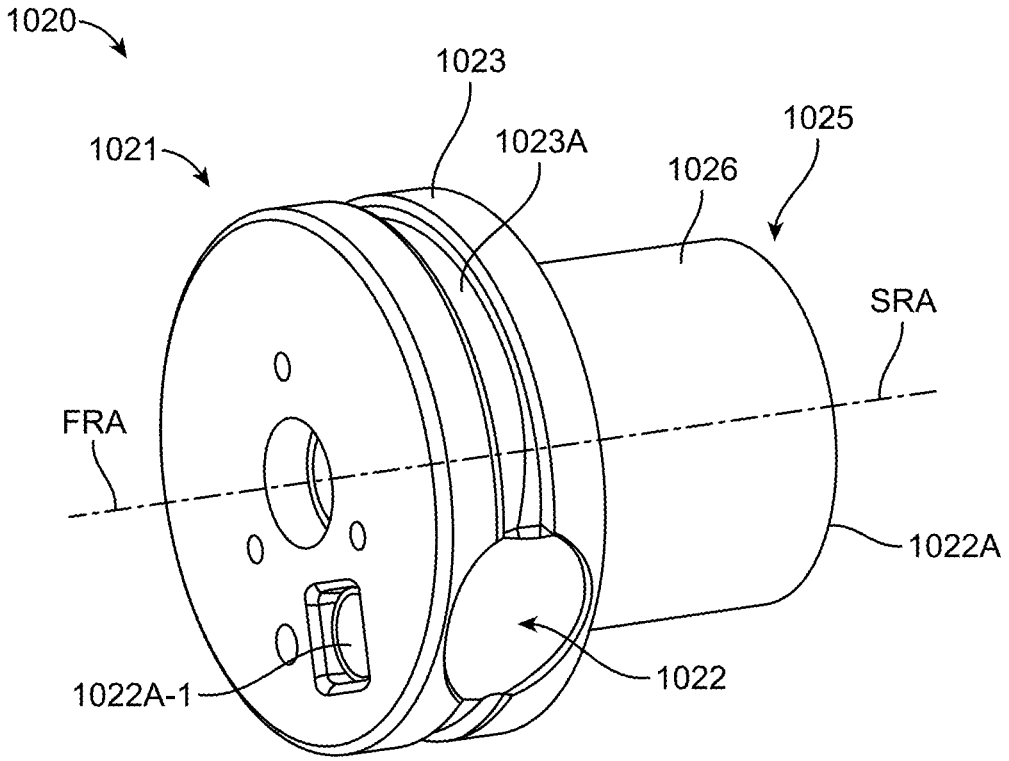
FIG. 12A illustrates side perspective view of a spool assembly for use with an exercise equipment according to an example of the presently disclosed subject matter.
Figure 12B:
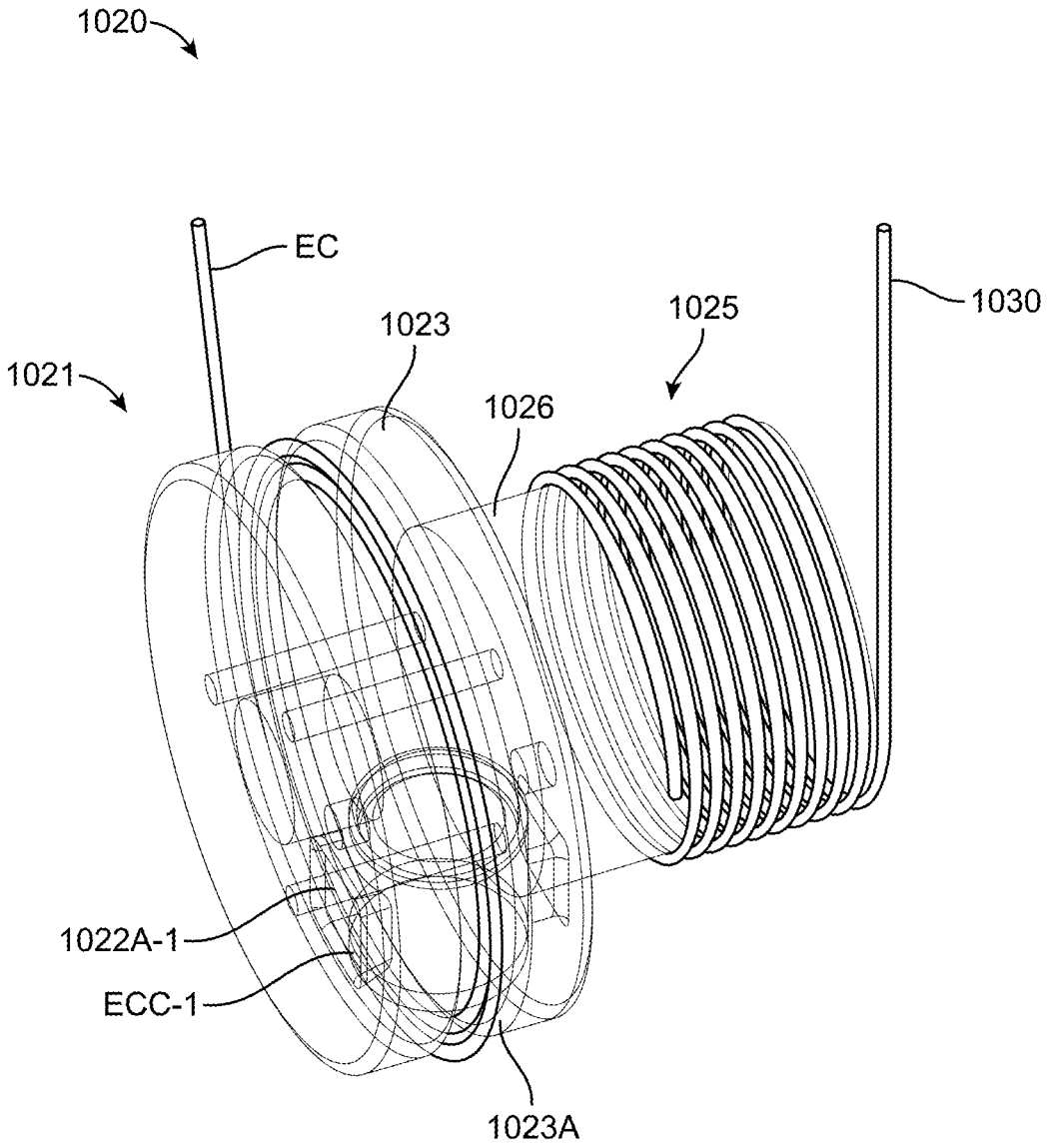
FIG. 12B illustrates another side perspective view of the spool assembly of FIG. 12A with an equipment cable and an add-on cable.
Figure 12C:
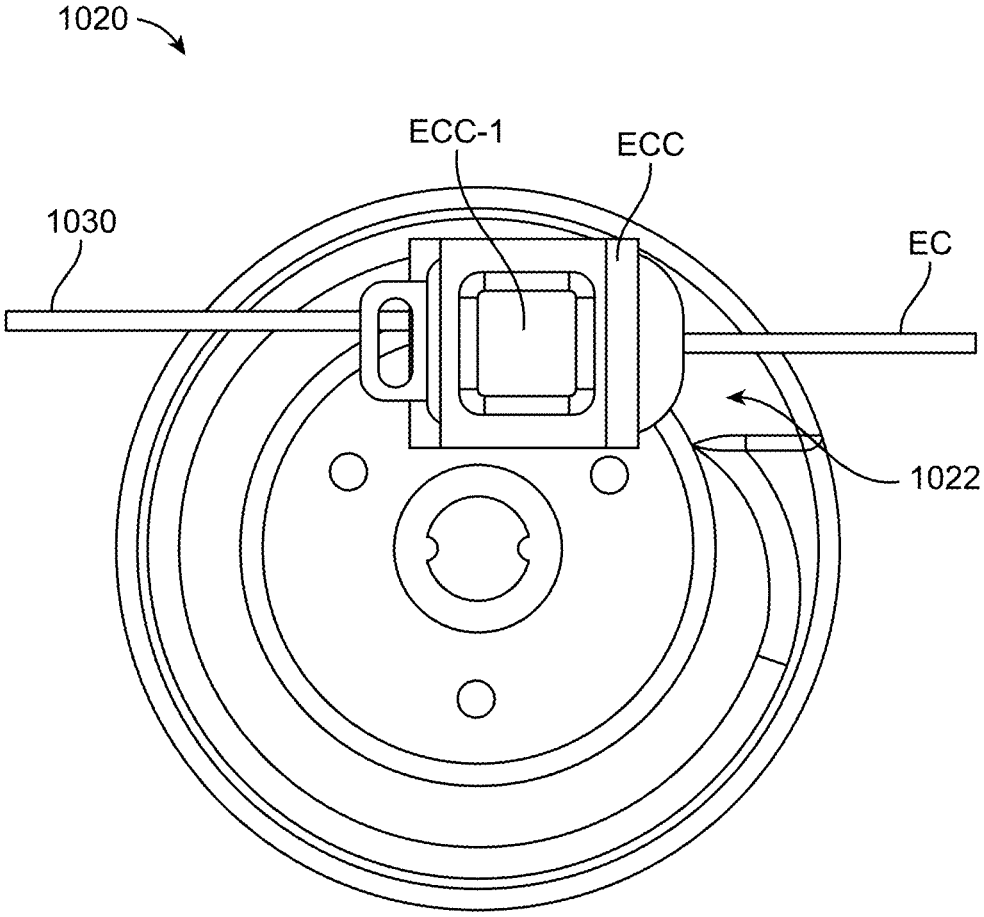
FIG. 12C illustrates side view of the spool assembly of FIG. 12B.
Figure 13:
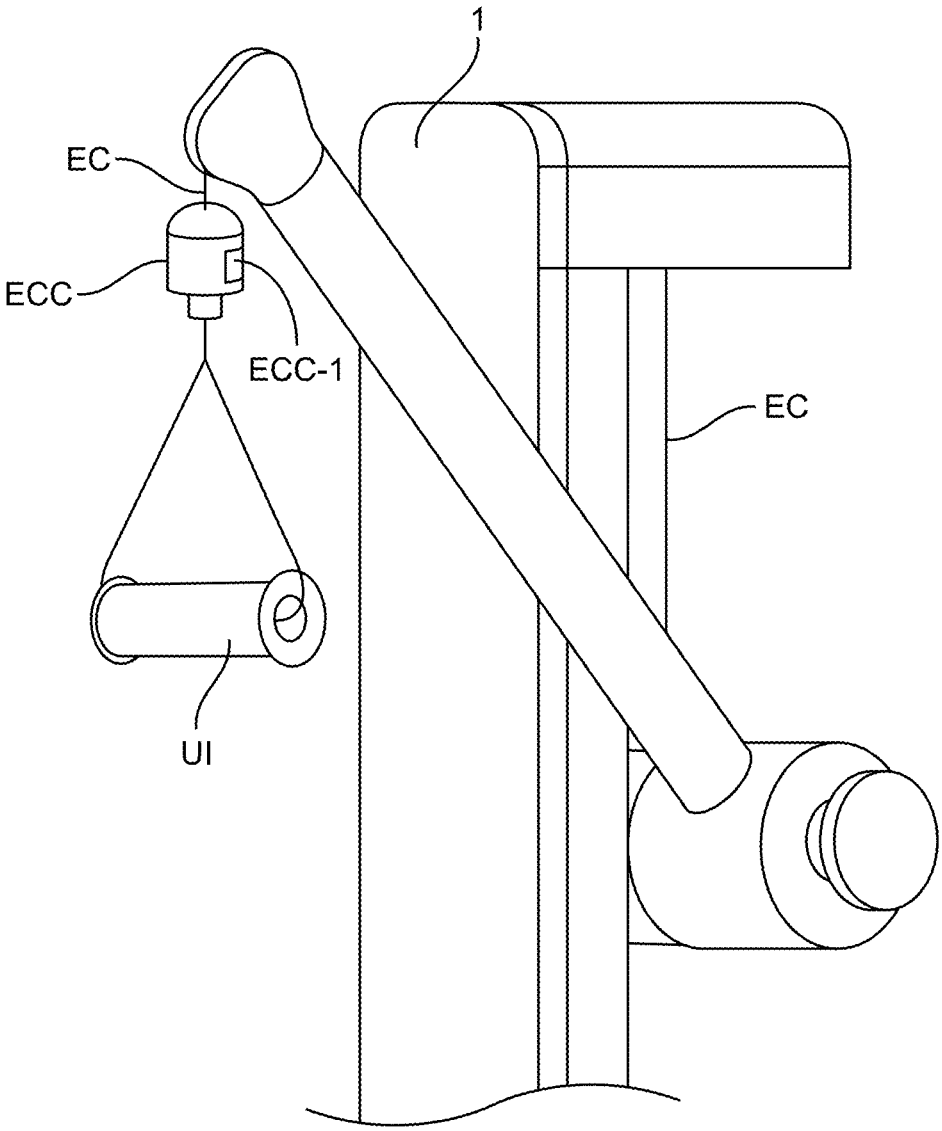
FIG. 13 illustrates a side perspective view of a portion of an exercise equipment according to yet another example of the presently disclosed subject matter.

In the illustrated example, the first and second elements rotation axis FRA and SRA coincide (as shown in FIG. 12A). In some examples, the first and second elements rotation axes FRA and SRA can be spaced from each other and can be parallel to each other. In other examples, the axes can be non-parallel to each other. In general, the first and second rotatable elements need to be connected to each other in a manner that rotation of one (for example, as a result of manipulation of its associated cable) leads to respective rotation of the other.

Attention is directed again to FIGS. 6A and 6B showing the platform 1000 comprising the platform cable 1030 operatively associated with the quick-release interface 1020, which transfers the resistance applied to the equipment cable EC by the resistance source RS to the platform cable 1030 when the equipment cable EC is attached to the quick-release interface 1020, for example as described above. The platform cable 1030 is conveyed through the platform base 1010 via at least one user interface position 1040. It is to be understood herein that the platform 1000 can include more than one user interface positions 1040 (shown as dotted) via which the platform cable 1030 passes. In the illustrated example, the platform 1000 includes one (shown in solid lines) user interface position 1040. A user can access the platform cable 1030 through (or at) the user interface position 1040 and can manipulate the platform cable 1030 for performing an exercise routine. The user interface position 1040 allows a user to apply on the platform cable 1030 a force which counteracts the resistance transferred onto the platform cable 1030 via the quick-release interface 1020.

In the illustrated example, the user interface position 1040 has been shown as being formed as an opening in the top surface 1012 of the housing 1011, thereby allowing access to the platform cable 1030. In some examples, the platform base may not have a housing, and the user interface position can be any position on the platform base at which a user can engage the platform cable.

It is to be understood herein that a user can either directly engage the platform cable 1030, for example by hands, or indirectly by a suitable user interface element. A user interface element can include a hook, a handle, a connector, a loop, a hook pulley, an eye pulley, a sheave, or any equivalent thereof for allowing a user to engage with the platform cable 1030. In some examples, the user interface element can at least partially constitute a part of the platform, while in some examples, the user interface element can be separate from the platform. Some examples of the user interface element are described further below.

As shown schematically in FIG. 6B, a user can engage the platform cable 1030 by a user interface element 1050, which has been shown as (dotted) not being a part of the platform 1000. A user U1 has been schematically shown as standing on the top surface 1012 of the housing 1011 of the platform base 1010, and engaging and manipulating the platform cable 1030 by a user interface element 1050 via a user interface position 1040. It is to be understood herein that the user U1 can stand away from the platform 1000 as well to engage and manipulate the platform cable 1030.

In the illustrated example, the platform 1000 comprises a cable transfer mechanism 1060 including sheaves 1062 via which the platform cable 1030 is conveyed. The sheaves 1062 enable the transfer and movement of the platform cable 1030 when a user manipulates the platform cable 1030. The sheaves 1030 allow the platform cable 1030 to be manipulated in any direction away from the platform base 1010. It is to be understood herein that the user interface position 1040 and/or the cable transfer mechanism 1060 can be positioned anywhere along the platform base, within or external to the housing 1011. In the illustrated example, the cable transfer mechanism 1060 has been shown as being located at the user interface position 1040, while in other examples, the cable transfer mechanism 1060 can be located at a position spaced from the user interface position 1040.

It is to be understood herein that although in the illustrated example, the free platform cable end 1034 has been shown as anchored to the platform base 1010, however in some examples, the free platform cable end 1034 can be anchored to any other component, for example, the cable transfer mechanism. In some examples, the free platform cable end 1034 can be free for being engaged by a user. In such examples, the free platform cable end 1034 can include a cable connector for connecting thereto a user interface element for engaging the platform cable. In some examples, the free platform cable end 1034 can include a cable connector for connecting the free platform cable end 1034 to another platform with functionality similar to the platforms described herein or different from those described herein.

In some examples, the free end of the platform cable can be securely tied or fastened to a designated anchoring element on the platform base, ensuring that the cable end is firmly attached. In some examples, the free end of the platform cable can be threaded through a channel or groove, located for example inside or on the platform, which grips the cable end (and optionally, a segment of the cable adjacent the end) and reduces or prevents unintended detachment of the end of the cable.

Figure 7:
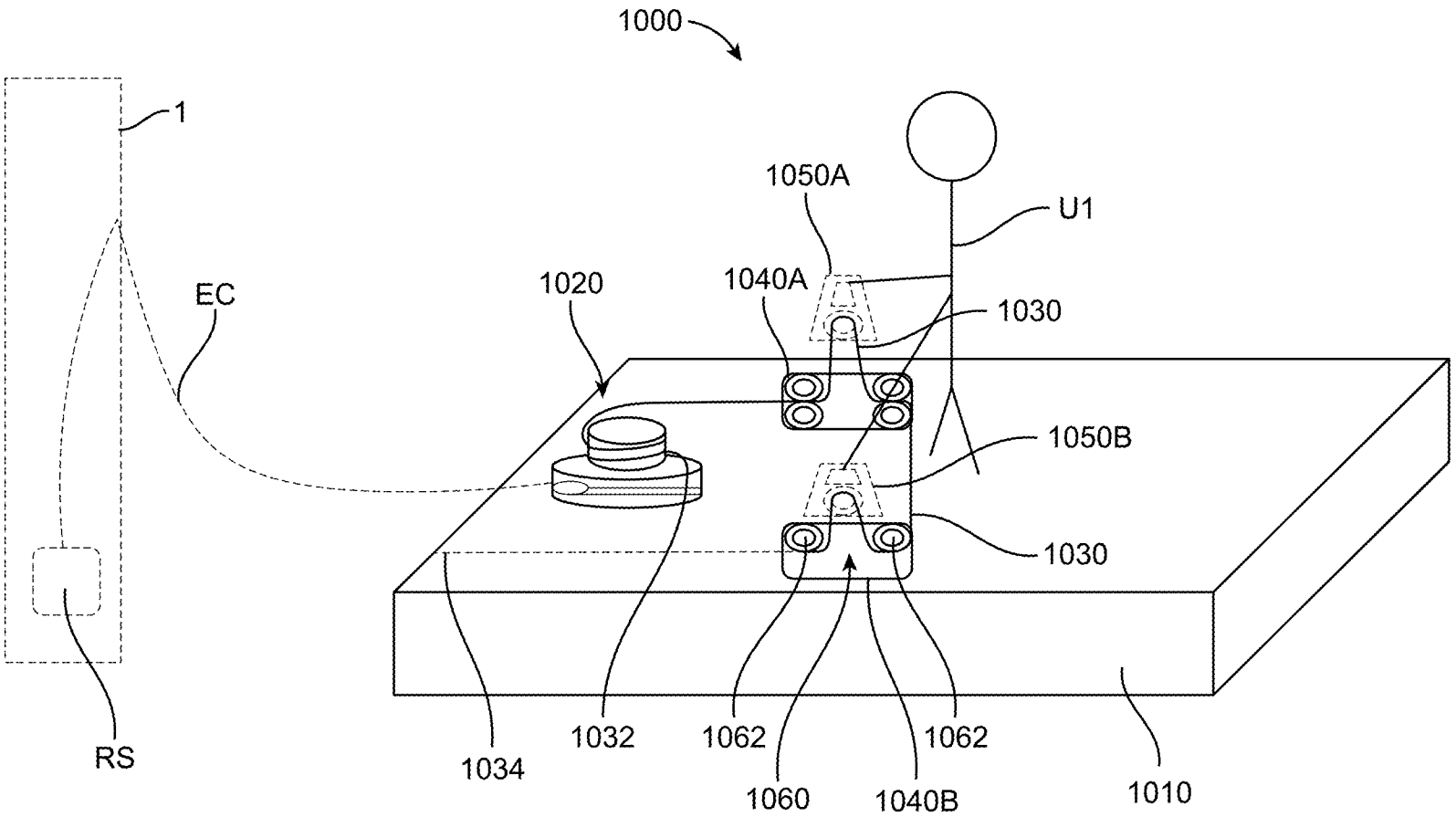
FIG. 7 schematically illustrates a side perspective view of a platform for use with an exercise equipment according to another example of the presently disclosed subject matter.

Reference is now made to FIG. 7 schematically illustrating a platform 1000 according to another example of the presently disclosed subject matter. It is to be understood herein that the platform 1000 shown in FIG. 7 can include some or all the features of the platform 1000 described above with reference to FIGS. 6A and 6B, with some additional features, as described herein below. Accordingly, the description of features of the platform 1000 of FIGS. 6A and 6B apply analogously to corresponding features of the platform 1000 of FIG. 7. Same reference numerals have been used for corresponding features of the platform 1000 of FIGS. 6A and 6B, and FIG. 7.

In the example illustrated in FIG. 7, the platform 1000 includes two user interface positions, i.e., a first user interface position 1040A and a second user interface position 1040B, and the platform cable 1030 passes through each one of the first user interface position 1040A and the second user interface position 1040B. As shown schematically in FIG. 7, a user U1 can simultaneously engage and manipulate the platform cable 1030 at the first and second user interface positions 1040A and 1040B by first and second user interface elements 1050A and 1050B, respectively. In some examples, the first and second user interface elements 1050A and 1050B can at least partially constitute parts of the platform 1000 and can be positioned at the first and second user interface positions 1040A and 1040B respectively, and can be operatively associated with the platform cable 1030. In an example, user interface elements 1050A and 1050B include handles which the user can pull, thereby pulling the platform cable at the two oppositely positioned user interface positions 1040A and 1040B.

It is to be understood herein that the first and second user interface positions 1040A and 1040B can be either simultaneously or independently used by a user based on an exercise routine to be performed. Also, the first and second user interface positions 1040A and 1040B can be positioned at locations different from the ones shown in the illustrated example.

Figure 8:
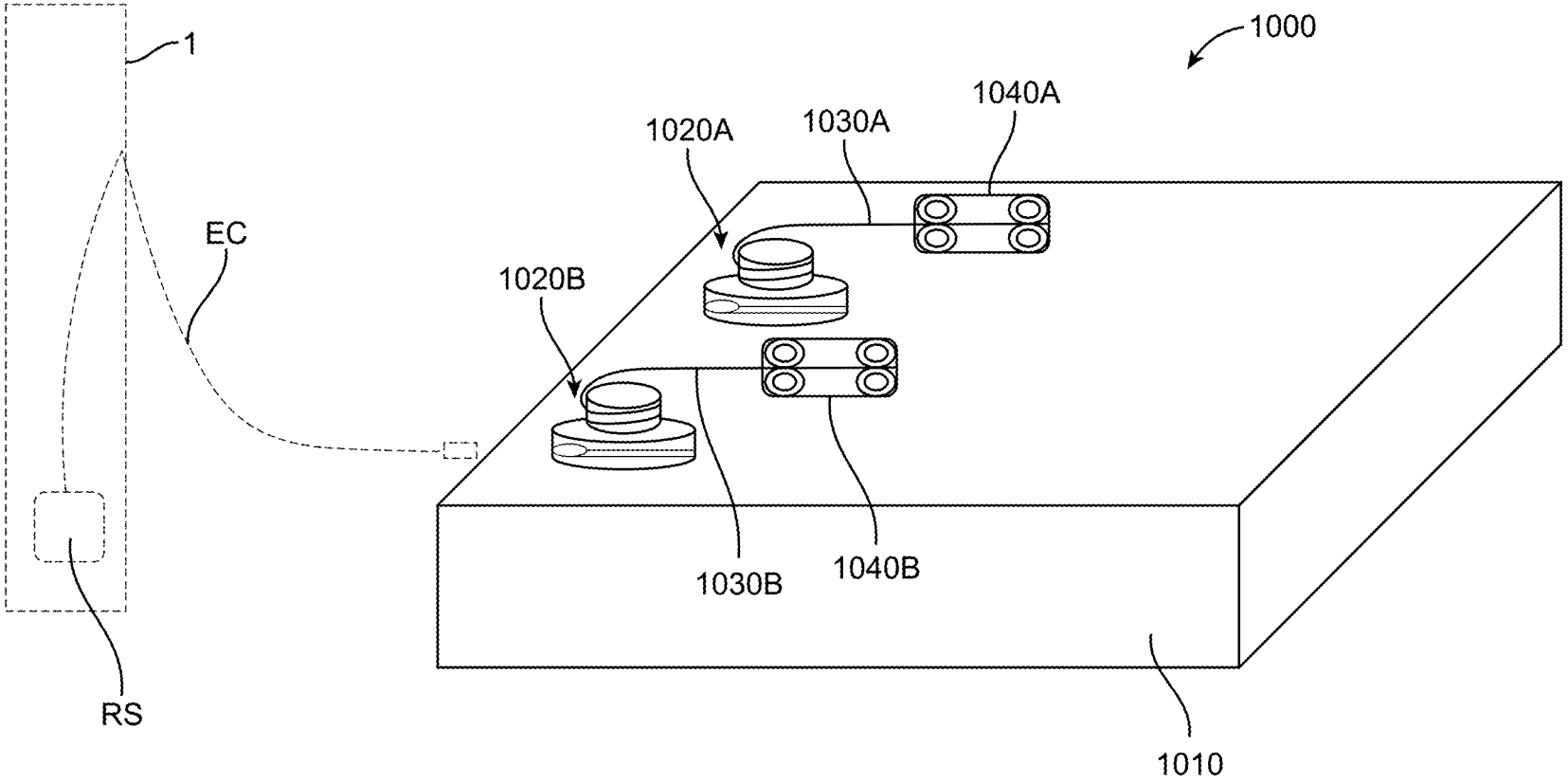
FIG. 8 schematically illustrates a side perspective view of a platform for use with an exercise equipment according to yet another example of the presently disclosed subject matter, showing the platform in use by a user.

Reference is now made to FIG. 8 schematically illustrating a platform 1000 according to yet another example of the presently disclosed subject matter. It is to be understood herein that the platform 1000 shown in FIG. 8 can include some or all the features of the platform 1000 described above with reference to FIGS. 6A and 6B and/or FIG. 7, with some additional features, as described herein below. Accordingly, the description of features of the platform 1000 of FIGS. 6A and 6B and/or FIG. 7 apply analogously to corresponding features of the platform 1000 of FIG. 8. Same reference numerals have been used for corresponding features of the platform 1000 of FIGS. 6A and 6B, FIG. 7, and FIG. 8.

In the example illustrated in FIG. 8, the platform 1000 includes two quick-release interfaces, i.e., a first quick-release interface 1020A and a second quick-release interface 1020B, each of which can include some or all of the features of the quick-release interface described herein above and corresponding description thereof can apply to each one of the first and second quick-release interfaces 1020A and 1020B. The platform 1000 further includes a first platform cable 1030A operatively associated with the first quick-release interface 1020A, and a second platform cable 1030B operatively associated with the second quick-release interface 1020B. The first platform cable 1030A passes through the first user interface position 1040A and the second platform cable 1030A passes through the second user interface position 1040B.

In such setup, the equipment cable can be connected to either the first or second quick release interfaces 1020A, 1020B, and a user can engage the respective first or second platform cable 1030A, 1030B at the respective user interface position (1040A, 1040B) to manipulate it. Alternatively, in some examples there can be an operable attachment between the platform cables (e.g. chaining of the two cables, having an end of the first cable being connected to the quick release interface of the second cable, or as such), allowing both cables to be simultaneously used while only one of the quick release interfaces is connected to the equipment cable.

A user U1 can engage and manipulate a platform cable at the user interface position via a user interface element, such as a handle. In some examples, the user interface element can at least partially constitute a part of the platform 1000 and can be located at the user interface position.

Figure 9:
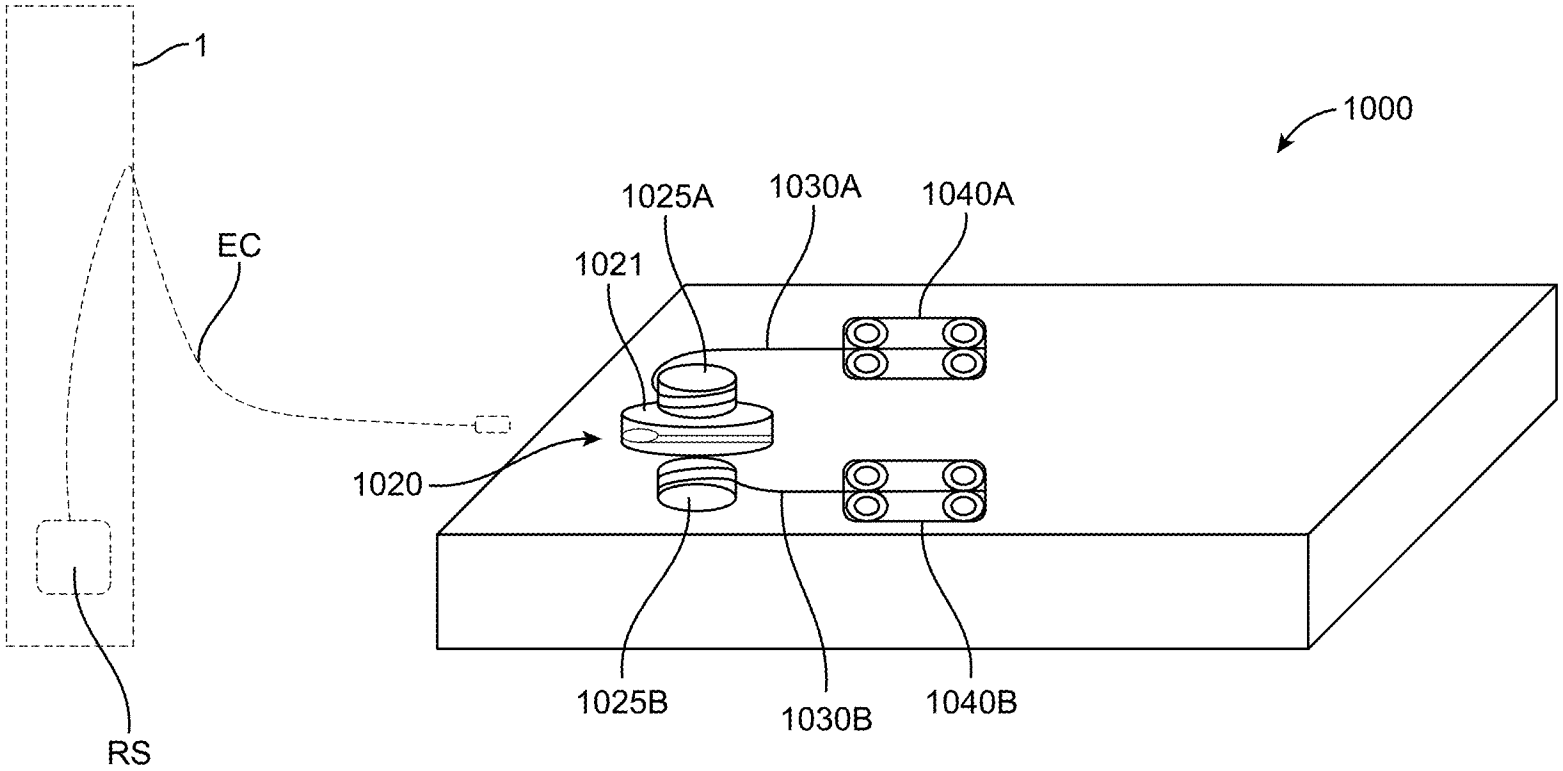
FIG. 9 schematically illustrates a side perspective view of a platform for use with an exercise equipment according to yet another example of the presently disclosed subject matter.

Reference is now made to FIG. 9 schematically illustrating a platform 1000 according to yet another example of the presently disclosed subject matter. It is to be understood herein that the platform 1000 shown in FIG. 9 can include some or all the features of the platform 1000 described above with reference to FIGS. 6A and 6B, FIG. 7, and/or FIG. 8, with some additional features, as described herein below. Accordingly, the description of features of the platform 1000 of FIGS. 6A and 6B, FIG. 7, and/or FIG. 8 apply analogously to corresponding features of the platform 1000 of FIG. 9. Same reference numerals have been used for corresponding features of the platform 1000 of FIGS. 6A and 6B, FIG. 7, FIG. 8, and FIG. 9.

In the example illustrated in FIG. 9, the quick release interface 1020 includes a single first rotatable element 1021 and two second rotatable elements 1025A and 1025B. Each of the two second rotatable elements 1025A and 1025B can include some or all features of the second rotatable element 1025 described herein above, and can operate in the same manner. A first platform cable 1030A is operatively associated with the second rotatable element 1025A, and a second platform cable 1030B is operatively associated with the second rotatable element 1025B. The first platform cable 1030A passes through the first user interface position 1040A and the second platform cable 1030A passes through the second user interface position 1040B.

A user U1 can simultaneously or independently engage and manipulate the first and second platform cables 1030A and 1030B at the first and second user interface positions 1040A and 1040B respectively, by first and second user interface elements, respectively. In some examples, the first and second user interface elements can at least partially constitute parts of the platform 1000 and can be positioned at the first and second user interface positions 1040A and 1040B respectively.

In general, a user interface position can have any size, shape, or location based on the exercise routine that is intended to be performed via the user interface position. Also, according to the user interface position, a user interface element can also be positioned at the user interface position that is suitable for performance of the intended exercise routine. In some examples, a user interface element can at least partially constitute a part of the platform and can be positioned at a user interface position and can be operatively associated with a platform cable. The user interface element can be engaged by a user either directly or indirectly by another user interface element for manipulating the platform cable.

In some examples, a user interface element can include a moveable part which can be moveable with respect to the platform base. A user can at least indirectly engage the moveable part and manipulate the platform cable by applying a force to move the moveable part. In some examples, the moveable part can be moveable along a top plane, which for example can be a horizontal plane when the platform is placed on a horizontal surface. In some examples, the moveable part can be moveable in a plane transverse a horizontal plane, for example, in direction away from and towards the top surface of the platform base. In such examples, the moveable part can be moveable vertically up and down (when the platform is placed on a horizontal surface) or in an inclined direction. The direction of movement can be according to the exercise routine to be performed with a user interface element.

In the examples in which the platform base comprises a housing, the moveable part can at least selectively extend outside the housing. For instance, the moveable part can be, while the platform is not in use, positioned within the housing, and during use can be pulled outside the housing. In some examples, the moveable part can remain within the housing during use, for example when the moveable part moves along the top surface of the housing.

In general, a platform base can comprise a pathway along which the moveable part can move. Such a pathway can be defined by a structure suitable to allow the movement of the moveable part there along. Some examples of such a structure can include a slide along which the moveable part can slide, a roller arrangement, magnetic arrangement, belt, pulley arrangement, rail, track, or equivalents thereof. The moveable part can have any structure corresponding to the structure of the pathway and can move along at least a segment of the pathway.

Figure 10:
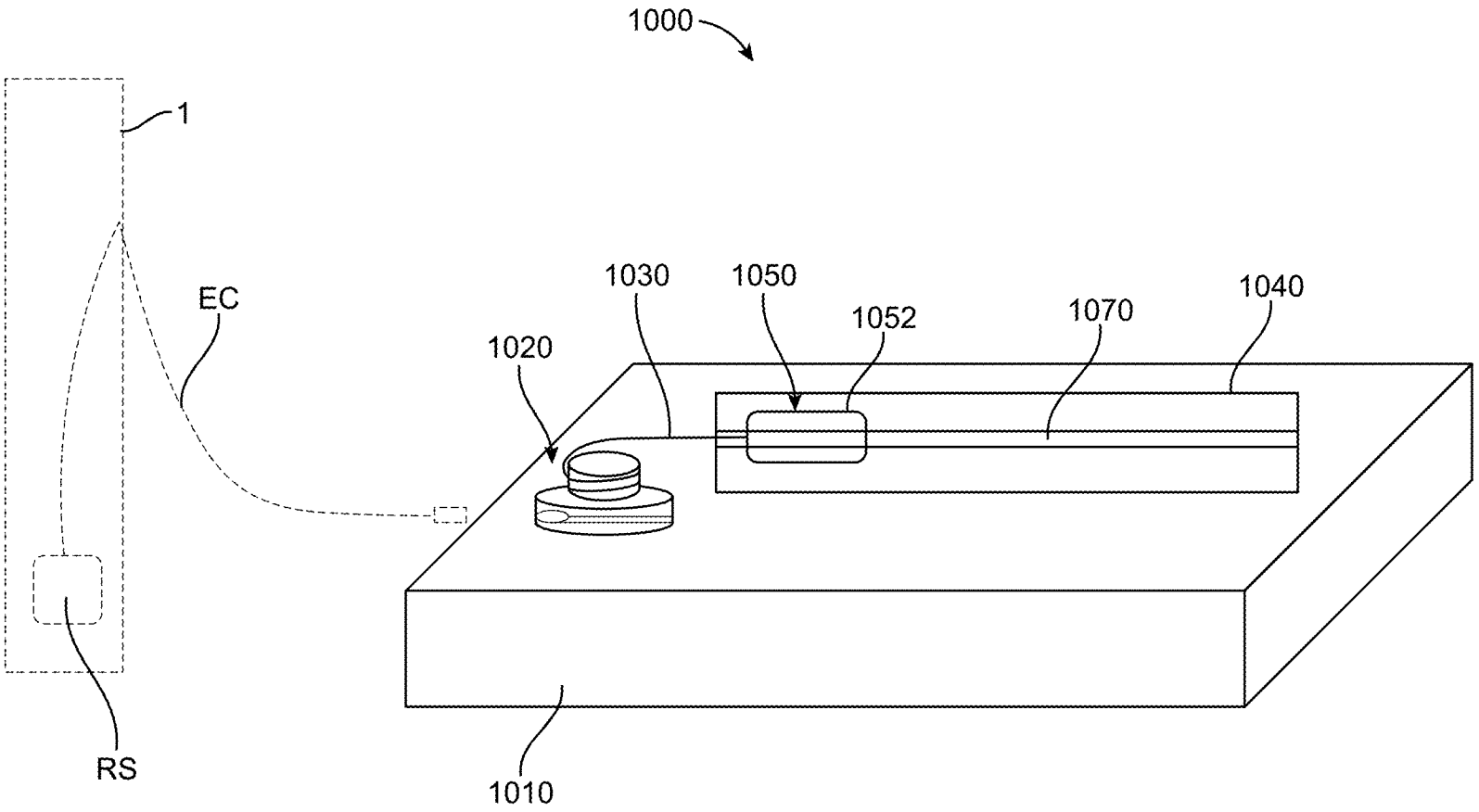
FIG. 10 schematically illustrates a side perspective view of a platform for use with an exercise equipment according to yet another example of the presently disclosed subject matter.

Reference is now made to FIG. 10 schematically illustrating a platform 1000 according to yet another example of the presently disclosed subject matter. It is to be understood herein that the platform 1000 shown in FIG. 10 can include some or all the features of the platform 1000 described above with reference to FIGS. 6A and 6B, FIG. 7, FIG. 8, and/or FIG. 9, with some additional features, as described herein below. Accordingly, the description of features of the platform 1000 of FIGS. 6A and 6B, FIG. 7, FIG. 8, and/or FIG. 9 apply analogously to corresponding features of the platform 1000 of FIG. 10. Same reference numerals have been used for corresponding features of the platform 1000 of FIGS. 6A and 6B, FIG. 7, FIG. 8, FIG. 9, and FIG. 10.

In the example illustrated in FIG. 10, the platform 1000 comprises a track 1070 positioned at the user interface position 1040. The user interface element 1050 includes a moveable part 1052 that can move along the track 1070 in a horizontal plane. The moveable part 1052 is operatively associated with the platform cable 1030 such that moving the moveable part 1052 in a direction away from the quick-release interface 1020 unwinds the platform cable 1030 from the quick-release interface 1020 and moving the moveable part 1052 in a direction towards the quick-release interface 1020 winds the platform cable 1030 onto the quick-release interface 1020. In some examples, the moveable part 1052 can have structure suitable to allow a user to sit or stand thereon for performing an exercise routine. An example of such an exercise routine can include:

- a rowing exercise, generally enabling the wall-mounted exercise equipment to be converted into a rowing exercise equipment by the add-on platform described herein;
- a kayaking exercise, in which dual handles attached to the platform cable(s) can simulate paddling motion, by alternatively pulling each handle;
- a sled pulling or pushing simulation, in which the user can push or pull on a handle or other element slidably coupled to a track of the platform;
- cable based strength training exercises, for example pulling, chest presses, cable rows, and equivalents thereof.

In general, the platform can include additional structures and components for assisting a user in performing the intended exercise routine, for example, handle(s), support element(s), foot-rest(s), anti-skid mat(s), holder(s), bouncing surfaces, etc.

In some examples, a moveable part can have any structure allowing connection of another user interface element (for example, a connector or a handle) thereto which can be held by a user for accessing the moveable part. In some examples, at least a part of the track 1070 can constitute a part of the user interface element 1050 and can thus constitute a fixed part of the user interface element that is fixed with respect to the platform base. In the examples in which the platform base includes a housing, the fixed part can be at least partially within the housing, or can be fully outside the housing.

In general, a user interface element can have any structure that allows a user to manipulate the platform cable. In some examples, the user interface element can include one or more sheaves via which the platform cable can be conveyed. The manipulation of the user interface element can cause the manipulation of the platform cable.

Figure 11A:
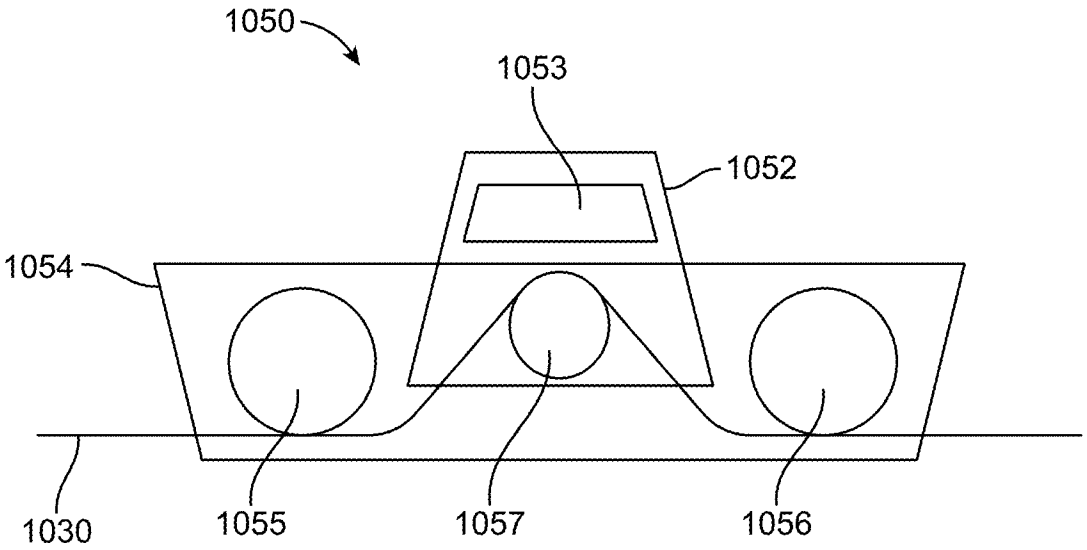
FIG. 11A schematically illustrates a user interface element according to an example of the presently disclosed subject matter.
Figure 11B:
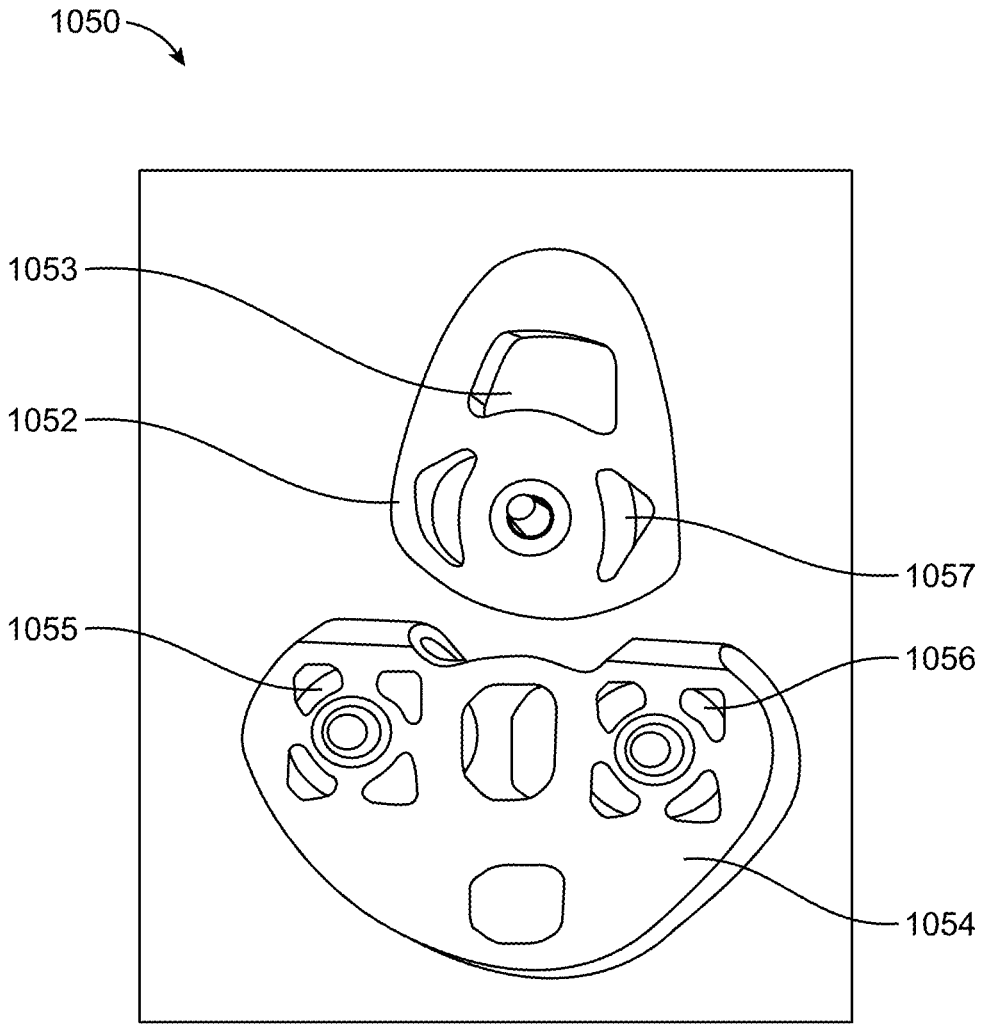
FIG. 11B illustrates a user interface element according to an example of the presently disclosed subject matter.

Reference is now made to FIGS. 11A and 11B illustrating examples of a user interface element 1050 that can be used with, and/or constitute a part of, a platform described above according to various examples. In the illustrated examples, the user interface element 1050 includes a first part 1052, which in the illustrated examples is a moveable part 1052, and a second part 1054, which in the illustrated examples is a fixed part 1054. The fixed part 1054 can be fixed at a user interface position of a platform, for example the platform 1000. The user interface element 1050 comprises three sheaves 1055, 1056, and 1057, out of which the first and second sheaves 1055 and 1056 constitute a part of the fixed part 1054 and form end sheaves 1055 and 1056, and the third sheave 1057 constitutes a part of the moveable part 1052 and form a central sheave 1057 positioned between the end sheaves 1055 and 1056. The platform cable 1030 is conveyed through the sheaves 1055, 1056, and 1057, such that the platform cable 1030 passes under the end sheaves 1055 and 1056, and passes over the central sheave 1057.

During use of the platform, a user can engage, directly or indirectly, and manipulate the moveable part 1052. For instance, the user can directly hold or indirectly engage, for example via connector, handle, hook, etc., an engagement portion 1053 of the moveable part 1052. The user can pull the moveable part 1052 away from the fixed part 1054 and thus from the platform base, thereby pulling the central sheave 1057 away from the end sheaves 1055 and 1056, and further thereby pulling the platform cable 1030.

In some examples, the second part 1054 can be moveable as well with respect to the platform base, for example for adjusting the location of the second part 1054 along the user interface position, or can be moveable during use of the platform when a user manipulates the moveable part 1052.

It is to be understood herein that the description of user interface element can apply to any or all of the user interface positions described above with respect to examples of the platform 1000.

It is to be further understood herein that the structure, orientation, and/or positioning of the quick release interface (s) and/or the cable transfer mechanism, and/or the user interface element(s) can be arranged and/or adjusted to modify the resistance applied to the equipment cable by the resistance source, when the equipment cable is attached to the at least one quick-release interface. For instance, the resistance transferred to the platform cable can be modified as compared to the resistance applied to the equipment cable by the resistance source. In some examples, the resistance transferred to the platform cable can be increased as compared to the resistance applied to the equipment cable by the resistance source, for example by a multiplication factor greater than 1. In some examples, the resistance transferred to the platform cable can be decreased as compared to the resistance applied to the equipment cable by the resistance source, for example by a multiplication factor smaller than 1. In some examples, the resistance transferred to the platform cable can be same as the resistance applied to the equipment cable by the resistance source. The resistance transferred to the platform cable can depend on the structure, orientation, number, and/or positioning of the quick release interface(s), the cable transfer mechanism, and/or the user interface element(s).

When the platform is not in use and/or is to be stored, the platform can be removably attached to the exercise equipment, for example by a hanging arrangement, mounting arrangement, attaching arrangement, or other suitable connectors. The connectors can include at least one of hook, clasp, loop, rope, magnet, or equivalent connection arrangement. In some examples, when the exercise equipment is constructed as a longitudinal wall-mounted beam, the platform may be folded up adjacent the beam when stored, optionally being aligned with the beam.

In some examples, when the platform is not in use, and the equipment cable is not connected to the platform, any manipulation of the platform cable would not be resisted to (i.e., the user would not experience any counter force when attempting to manipulate, e.g. pull, the platform cable). At most, any resistance experienced by the user in such setup would be that of the rotatable element on which the platform cable is wound.

Accordingly, provided herein is an exercise system comprising an exercise equipment that can be used stand-alone for performing a number of exercise routines, and a platform that can be used with the exercise equipment, for example, for enhancing the number of exercise routines that can be performed with the exercise equipment and/or modifying the resistance applied to the equipment cable beyond the limits of the resistance that can be applied by a resistance source of the exercise equipment. Such an exercise system can comprise an exercise equipment according to any of the examples of an exercise equipment described herein and a platform according to any of the examples of a platform described herein. In general, an exercise equipment of such an exercise system can comprise an equipment cable engageable by a user for performing one or more exercise routines, and a resistance source, for example an electronically adjustable motorized resistance source for applying resistance to the equipment cable.

FIG. 13 illustrates an exercise equipment 1 according to an example of the presently disclosed subject matter. The exercise equipment 1 of FIG. 13 can include one or more features of an exercise equipment according to any of the examples of an exercise equipment described herein, and a platform described herein according to various examples can be used with the exercise equipment 1 of FIG. 13. In the example illustrated in FIG. 13, the connector ECC of the cable EC is configured to connect directly to a user interface U1, which can be an exercise accessory (e.g. a handle, a hoop, a rope, a bar, etc.), used solely with the exercise equipment, when the platform is not in use. The same connector ECC can then be used with the platform, for example by pulling on it from the exercise equipment (e.g. from the wrist portion of the arm of the exercise equipment) and connecting it to the quick-release interface of the platform. The buttons ECC-1 can be used for disconnecting the connector ECC from a quick-release interface of the platform, for example, as described above.

In some examples, the platform can be free of any electrical actuators and electrical powering, for example, the platform does not include motors or the like. Optionally, the platform can be free of electrical wiring. In general, the exercise equipment is powered so that the resistance motor will apply resistance onto the equipment cable; then, if and when the platform is connected, that resistance is at least indirectly transferred to the platform cable, and optionally modified by any intermediate components. In other words, the platform is "passive" in the sense that it does not provide (or provides only a very low) resistance if attempted to be used without being coupled to the exercise equipment.

The invention claimed is:

1. An exercise equipment comprising:

a frame having an access opening; and a spool rotatably coupled to the frame, the spool having a spool internal volume defined at least partially by a spool wall operable for winding at least a segment of a cable thereon, the spool wall comprising a hole extending from an exterior side of the spool to the spool internal volume;

wherein the access opening is positioned to provide access to the exterior side of the spool, allowing a user to engage the end of the cable on the exterior side of the spool and to insert the end of the cable into the spool internal volume via the spool wall hole for anchoring the end of the cable to the spool, wherein the exercise equipment further comprises a resistance source to which the spool is at least indirectly coupled, the resistance source being operable to apply resistance onto the cable, when the cable is anchored to the spool, wherein the resistance source is operable to rotate the spool in a winding direction thereby causing the cable to wind onto the spool once the cable is anchored to the spool, and wherein the cable, when pulled by a user against the resistance applied onto the cable by the resistance source, causes the spool to rotate in an unwinding direction, opposite the winding direction, and is unwound from the spool.

2. The exercise equipment of claim 1, further comprising an arm which includes a shoulder portion at least indirectly coupled to the frame and a wrist portion opposite the shoulder portion.

3. The exercise equipment of claim 2, further comprising a cable path between the wrist portion and the spool, the cable path extending at least partially through an internal volume of the arm and an internal volume of the frame.

4. The exercise equipment of claim 3, further comprising at least one cable receiving opening in communication with at least one of the frame internal volume and the arm internal volume, the opening being accessible by a user for pushing therethrough an end of the cable.

5. The exercise equipment of claim 2, wherein the wrist portion is operable to at least indirectly connect thereto an exercise interface.

6. The exercise equipment of claim 1, wherein the frame comprises a vertical, wall mountable beam.

7. The exercise equipment of claim 6, wherein the spool and the access opening are located at a lower portion of the vertical beam.

8. The exercise equipment of claim 1, wherein the access opening is aligned with the exterior side of the spool.

9. The exercise equipment of claim 1, wherein the frame comprises a removable faceplate which, when removed, allows manual access to the access opening of the frame.

10. The exercise equipment of claim 1, wherein the resistance source includes an electronically adjustable weight resistance motor.

11. The exercise equipment of claim 1, wherein the frame prevents access to at least a part of a cable path portion extending within an internal volume of the frame.

12. The exercise equipment of claim 1, wherein the spool includes a cylindrical body and wherein an outer surface of the spool wall comprises grooves for guiding the cable.

13. A method for anchoring a cable to a spool in an exercise equipment, comprising:

removing a faceplate positioned on a frame of the exercise equipment;

through an access opening defined in the frame, manually accessing an end of the cable which had been inserted into the exercise equipment;

inserting the end of the cable into an internal volume of the spool through a hole defined in a wall of the spool;

anchoring the end of the cable to the spool; and operating a resistance source operably coupled to the spool to rotate the spool in a winding direction, thereby causing the cable to wind onto the spool, wherein the resistance source includes an electronically adjustable weight resistance motor.

14. The method of claim 13, wherein anchoring comprises tying a knot at the end of the cable, the knot being larger than the hole defined in the wall of the spool.

15. The method of claim 13, wherein the frame comprises a vertical, wall mountable beam, and the spool and access opening are located at a lower portion of the vertical beam.

16. An exercise equipment comprising:

a frame having an access opening; and a spool rotatably coupled to the frame, the spool having a spool internal volume defined at least partially by a spool wall operable for winding at least a segment of a cable thereon, the spool wall comprising a hole extending from an exterior side of the spool to the spool internal volume, wherein the access opening is positioned to provide access to the exterior side of the spool, allowing a user to engage the end of the cable on the exterior side of the spool and to insert the end of the cable into the spool internal volume via the spool wall hole for anchoring the end of the cable to the spool, and wherein the exercise equipment further comprises an arm which includes a shoulder portion at least indirectly coupled to the frame, and a wrist portion opposite the shoulder portion.

17. The exercise equipment of claim 16, further comprising a cable path between the wrist portion and the spool, the cable path extending at least partially through an internal volume of the arm and an internal volume of the frame.

18. An exercise equipment comprising:

a frame having an access opening, the frame comprising a vertical, wall mountable beam; and a spool rotatably coupled to the frame, the spool having a spool internal volume defined at least partially by a spool wall operable for winding at least a segment of a cable thereon, the spool wall comprising a hole extending from an exterior side of the spool to the spool internal volume, wherein the access opening is positioned to provide access to the exterior side of the spool, allowing a user to engage the end of the cable on the exterior side of the spool and to insert the end of the cable into the spool internal volume via the spool wall hole for anchoring the end of the cable to the spool.

19. The exercise equipment of claim 18, wherein the spool and the access opening are located at a lower portion of the vertical beam.

20. A method for anchoring a cable to a spool in an exercise equipment, comprising:

removing a faceplate positioned on a frame of the exercise equipment;

through an access opening defined in the frame, manually accessing an end of the cable which had been inserted into the exercise equipment;

inserting the end of the cable into an internal volume of the spool through a hole defined in a wall of the spool; and anchoring the end of the cable to the spool;

wherein the frame comprises a vertical, wall mountable beam, and the spool and access opening are located at a lower portion of the vertical beam.

* * * * *